US012161231B2

(12) United States Patent
DeLuca et al.

(10) Patent No.: US 12,161,231 B2
(45) Date of Patent: Dec. 10, 2024

(54) INTERCONVERTING SUPPORT FRAMES HAVING PACK- SUPPORTING AND SEAT-SUPPORTING CONFIGURATIONS

(71) Applicant: Emile Ettore DeLuca, Portland, OR (US)

(72) Inventors: Emile Ettore DeLuca, Portland, OR (US); Otto Aurek Stefan, Bozeman, MT (US)

( * ) Notice: Subject to any disclaimer, the term of this patent is extended or adjusted under 35 U.S.C. 154(b) by 266 days.

(21) Appl. No.: 17/869,695

(22) Filed: Jul. 20, 2022

(65) Prior Publication Data

US 2023/0032476 A1 Feb. 2, 2023

Related U.S. Application Data

(60) Provisional application No. 63/226,392, filed on Jul. 28, 2021.

(51) Int. Cl.
*A47C 4/06* (2006.01)
*A47C 13/00* (2006.01)

(52) U.S. Cl.
CPC ..... *A47C 4/06* (2013.01); *A47C 13/00* (2013.01)

(58) Field of Classification Search
CPC ..... A47C 4/30; A47C 4/06; A47C 4/025; A47C 1/14; A47C 4/022; A47C 13/00
USPC ..... 297/129
See application file for complete search history.

(56) References Cited

U.S. PATENT DOCUMENTS

| | | | | |
|---|---|---|---|---|
| 4,450,990 | A | 5/1984 | Bolstad | |
| 4,738,383 | A | 4/1988 | Dearborn et al. | |
| 4,795,068 | A | 1/1989 | Blean | |
| 5,303,975 | A | 4/1994 | Asato | |
| 5,381,941 | A * | 1/1995 | Brune | A45F 3/26 224/155 |
| 5,588,570 | A | 12/1996 | Zirbel | |
| 5,779,112 | A | 7/1998 | Krulik | |
| 6,547,110 | B2 | 4/2003 | O'Hare | |
| 6,651,853 | B2 | 11/2003 | Higgins et al. | |
| 7,717,309 | B1 | 5/2010 | Lehmberg | |

(Continued)

FOREIGN PATENT DOCUMENTS

DE 2825366 A1 12/1979

*Primary Examiner* — Milton Nelson, Jr.

(57) ABSTRACT

The interconverting support frames include a plurality of interconnecting frame members that are configured to be selectively assembled in a pack frame assembled configuration and a seat frame assembled configuration. The plurality of interconnecting frame members includes a central frame member, a plurality of longitudinal frame members, and a plurality of transitioning frame members. The longitudinal frame members are configured to support a pack of the load-carrying device in the pack frame assembled configuration. The transitioning frame members are configured to interconnect with and selectively disconnect from the central frame member to transition the interconverting support frame between the pack frame and the seat frame assembled configurations. In the seat frame assembled configuration, the plurality of longitudinal frame members and the plurality of transitioning frame members are operably interconnected with the central frame member, and the interconverting support frame is configured to support a seat fabric on a ground surface.

19 Claims, 23 Drawing Sheets

(56) References Cited

U.S. PATENT DOCUMENTS

| | | | | |
|---|---|---|---|---|
| 8,454,084 | B2 | 6/2013 | Lah | |
| 8,646,835 | B2 | 2/2014 | Homans et al. | |
| 8,733,766 | B2 | 5/2014 | Neiman | |
| 8,894,139 | B1 | 11/2014 | Coffey | |
| 8,899,686 | B1 | 12/2014 | Kim | |
| 9,320,332 | B2 | 4/2016 | Zuckerman | |
| 9,332,824 | B2 | 5/2016 | Kriemelmeyer | |
| 9,788,638 | B2 | 10/2017 | Robert et al. | |
| 10,028,587 | B1 | 7/2018 | Kersey | |
| 10,470,579 | B2 | 11/2019 | Frady et al. | |
| 10,631,619 | B2 | 4/2020 | Alphin | |
| 2005/0099039 | A1 | 5/2005 | Rhee | |
| 2010/0237110 | A1 | 9/2010 | Hunter | |
| 2010/0252589 | A1 | 10/2010 | Popescu | |
| 2013/0126564 | A1* | 5/2013 | Savage, Sr. ..... | A45F 4/02 224/155 |
| 2014/0076942 | A1 | 3/2014 | Hurt | |
| 2014/0374450 | A1 | 12/2014 | Kruse | |
| 2018/0110318 | A1 | 4/2018 | Ackerman et al. | |

* cited by examiner

INTERCONVERTING SUPPORT FRAMES HAVING PACK- SUPPORTING AND SEAT-SUPPORTING CONFIGURATIONS

RELATED APPLICATION

This application claims priority to similarly titled U.S. Provisional Patent Application No. 63/226,392, which was filed on Jul. 28, 2021, and the complete disclosure of which is hereby incorporated by reference.

FIELD

The present disclosure relates to interconverting support frames that include pack-supporting and seat-supporting configurations.

BACKGROUND

Load-carrying devices, such as backpacks and luggage, often include a frame that is configured to distribute the weight of a carried load across the load-carrying device. In backpacks, the frame typically is configured to provide structure to the fabric of the backpack and distribute the carried load across a user's back, hips, and shoulders. Regardless of size, all load-carrying devices have some finite carrying capacity that may be limited by the space provided within the particular load-carrying device and/or the weight a user can transport under their own strength. Thus, whether traveling, day-tripping, hiking, or backpacking, a user often must be considerate of the weight, bulk, and number items they choose to pack in the load-carrying device. With this in mind, non-essential or luxury items often are the first to be omitted from the carried load when space or weight is limited.

Particularly in recent years, portable seats have become a popular luxury for use in a variety of activities including travel, hunting, camping, and backpacking. Despite the increasingly lightweight and compact design of these devices, portable seats add carried weight and occupy limited space when transported in a load-carrying device. To address this issue, a number of backpack and luggage designs have been offered in which a portable seat is integrated into or defines a portion of the load-carrying device. Many of these designs claim to offer space and weight savings by providing a hybridized load-carrying device that can be selectively reconfigured, or simply used, as a seat. However, in existing designs, the mechanism that allows the hybridized devices to convert between the seat and load-carrying functions most often is excessively articulated, bulky, or causes the hybridized device to perform poorly in either or both the seat and load-carrying functions. Thus, a need exists for improved support frames having pack-supporting and seat-supporting configurations.

SUMMARY

Interconverting support frames, load-carrying devices including interconverting support frames, and seats including interconverting support frames are disclosed herein. The interconverting support frames include a plurality of interconnecting frame members that are configured to be selectively assembled in a plurality of assembled configurations, which includes a pack frame assembled configuration and a seat frame assembled configuration. The plurality of interconnecting frame members includes a central frame member, a plurality of longitudinal frame members, and a plurality of transitioning frame members. The plurality of longitudinal frame members are configured to engage and support a pack of the load-carrying device in the pack frame assembled configuration. The plurality of transitioning frame members are configured to selectively interconnect with and selectively disconnect from the central frame member to transition the interconverting support frame between the pack frame assembled configuration and the seat frame assembled configuration. In the seat frame assembled configuration, the plurality of longitudinal frame members and the plurality of transitioning frame members are operably interconnected with the central frame member, and the interconverting support frame is configured to support a seat fabric on a ground surface and suspend the seat fabric spaced above the ground surface.

The load-carrying device includes the interconverting support frame in the pack frame assembled configuration and may include a pack comprising a frame-receiving region configured to receive and operably couple to the interconverting support frame in the pack frame assembled configuration. The pack also may include a load compartment configured to carry a load, and interconverting support frame is configured to distribute a weight of the load across the pack.

The seat includes the interconverting support frame in the seat frame assembled configuration and a seat fabric. The seat fabric is configured to engage with and extend between seat-contacting ends of the interconverting support frame. The seat fabric may include receiving regions, each being configured to receive and engage with a respective seat-contacting end of the interconverting support frame.

DETAILED DESCRIPTION

Figure 1:
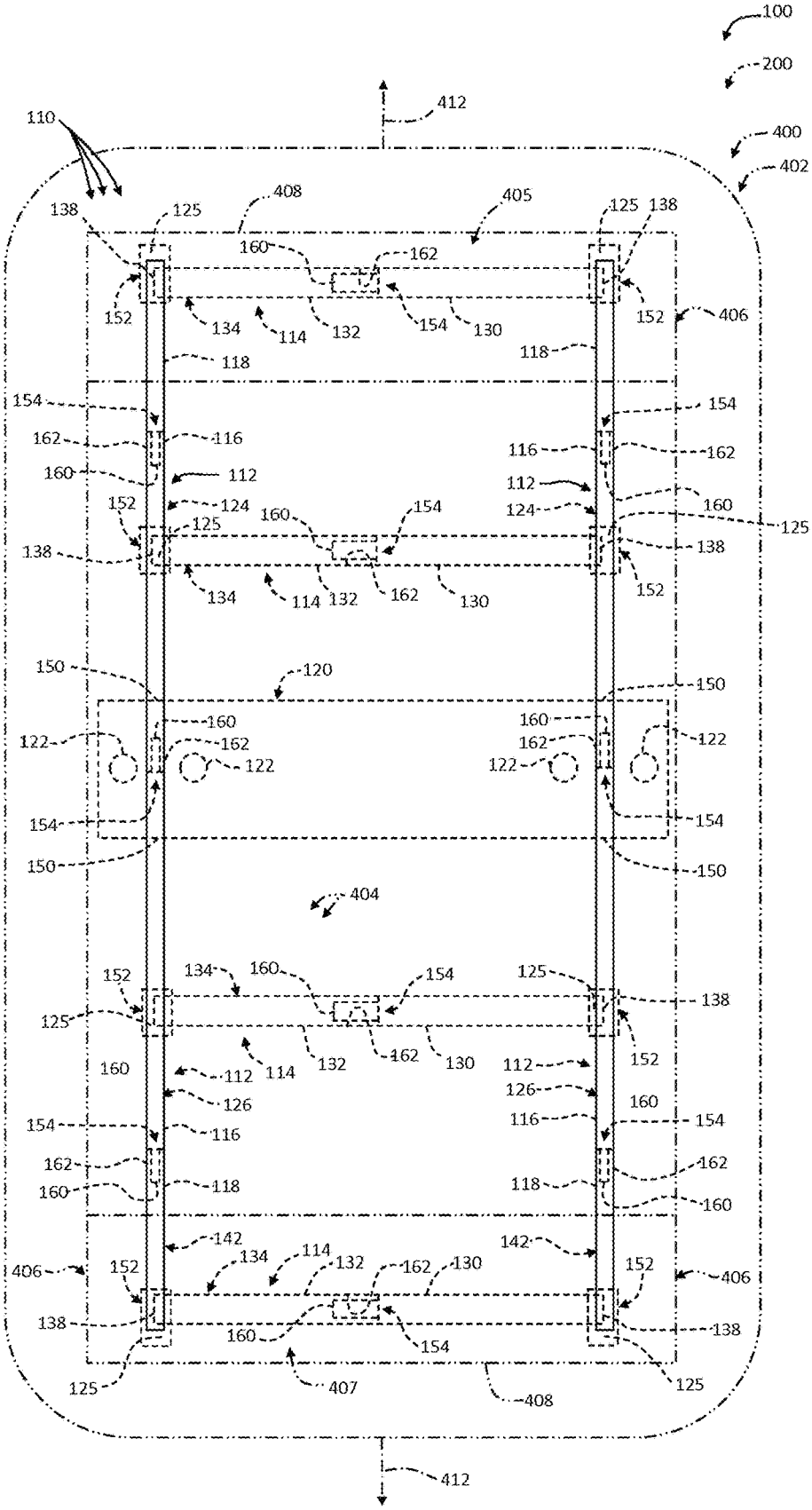
FIG. 1 is a schematic representation showing examples of interconverting support frames in a pack frame assembled configuration according to the present disclosure

FIGS. 1-23 provide examples of interconverting support frames 100, of load-carrying devices 400 including interconverting support frames 100, of seats 301 including interconverting support frames 100, and of central frame members 120 of interconverting support frames 100 according to the present disclosure. Elements that serve a similar, or at least substantially similar, purpose are labelled with like numbers in each of FIGS. 1-23 and these elements may not be discussed herein with reference to each of FIGS. 1-23. Similarly, all elements may not be labelled, but reference numerals associated therewith may be utilized herein for consistency. Elements, components, and/or features that are discussed herein with reference to one or more of FIGS. 1-23 may be included in and/or utilized with any of FIGS. 1-23 without departing from the scope of the present disclosure.

Generally, in the figures, elements that are likely to be included in a given example are illustrated in solid lines, while elements that are optional to a given example are illustrated in dashed lines. However, elements that are illustrated in solid lines are not essential to all examples of the present disclosure, and an element shown in solid lines may be omitted from a particular example without departing from the scope of the present disclosure. Generally in the figures, dot-dash lines may be utilized to indicate defined features, such as dimensions and configurations. Additionally, dot-dot-dash lines may be utilized to indicate structure, components, and/or devices that may be utilized in conjunction with and/or that may include interconverting support frames according to the present disclosure.

Figure 2:
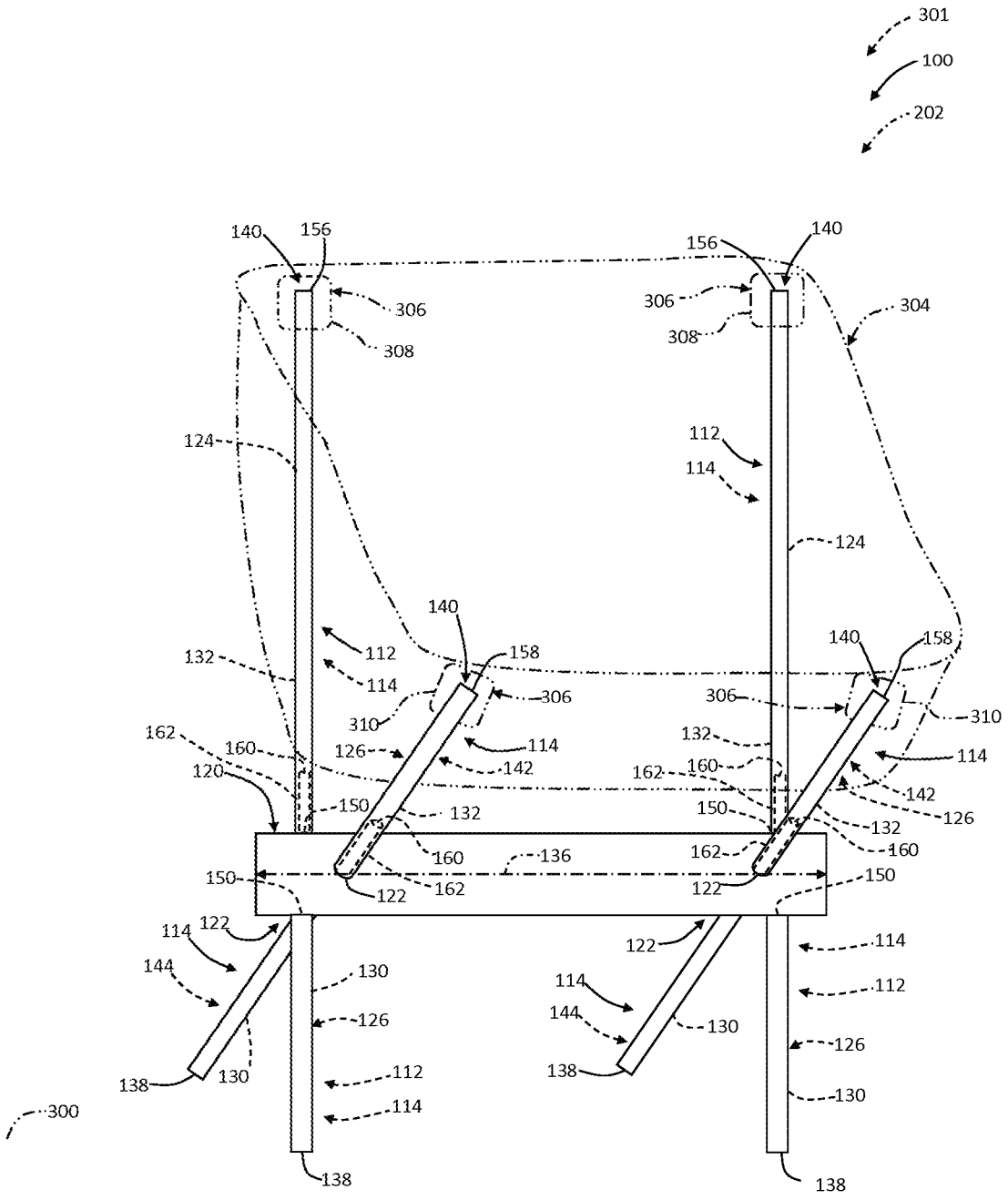
FIG. 2 is a schematic representation sowing examples of interconverting support frames in a seat frame assembled configuration according to the present disclosure.

FIG. 1 is a schematic representation showing examples of interconverting support frames 100 in a pack frame assembled configuration 200 according to the present disclosure, and FIG. 2 is a schematic representation showing examples of interconverting support frames 100 in a seat frame assembled configuration according to the present disclosure. With reference to FIGS. 1 and 2, interconverting support frames 100 include a plurality of interconnecting frame members 110. Interconnecting frame members 110 are configured to be selectively assembled in a plurality of assembled configurations, which include pack frame assembled configuration 200 and seat frame assembled configuration 202. The plurality of interconnecting frame members 110 includes a central frame member 120, a plurality of longitudinal frame members 112, and a plurality of transitioning frame members 114. Longitudinal frame members 112 are configured to engage and support a pack 402 of a load-carrying device 400 in the pack frame assembled configuration 200. Transitioning frame members 114 are configured to selectively interconnect with and selectively disconnect from central frame member 120 to transition interconverting support frame 100 between the seat frame assembled configuration 202 and the pack frame assembled configuration 200.

For example, central frame member 120 may include a plurality of transitioning frame member receivers 122, each being configured to selectively receive and interconnect a respective transitioning frame member 114 to central frame member 120 in seat frame assembled configuration 202. Transitioning frame members 114 may be configured to selectively interconnect with and disconnect from transitioning frame member receivers 122 to transition interconverting support frame 100 between pack frame assembled configuration 200 and seat frame assembled configuration 202. As discussed in more detail herein, transitioning frame member receivers 122 also may orient transitioning frame members 114 to extend from central frame member 120 in a plurality of predetermined orientations in seat frame assembled configuration 202.

In the seat frame assembled configuration 202, interconverting support frame 100 is configured to support a seat fabric 304 on a ground surface 300 and suspend the seat fabric 304 spaced apart from the ground surface 300. In particular, in the seat frame assembled configuration 202, longitudinal frame members 112 and transitioning frame members 114 are operably interconnected with central frame member 120, and central frame member 120 may position and orient longitudinal frame members 112 and transitioning frame members 114 to collectively support seat fabric 304 upon, and spaced apart from, ground surface 300. In some examples, transitioning frame members 114 and longitudinal frame members are operably interconnected with one another, and optionally with central frame member 120, in pack frame assembled configuration 200. Additionally or alternatively, one or more transitioning frame members 114 and/or one or more longitudinal frame members 112 may not be operably interconnected with central frame member 120 and/or may not be interconnected with one another in pack frame assembled configuration 200.

As referred to herein, a transitioning frame member 114 or a longitudinal frame member 112 may be described as being "operably interconnected" with the central frame member 120 when the transitioning frame member 114 or a longitudinal frame member 112 is directly engaged with and/or is directly oriented by connection to the central frame member 120. Interconverting support frame 100 may be configured to be transitioned between pack frame assembled configuration 200 and seat frame assembled configuration 202 any suitable number of times without damage or destruction to interconnecting frame members 110, load-carrying device 400, and/or seat fabric 304. Additionally, interconverting support frame 100 may be configured to be engaged with and disengaged from pack 402 and/or seat fabric 304 any suitable number of times without damage or destruction to interconverting support frame 100, pack 402, and/or seat fabric 304.

Pack 402 may include any suitable device that is configured to carry a load. In pack frame assembled configuration 200, interconverting support frame 100 may be configured to distribute the weight of the load across pack 402. For example, pack 402 may include at least one load compartment 404 configured to contain at least some of the load. Pack 402 may be configured to be carried or otherwise transported by a user. For example, pack 402 may include straps, handles, and the like that a user may utilize to carry pack 402. At least some of, and typically most of, pack 402 is formed of a fabric that surrounds and/or defines the one or more load compartments 404. Pack 402 also may include various mechanisms for selectively enclosing and providing selective access to each load compartment 404. Examples of such mechanisms include zippers, flaps, pull strings, buckles, buttons, latches, clips folds, rolls, and the like. More specific examples of suitable packs 402 that may include or be utilized with interconverting support frames 100 according to the present disclosure include backpacks, internal frame backpacks, external frame backpacks, and/or luggage.

As referred to herein, external frame backpacks may include backpacks in which interconverting support frame 100 is coupled to the exterior of the backpack. Internal frame backpacks may include backpacks in which interconverting support frame 100 is received within and engages the backpack from within an internal compartment thereof, and optionally from within one or more dedicated internal compartments thereof. Interconverting support frames 100 may be configured as an external frame and/or to operably couple to the exterior of an external frame backpack. Additionally or alternatively, interconverting support frames 100 may be configured as an internal frame and/or to be received within the backpack. When interconverting support frame 100 is configured to be utilized with a backpack, pack frame assembled configuration 200 additionally or alternatively may be referred to herein as backpack frame assembled configuration.

Longitudinal frame members 112 additionally or alternatively may be referred to as pack-engaging frame members 112, vertical load-distributing frame members 112, and/or elongate frame members 112. Longitudinal frame members 112 may extend at least substantially parallel to one another and/or along a common plane in pack frame assembled configuration 200 and/or in seat frame assembled configuration 202. In pack frame assembled configuration 200, longitudinal frame members 112 may extend longitudinally along and/or within pack 204. In particular, pack 402 may define a long axis 412 that extends along a length of the pack 402 and/or through top and bottom portions of the pack 402. When engaged with and supporting pack 402 in pack frame assembled configuration 200, longitudinal frame members 112 may extend at least substantially between the top and bottom portion of the pack 402 and/or at least a substantial portion of longitudinal frame member 112 may extend at least partially parallel to long axis 412. In some examples when engaged with and supporting pack 402 in pack frame assembled configuration 200, longitudinal frame members 112 extend at least substantially parallel to the long axis 412 of pack 402 and/or along at least a substantial portion of the length of pack 402. This way, longitudinal frame members 112 may engage and distribute the weight of a carried load along the length or long axis 412 of pack 402. Interconverting support frame 100 also may stiffen pack 402 along the length of pack 402 and/or restrict bending, folding, flexure, and/or deflection of pack 402 along long axis 412.

For examples in which pack 402 includes an internal frame backpack, pack 402 may include a frame-receiving region 406 that is configured to receive and engage interconverting support frame 100 in pack frame assembled configuration 200. Frame-receiving region 406 may extend along at least a substantial portion of the length of pack 402. In some such examples, longitudinal frame members 112 may be configured to extend between an upper portion 405 and a lower portion 407 of frame-receiving region 406 that are spaced apart along the length or long axis 412 of pack 402. In such examples, longitudinal frame members 112 may distribute a load carried by pack 402 between the upper portion 405 and lower portion 407 of frame-receiving region 406 and/or evenly along the length of pack 402. Frame-receiving region 406 may be configured to selectively receive and selectively release interconverting support frame 100 to permit transition of interconverting support frame 100 between pack frame assembled configuration 200 and seat frame assembled configuration 202. In some examples, interconverting support frame 100 and/or longitudinal frame members 112 are configured to be resiliently flexed, and/or resiliently deflected to be received in and removed from frame-receiving region 406.

As more specific examples, frame-receiving region 406 may include a plurality of tension pockets 408 that are configured to selectively engage and selectively release interconverting support frame 100 in pack frame assembled configuration 200. In particular, tension pockets 408 may include a pair of opposed tension pockets 408, one of which being positioned along or defining upper portion 405 of frame-receiving region 406 and the other of which being positioned along or defining lower portion 407 of frame-receiving region 406. In some examples, interconverting support frame 100 is configured to be flexed to be selectively moved into and removed from the pair of opposed tension pockets 408. When received in the pair of tension pockets 408, interconverting support frame 100 may apply an outward force between tension pockets 408 to apply tension across the length of the pack 402. In some examples, this tension applied to pack 402 by interconverting support frame may support pack 402 in a desired shape.

As shown in FIG. 1, longitudinal frame members 112 may include a first pair 124 of longitudinal frame members 112 that are configured to engage upper portion 405 of frame-receiving region 406 of pack 402 in pack frame assembled configuration 200, and a second pair 126 of longitudinal frame members 112 that are configured to engage lower portion 407 of frame-receiving region 406 in pack frame assembled configuration 202. Longitudinal frame members 112 of the first pair 124 may be laterally spaced apart from one another and may extend at least substantially parallel to one another and/or at least substantially along a common plane in pack frame assembled configuration 200. Likewise, longitudinal frame members 112 of the second pair 126 may be laterally spaced apart from one another and may extend at least substantially parallel to one another and/or at least substantially along a common plane in pack frame assembled configuration 200. First pair 124 of longitudinal frame members 112 and second pair 126 of longitudinal frame members 112 may be aligned with one another and/or may intersect with one another directly or via central frame member 120. First pair 124 and second pair 126 of longitudinal frame members also may extend at least substantially parallel to one another and/or at least substantially along a common plane in pack frame assembled configuration 200.

The present discussion focuses on examples in which first pair 124 of longitudinal frame members 112 are configured to engage upper portion 405 of frame-receiving region 406 and second pair 126 of longitudinal frame members 112 are configured to engage a lower portion 407 of frame-receiving region 406. However, it is within the scope of the present disclosure that interconverting support frame 100 may be configured to be rotated, flipped, or otherwise reoriented such that second pair 126 of longitudinal frame members 112 engage upper portion 405 of frame-receiving region 406 and first pair 124 of longitudinal frame members 112 engage lower portion 407 of frame-receiving region 406.

As shown in FIG. 1, in some examples, central frame member 120 may configured to operably support and position at least some of, and optionally all, longitudinal frame members 112 in pack frame assembled configuration 200. In particular, at least some of, and optionally all, longitudinal frame members 112 may be operatively coupled to and extend from central frame member 120 in pack frame assembled configuration 200. Central frame member 120 may extend laterally within pack 402 and may support longitudinal frame members 112 to extend longitudinally within pack 402. In other words, central frame member 120 may extend laterally between longitudinal frame members 112, transverse to longitudinal frame members 112, and/or transverse to the long axis 412 of pack 402. As referred to herein, one element extending transverse to a second element may be defined as the first element extending along a first direction that is normal to, at least partially normal to, or at least substantially normal to a second direction along which the second element extends. As more specific examples, the first direction may form an angle with the second direction that is in the range of at least 30°, at least 40°, at least 50°, at least 60°, at least 70°, at least 80°, at least 90°, at most 70°, at most 80°, at most 90°, at most 100°, at most 110°, at most 120°, at most 130°, and/or at most 140°.

As a more specific example, first pair 124 of longitudinal frame members 112 and second pair 126 of longitudinal frame members 112 may be operatively coupled to central frame member 120 in pack fame assembled configuration 200. Central frame member 120 may support longitudinal frame members 112 of first pair 124 and/or longitudinal frame members 112 of second pair 126 laterally spaced apart from one another along a width 136 of central frame member 120. Thus, in pack frame assembled configuration 200, first pair 124 of longitudinal frame members 112 may engage and support laterally spaced apart portions of upper portion 405 of frame-receiving region 406, and second pair 126 of longitudinal frame members 112 may engage and support laterally spaced apart portions of lower portion 407 of frame-receiving region 406. In this way, interconverting support frame 100 also may distribute loads laterally across pack 402, or in a direction transverse to long axis 412. Interconverting support frame 100 also may provide lateral stiffening to pack 402, and/or restrict flexure, deflection, and/or folding of pack 402 along its lateral dimension.

As shown in FIG. 2, interconverting support frames 100 may include a plurality of ground-contacting ends 138 that are configured to contact ground surface 300 in seat frame assembled configuration 202. As more specific examples, interconverting support frame 100 form include at least three, three, at least four, four, at most four, and/or at most eight ground-contacting ends 138. Ground-contacting ends 138 may be included in transitioning frame members 114 and/or in longitudinal frame members 112. Ground-contacting ends 138 may be specifically configured to contact ground surface 300 and support a load on ground surface 300. As more specific examples, ground-contacting ends 138 may be flared, may include baskets, and/or rubberized ends that are configured to contact ground surface 300 such as without sliding along ground surface 300 and/or penetrating into ground surface 300. The interconnecting frame members 110 that include ground-contacting ends 138 may be of the same length as one another.

Interconverting support frame 100 also may include a plurality of seat-contacting ends 140 that are positioned to engage and support seat fabric 304 in seat frame assembled configuration 202. As examples, interconverting support frame 100 may include at least three, four, at most four, and/or at most six seat-contacting ends 140. Seat-contacting ends 140 may be included in longitudinal frame members 112 and/or transitioning frame members 114. Each transitioning frame member 114 and each longitudinal frame member 112 may include a distal end region that is or that includes a ground-contacting end 138 or a seat-contacting end 140 and a proximal end region that is opposed thereto. The proximal end region of each transitioning frame member 114 and each longitudinal frame member 112 may be interconnected with central frame member 120 in seat frame assembled configuration 202.

In some examples, first pair 124 of longitudinal frame members 112 extend upwardly from central frame member 120 to form a pair of seat-contacting ends 140 in seat frame assembled configuration 202. In some examples, second pair 126 of longitudinal frame members 112 extend downwardly from central frame member 120 form a pair of ground-contacting ends 138 in seat frame assembled configuration 202. In some such examples, each longitudinal frame member 112 of first pair 124 of longitudinal frame members 112 may include a length that is greater than that of each longitudinal frame member 112 of the second pair 126. In this way, seat-contacting ends 140 of first pair 124 of longitudinal frame members 112 are positioned further from central frame member 120 than ground-contacting ends 138 of second pair 126 of longitudinal frame members 112. Each longitudinal frame member 112 of the first pair 124 also may include a length that is greater than that of each transitioning frame member 114.

The interconnecting frame members 110 that include a seat-contacting ends 140 may be of the same length such that interconverting support frame 100 may form a stool in seat frame assembled configuration. Alternatively, two of the interconnecting frame members 110 that include seat-contacting ends 140 may be longer than another two interconnecting frame members 110 that include seat-contacting ends 140 such that interconverting support frame 100 may be configured to form a chair in seat frame assembled configuration 202. Accordingly, seat fabric 304 may be dimensioned and shaped corresponding to interconverting support frame 100 in seat frame assembled configuration 202, such as to form the seat fabric of a chair or the seat fabric of a stool.

As also shown in FIG. 2, seat fabric 304 may include a plurality of receiving regions 306, each being configured receive and engage a seat-contacting end 140 of interconverting support frame 100. Seat fabric 304 may include any suitable number of receiving regions 306 which may correspond to the number of seat-contacting ends 140 defined by interconverting support frame 100. As examples, seat fabric 304 may include at least three, three, at least four, four, at most four, and/or at most eight receiving regions 306. Receiving regions 306 may include pockets and/or may be referred to as frame-receiving pockets 306. Receiving regions 306 may include fabric pockets, sockets, and/or molded sockets that are dimensioned and shaped to receive seat-contacting ends 140. Receiving regions 306 each may be disposed along any suitable region of seat fabric 304 such as a peripheral region thereof and/or at corners of seat fabric 304. Seat fabric 304 may be dimensioned and shaped such that, when supported by interconverting support frame 100 in seat frame assembled configuration 202, seat fabric 304 forms a support surface that is sized and shaped to support at least a portion of a user's bottom and lower torso. When interconverting support frame 100 is coupled to seat fabric 304 to suspend seat fabric above ground surface 300, interconverting support frame 100 and seat fabric 304 may be described as collectively forming a seat 301 that is configured to support a user seated in seat fabric 304. With this in mind, interconverting support frame 100 may be configured to support the weight of a user seated in seat fabric 304 in seat frame assembled configuration 202.

In seat frame assembled configuration 202, first pair 124 of longitudinal frame members 112 and/or second pair 126 of longitudinal frame members 112 may extend at least substantially parallel to one another and/or along a common plane. Central frame member 120 may support first pair 124 of longitudinal frame members 112 and/or second pair 126 of longitudinal frame members 112 laterally spaced apart from one another, such as along the width 136 of central frame member 120. In this way, first pair 124 of longitudinal frame members 112 may contact and support receiving regions 306 disposed at laterally spaced apart upper portions of seat fabric 304, such as the upper corners thereof. Similarly, second pair 126 of longitudinal frame members 112 may support seat 301 on laterally spaced apart regions of ground surface 300. Alternatively, second pair 126 of longitudinal frame members 112 may support laterally spaced apart lower portions of seat fabric 304, such as the lower corners thereof. In such examples, central frame member 120 orients second pair 126 of longitudinal frame members 112 transverse to first pair 124 of longitudinal frame member in seat frame assembled configuration 202.

Longitudinal frame members 112 may be coupled to central frame member 120 in any suitable manner. As shown in FIGS. 1 and 2, central frame member 120 may support longitudinal frame members 112 to extend at least substantially transverse to central frame member 120 in pack frame assembled configuration 200 and in seat frame assembled configuration 202. In some examples, first pair 124, and/or second pair 126, of longitudinal frame members 112 are fixedly coupled to central frame member 120. For some examples in which first pair 124 and second pair 126 of longitudinal frame members 112 are fixedly coupled to central frame member 120, each longitudinal frame member 112 of the first pair 124 may be coextensive with, fixedly coupled to, and/or monolithic with a respective longitudinal frame member 112 of the second pair 126.

Additionally or alternatively, central frame member 120 may include a pair of longitudinal frame member receivers 150 that are configured to selectively couple first pair 124 of longitudinal frame members 112 to central frame member 120 and selectively release first pair 124 of longitudinal frame members 112 from central frame member 120. As discussed in more detail herein, first pair 124 of longitudinal frame members 112 may be oriented, relative to the other interconnecting frame members 110, in a pack frame orientation in pack frame assembled configuration 200 and may be oriented in a seat frame orientation in seat frame assembled configuration 202. First pair 124 of longitudinal frame members 112 may be configured to rotate between the pack frame orientation and the seat frame orientation to transition interconverting support frame 100 between pack frame assembled configuration 200 and seat frame assembled configuration 202. Longitudinal frame member receivers 150 may be configured to receive, orient, and optionally restrict rotation of first pair 124 of longitudinal frame members 112 in the pack frame orientation and the seat frame orientation. Longitudinal frame member receivers 150 also may be configured to selectively release first pair 124 of longitudinal frame members 112 to permit rotation thereof between the pack frame orientation and the seat frame orientation.

Central frame member 120 also may include a pair of longitudinal frame member receivers 150 that are configured to selectively couple second pair 126 of longitudinal frame members 112 to central frame member 120 and selectively release second pair 126 of longitudinal frame members 112 from central frame member 120. As discussed in more detail herein, second pair 126 of longitudinal frame members 112 may be coupled to central frame member 120 by the respective pair of longitudinal frame member receivers 150 in pack frame assembled configuration 200, and second pair 126 of longitudinal frame members 112 may be coupled to central frame member 120 by a pair of transitioning frame member receivers 122 in seat frame assembled configuration 202. In such examples, second pair 126 of longitudinal frame members 112 may be described as forming a pair of transitioning frame members 114. Longitudinal frame member receivers 150 also may be configured to receive transitioning frame members 114 in seat frame assembled configuration 202, such discussed herein.

First pair 124 of longitudinal frame members 112 may be coupled to, or interconnected with, second pair 126 of longitudinal frame members 112 in pack frame assembled configuration 200. In some examples, first pair 124 and second pair 126 of longitudinal frame members 112 collectively include a pair of telescopic coupling mechanisms 154 that are configured to selectively couple first pair 124 and second pair 126 of longitudinal frame members 112 to one another, at least in pack frame assembled configuration 200. In particular, telescopic coupling mechanisms 154 may be included in the proximal end regions of first pair 124 and second pair 126 of longitudinal frame members 112. Telescopic coupling mechanism 154 may include a telescopic insert portion 160 and a telescopic receiving portion 162. Telescopic insert portion 160 is configured to be selectively received in and selectively released from telescopic receiving portion 162. In such examples, telescopic insert portions 160 may be included in one of first pair 124 and second pair of longitudinal frame members 112 and telescopic receiving portions 162 may be included in the other of first pair 124 and second pair 126 of longitudinal frame members 112. As discussed in more detail herein, telescopic coupling mechanisms 154 also may be configured to selectively couple longitudinal frame members 112 to central frame member 120 and/or may be configured to couple with longitudinal frame member receivers 150 of central frame member 120.

Additionally or alternatively, longitudinal frame members 112 and transitioning frame members 114 may be configured to be disconnected from central frame member 120 in pack frame assembled configuration 200. In other words, longitudinal frame members 112 and transitioning frame members 114 may be configured to form a support frame for pack 402 without being connected to central frame member 120. In such examples, longitudinal frame members 112 and transitioning frame members 114 may only be interconnected with central frame member 120 in seat frame assembled configuration 202. In some such examples, central frame member 120 may be stowed in pack 402 when interconverting support frame 100 is utilized in pack frame assembled configuration 200.

As shown in FIG. 1, at least some, and optionally all, transitioning frame members 114 may be disconnected from the central frame member 120 and/or transitioning frame member receivers 122 thereof in pack frame assembled configuration 200. In some examples, interconverting support frame 100 is configured to form pack frame assembled configuration 200 with at least one, and optionally a plurality of transitioning frame members 114 disconnected from the other interconnecting frame members 110. In other words, at least one, and optionally a plurality of, transitioning frame members 114 may be stowed in pack 402 in pack frame assembled configuration 200.

Additionally or alternatively, one or more transitioning frame members 114 may extend between and interconnect two respective longitudinal frame members 112 in pack frame assembled configuration 202. In particular, the one or more transitioning frame members 114 may extend transverse to the one or more longitudinal frame members 112 and/or at least substantially parallel to central frame member 120 in pack frame assembled configuration 200. In some such examples, transitioning frame member 114 may extend between and interconnect distal end regions of the two respective longitudinal frame members 112 of in pack frame assembled configuration 200. Alternatively, transitioning frame member 114 may extend between and interconnect the midsections of the two respective longitudinal frame members 112.

The two respective longitudinal frame members 112 may be first pair 124 of longitudinal frame members 112 or second pair 126 of longitudinal frame members 112. As discussed herein, the distal end, portion, or region of a longitudinal frame member 112 may refer to the end, portion, or region of longitudinal frame member 112 that is positioned furthest from central frame member 120. In some such examples, transitioning frame members 114 form a closed shape with the two respective longitudinal frame members 112 in pack frame assembled configuration 200, which may enhance the strength of interconverting support frame 100 in pack frame assembled configuration 200.

In some examples, interconverting support frame 100 includes a plurality of transitioning frame member couplers 152, each being configured to interconnect an end region of a transitioning frame member 114 with a longitudinal frame member 112 in the pack frame assembled configuration 200 and selectively release the end region of the respective transitioning frame member 114 from the respective longitudinal frame member 112 to transition interconverting support frame 100 from pack frame assembled configuration 200 to seat frame assembled configuration 202. In particular, interconverting support frame 100 may include a pair of transitioning frame member couplers 152 for each transitioning frame member 114 and through which transitioning frame member 114 is coupled to two respective longitudinal frame members 112. As an example, each transitioning frame member coupler 152 may include a socket or a tubular socket that is coupled to a desired portion of longitudinal frame member 112 and configured to selectively receive and selectively release an end region of transitioning frame member 114.

Transitioning frame member couplers 152, the ends of transitioning frame members 114, and/or the ends of longitudinal frame members 112 each include a rotational retaining mechanism 125 that is configured to restrict transitioning frame members 114 and/or longitudinal frame members 112 from rotating within transitioning frame member couplers 152. Such a configuration may enhance the rigidity of interconverting support frame 20 by preventing torsional flexure of interconverting support frame 29. As examples, rotational retaining mechanism 125 may include a key, a recess, and/or a non-circular cross section formed in transitioning frame member 114, longitudinal frame member 112, and/or transitioning frame member coupler 152.

With continued reference to FIGS. 1 and 2, one or more longitudinal frame members 112 may include a first segment 116 and a second segment 118 that are configured to selectively interconnect with and disconnect from one another. When second segment 118 is disconnected from first segment 116, second segment 118 may be regarded herein as a transitioning frame member 114. In particular, second segment 118 may define the distal end of longitudinal frame member 112, and first segment 116 may be directly coupled, and optionally fixedly coupled, to central frame member 120 in pack frame assembled configuration 200. In seat frame assembled configuration 202, second segment 118 may be disconnected from first segment 116. Second segment 118 may be directly coupled to central frame member 120 via a transitioning frame member receiver 122 to form a seat-contacting end 140 or a ground-contacting end 138.

As shown in FIG. 1, transitioning frame members 114 may include one or more segmented transitioning frame members 134. Each segmented transitioning frame members 134 includes a first transitioning frame member segment 130 and a second transitioning frame member segment 132 that are configured to selectively interconnect with and selectively disconnect from one another to transition interconverting support frame 100 between pack frame assembled configuration 200 and seat frame assembled configuration 202. First transitioning frame member segment 130 and second transitioning frame member segment 132 generally may be referred to herein transitioning frame member segments.

In pack frame assembled configuration 200, first transitioning frame member segment 130 and second transitioning frame member segment 132 may be directly interconnected with one another, coextensive with one another, coaxial with one another, and/or colinear with one another. In seat frame assembled configuration 202, first transitioning frame member segment 130 and second transitioning frame member segment 132 each may be directly or operatively interconnected with central frame member 120. As a more specific example, and as shown in FIG. 2, first transitioning frame member segment 130 and second transitioning frame member segment 132 may be at least partially interposed by central frame member 120 such as while remaining operatively engaged with one another, in seat frame assembled configuration 202.

First transitioning frame member segment 130 and second transitioning frame member segment 132 also may be configured to selectively interconnect with and selectively disconnect from central frame member 120 to transition interconverting support frame 100 between pack frame assembled configuration 200 and seat frame assembled configuration 202. With this in mind, first transitioning frame member segment 130 and second transitioning frame member segment 132 also may be regarded as being transitioning frame members 114.

As a more specific example, segmented transitioning frame members 134 each may include a telescopic coupling mechanism 154 that is configured to selectively couple first transitioning frame member segment 130 and second transitioning frame member segment 132 to one another. In particular, telescopic coupling mechanism 154 may include a telescopic insert portion 160 that is included in one of first transitioning frame member segment 130 and second transitioning frame member segment 132 and a telescopic receiving portion 162 that is included in the other of first transitioning frame member segment 130 and second transitioning frame member segment 132. Telescopic insert portion 160 is configured to be selectively received in and removed from telescopic receiving portion 162.

When telescopic insert portion 160 is received in telescopic receiving portion 162, telescopic coupling mechanism 154 interconnects first transitioning frame member segment 130 and second transitioning frame member segment 132 such as in the manner discussed herein. Telescopic coupling mechanism 154 also may support first transitioning frame member segment 130 and second transitioning frame member segment 132 to extend in a desired orientation relative to one another, such as a colinear orientation, end-to-end orientation, and/or a coextensive orientation.

As an example, telescopic receiving portion 162 may include a tubular socket with any suitable cross-sectional shape (e.g., circular, square, rectangular, octagonal, or ovular) normal to the direction in which telescopic insert portion 160 is interested therein. Telescopic insert portion 160 may include a protrusion having an exterior shape corresponding to the interior profile of the tubular socket of telescopic receiving portion 162. In such a configuration, an exterior surface of telescopic insert portion 160 may engage an interior surface of telescopic receiving portion 162 to selectively retain telescopic insert portion 160 within telescopic receiving portion 162. In some examples, telescopic insert portion 160 includes a collar, ledge, or stop that may support telescopic insert portion 160 at a desired depth or extent within telescopic receiving portion 162, such that the transitioning frame member 114 formed of first transitioning frame member segment 130 and second transitioning frame member segment 132 may have a desired length.

Telescopic coupling mechanism 154 also may be configured to selectively couple first transitioning frame member segment 130 and second transitioning frame member segment 132 to central frame member 120 in seat frame assembled configuration 202. For example, as mentioned, central frame member 120 may include a plurality of transitioning frame member receivers 122, each being configured to selectively receive and interconnect a respective transitioning frame member 114 to central frame member 120. As examples, transitioning frame member receiver 122 may include a socket that is dimensioned and shaped to receive, engage, orient, and/or support an end region of transitioning frame member 114 and/or a selected portion of telescopic coupling mechanism 154. Each transitioning frame member receiver 122 may extend within an interior volume of central frame member 120. Each transitioning frame member receiver 122 also may extend transverse to width 136 of central frame member 120. Two transitioning frame member receivers 122 may be coextensive, collinear, and/or coaxial with one another such as to support two transitioning frame members 114, or segments thereof, to extend in a collinear, coextensive, and/or coaxial manner from opposed sides of central frame member 120.

As more specific examples, transitioning frame member receiver 122 may include a bore that extends at least partially through central frame member 120 and/or a socket, or a tubular socket that is attached to and/or that extends at least partially through central frame member 120. For some examples in which transitioning frame member receiver 122 includes a socket, the socket may project from, and extend transverse to, central frame member 120 to support a portion of the fabric of pack 402 when interconverting support frame 100 is in the pack frame assembled configuration 200.

In some examples, transitioning frame member receiver 122 extends through central frame member 120, and telescopic insert portion 160 is configured to be received in and extend through the transitioning frame member receiver 122 and receive telescopic receiving portion 162 on the other side of central frame member 120 from which transitioning frame member receiver 122 is inserted into central frame member 120. In such examples, telescopic insert portion 160 and telescopic receiving portion 162 each may be described as being operatively connected with central frame member 120, as transitioning frame member receiver 122 may directly orient and support both telescopic insert portion 160 and telescopic receiving portion 162.

Central frame member 120 may include transitioning frame member receivers 122 that are specifically configured to receive and engage telescopic insert portion 160 and/or telescopic receiving portion 162. In some examples, central frame member 120 includes transitioning frame member receivers 122 that are coextensive with one another with one being dimensioned and shaped to receive telescopic insert portion 160 and the other being dimensioned and shaped to receive telescopic receiving portion 162. In some such examples, telescopic insert portion 160 and telescopic receiving portion 162 may interconnect with one another within central frame member 120 while both being received in respective transitioning frame member receivers 122.

As shown in FIG. 1, for examples in which one or more longitudinal frame member 112 includes first segment 116 and second segment 118, the one or more longitudinal frame member 112 may include telescopic coupling mechanism 154. Telescopic coupling mechanism 154 may selectively interconnect first segment 116 and second segment 118 with one another in a similar, or at least substantially similar, manner to that discussed herein for the segmented transitioning frame member 134. Similarly, telescopic coupling mechanism 154 may be configured to selectively interconnect first segment 116 and/or second segment 118 with a transitioning frame member receiver(s) 122 of central frame member 120 in seat frame assembled configuration 202, such as in a similar, or at least substantially similar, manner to that discussed herein for segmented transitioning frame member 134.

As shown in FIG. 2, longitudinal frame members 112 and transitioning frame members 114 may extend oblique relative to ground surface 300 in seat frame assembled configuration 202. In seat frame assembled configuration 202, transitioning frame members 114 may extend at least substantially transverse to and/or normal to central frame member 120. Also, in seat frame assembled configuration 202, two or more transitioning frame members 114 may extend transverse to, and/or at least substantially normal to longitudinal frame members 112. As more specific examples, transitioning frame members 114 may extend transverse to and/or at least substantially normal to a plane along which first pair 124 of longitudinal frame members 112 and/or second pair 126 of longitudinal frame members 112 extend. In this way, the ends of longitudinal frame members 112 and transitioning frame members 114 may be positioned in a spaced apart relationship, with each end being positioned to contact a respective region of seat fabric 304 or ground surface 300.

At least two transitioning frame members 114 or at least two transitioning frame member segments may define seat-contacting transitioning frame members 142 that extend upwardly relative to central frame member 120 to contact and support seat fabric 304 in seat frame assembled configuration 202. At least two other transitioning frame members 114, or at least two other transitioning frame member segments, may define ground-contacting transitioning frame members 144 that extend downwardly from central frame member 120 to contact ground surface 300 in seat frame assembled configuration 202. In some examples, ground-contacting transitioning frame members 144 and seat-contacting transitioning frame members 142 are coextensive with, interconnected, and/or extend parallel to one another in seat frame assembled configuration 202.

Interconverting support frame 100 may include any suitable number of longitudinal frame members 112, such as two, three, four, five, or six longitudinal frame members 112. Interconverting support frame also may include any suitable number of transitioning frame members 114, such as at least two, at least three, three, at least four, four, eight, at most two at most three, at most four, at most six, and/or at most eight transitioning frame members 114.

Longitudinal frame members 112 and/or transitioning frame members 114 may be elongated and may include any suitable cross-sectional shape normal to the elongated dimension. As a more specific example, longitudinal frame members 112 and/or transitioning frame members 114 may include an elongated tubular shape with any suitable cross-sectional shape normal to the elongated dimension. Examples of suitable cross-sectional shapes include circular, ovular, polygonal, square, triangular, and/or hexagonal shapes. For examples in which transitioning frame members 114 and/or longitudinal frame members 112 include telescoping coupling mechanism 154, one end of thereof may be tapered or narrowed such as to fit into the open end of another transitioning frame member 114, longitudinal frame members 112, transitioning frame member receiver 122 and/or longitudinal frame member receiver 150.

Central frame member 120 also may include any suitable shape. As examples, central frame member 120 may be hollow, tubular, and/or elongated along width 136 thereof. In some examples, central frame member 120 includes a diameter, as measured normal to width 136, that is greater than the diameter of transitioning frame member 114 and/or longitudinal frame member 112. In this way, central frame member 12 may be dimensioned to receive and support transitioning frame member 114 and/or longitudinal frame member 112.

Central frame member 120, transitioning frame members 114, and longitudinal frame members 112 may be formed from any suitable one or more materials. As examples, central frame member 120, transitioning frame members 114, and/or longitudinal frame members 112 may be formed of one or more metals, carbon fiber, fiber glass, fiber-reinforced composite materials, plastic, steel, aluminum, aluminum alloys, titanium alloys, and/or combinations thereof.

Interconverting support frame 100 may define a total length in pack frame assembled configuration 200 that may be measured parallel to long axis 412 and/or from the distal ends of first pair 124 of longitudinal frame members 112 to the distal ends of second pair 126 of longitudinal frame members. As examples, the total length of interconverting support frame 100 in pack frame assembled configuration 200 may be at least 30 centimeters (cm), at least 35 cm, at least 40 cm, at least 45 cm, at least 50 cm, at least 52 cm, at least 54 cm, at least 56 cm, at least 58 cm, at least 60 cm, at most 35 cm, at most 40 cm, at most 45 cm, at most 50 cm, at most 52 cm, at most 54 cm, at most 56 cm, at most 58 cm, at most 60 cm, at most 65 cm, at most 70 cm and/or at most 80 cm.

Each longitudinal frame member 112 may define a length that is measured from the proximal end thereof to the distal end thereof. As examples, the length of each longitudinal frame member 112 of first pair 124 may be at least 25 cm, at least 30 cm, at least 35 cm, at least 40 cm, at least 45 cm, at least 50 cm, at least 55 cm, at least 60 cm, at most 35 cm, at most 40 cm, at most 45 cm, at most 50 cm, at most 55 cm, at most 60 cm, at most 70 cm, and/or at most 75 cm. As more examples, the length of each longitudinal frame member 112 of second pair 126 may be at least 5 cm, at least 10 cm, at least 15 cm, at least 20 cm, at least 25 cm, at least 30 cm, at least 35 cm, at least 40 cm, at least 45 cm, at most 10 cm, at most 15 cm, at most 20 cm, at most 25 cm, at most 30 cm, at most 35 cm, at most 40 cm, at most 45 cm, and/or at most 50 cm.

The width 136 of central frame member 120 may be at least 15 cm, at least 17 cm, at least 18 cm, at least 19 cm, at least 20 cm, at least 21 cm, at least 22 cm, at least 23 cm, at least 24 cm, at least 25 cm, at least 26 cm, at least 27 cm, at least 28 cm, at least 29 cm, at least 30 cm, at most 18 cm, at most 20 cm, at most 22 cm, at most 24 cm, at most 26 cm, at most 28 cm, at most 30 cm, at most 32 cm, at most 34 cm, at most 36 cm, and/or at most 38 cm, at most 40 cm. As discussed in more detail herein, central frame member 120 may be configured such that the width 136 thereof is adjustable to be greater in seat frame assembled configuration 202 than in pack frame assembled configuration 200.

Each transitioning frame member 114 may be configured to possess any suitable length, which is measured between the ends thereof. For example, when transitioning frame members 114 extend between longitudinal frame members 112 in pack frame assembled configuration 200, transitioning frame members 114 may be configured with a length that is at least substantially the same as the width 136 central frame member 120 and/or the separation between longitudinal frame members 112 as measured parallel to the width 136 of central frame member 120.

As more specific examples, the length of ground-contacting transitioning frame members 144 may be at least 5 cm, at least 6 cm, at least 7 cm, at least 8 cm, at least 9 cm, at least 10 cm, at least 12 cm, at least 14 cm, at most 6 cm, at most 8 cm, at most 9 cm, at most 10 cm, at most 12 cm, at most 14 cm, at most 16 cm, at most 18 cm, and/or at most 20 cm. As yet more specific examples, the length of seat-contacting transitioning frame members 142 may be at least 14 cm, at least 15 cm, at least 16 cm, at least 17 cm, at least 18 cm, at least 19 cm, at least 20 cm, at least 22 cm, at least 24 cm, at least 26 cm, at least 28 cm at least 30 cm, at most 15 cm, at most 16 cm, at most 18 cm, at most 20 cm, at most 22 cm, at most 24 cm, at most 26 cm, at most 28 cm, at most 30 cm, at most 32 cm, and/or at most 34 cm.

Turning now to FIGS. 3-22, illustrative non-exclusive examples of interconverting support frames 100, central frame members 120, seats 301, load-carrying devices 400, and/or central frame members 120 are provided. Where appropriate, reference numerals from the schematic illustrations of FIGS. 1-2 are used to designate corresponding parts of the examples of FIGS. 3-22. However, the examples of FIGS. 3-22 are non-exclusive and do not limit interconverting support frames 100, seats 301, load-carrying devices 400, and/or central frame members 120 to the illustrated embodiments of FIGS. 3-22. That is, interconverting support frames 100, seats 301, load-carrying devices 400, and/or central frame members 120 are not limited to the specific embodiments of FIGS. 3-22, and interconverting support frames 100, seats 301, load-carrying devices 400, and/or central frame members 120 may incorporate any number of the various aspects, configurations, characteristics, properties, variants, options etc. of interconverting support frames 100, seats 301, load-carrying devices 400, and/or central frame members 120 that are illustrated in and discussed with reference to the schematic representations of FIGS. 1-2 and/or the embodiments of FIGS. 3-22, as well as variations thereof, without requiring the inclusion of all such aspects, configurations, characteristics, properties, etc. Furthermore, any additional aspects, configurations, characteristics, properties, variants, options, etc. disclosed in connection with the interconverting support frames 100, seats 301, load-carrying devices 400, and/or central frame members 120 of any of FIGS. 3-22 may be used and/or otherwise included with other interconverting support frames 100, seats 301, load-carrying devices 400, and/or central frame members 120 according to the present disclosure, including interconverting support frames 100, seats 301, load-carrying devices 400, and/or central frame members 120 according to FIGS. 1-2 or others of FIGS. 3-22. For the purpose of brevity, each previously discussed component, part, portion, aspect, region, etc. or variants thereof may not be discussed, illustrated, and/or labeled again with respect to the examples of FIGS. 3-22; however, it is within the scope of the present disclosure that the previously discussed features, variants, etc. may be utilized with the examples of FIGS. 3-22.

Figure 3:
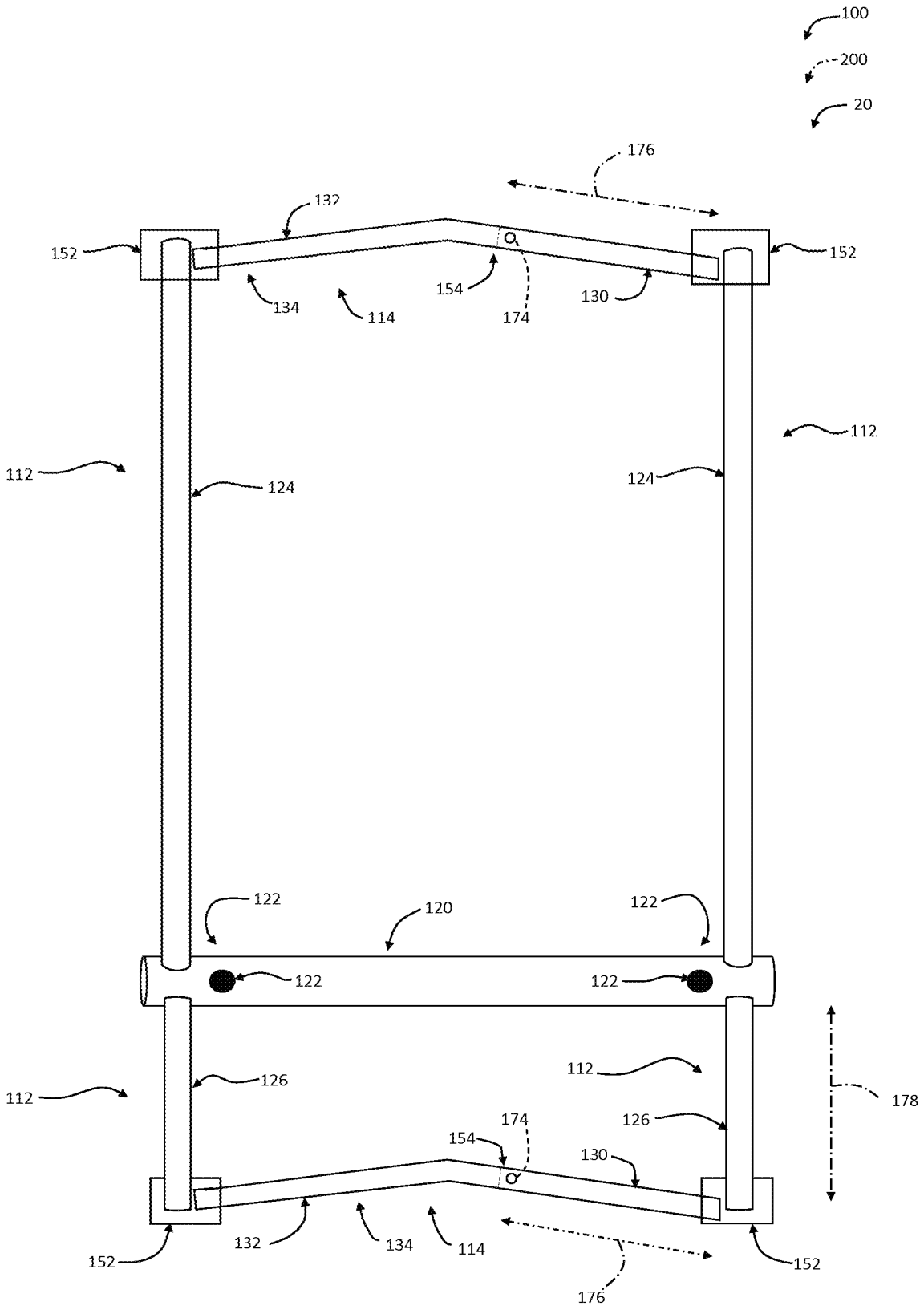
FIG. 3 is a front elevation view showing less schematic examples of interconverting support frames in the pack frame assembled configuration.
Figure 4:
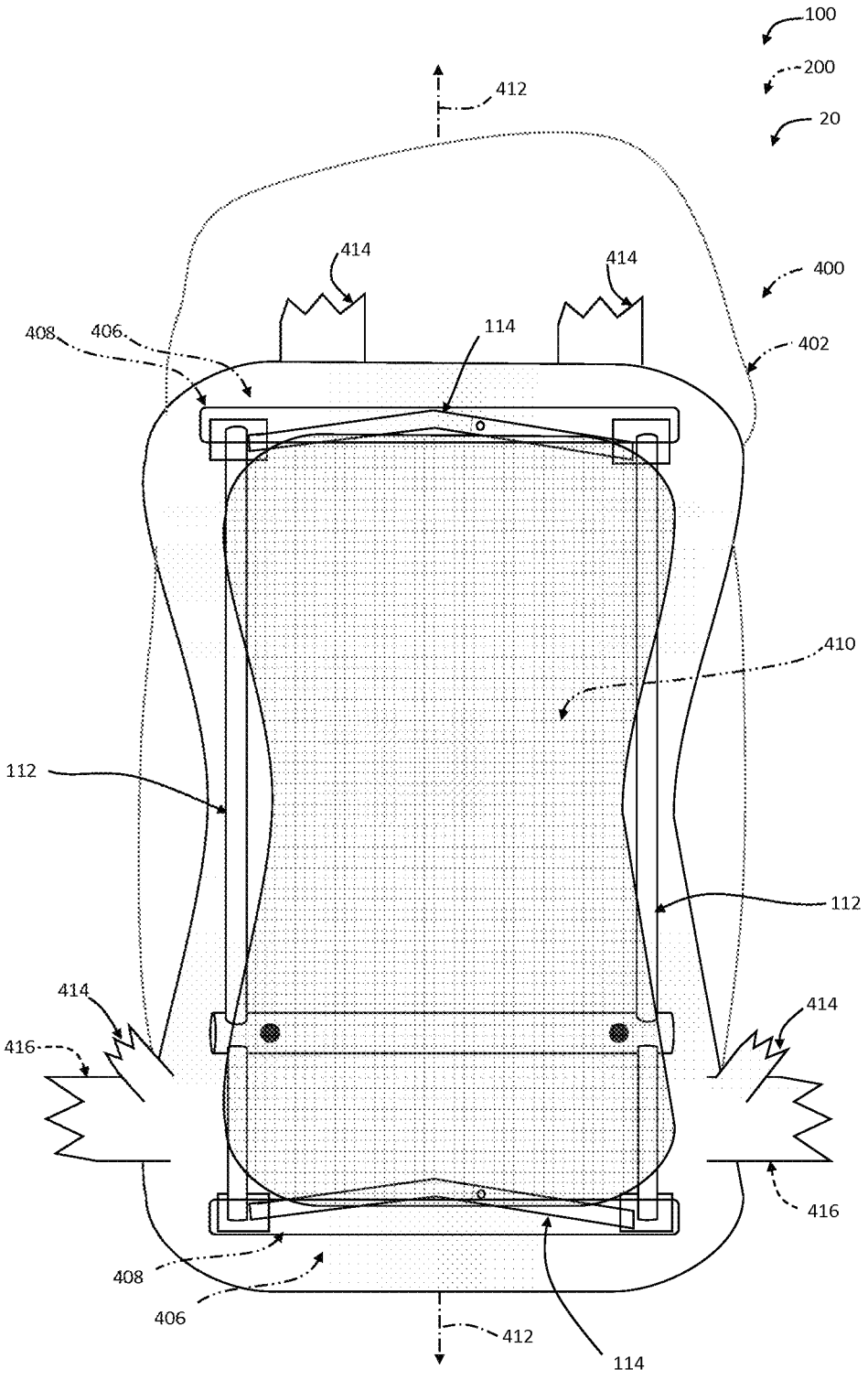
FIG. 4 is a front elevation view showing examples of a load-carrying device that includes the interconverting support frame of FIG. 3.
Figure 5:
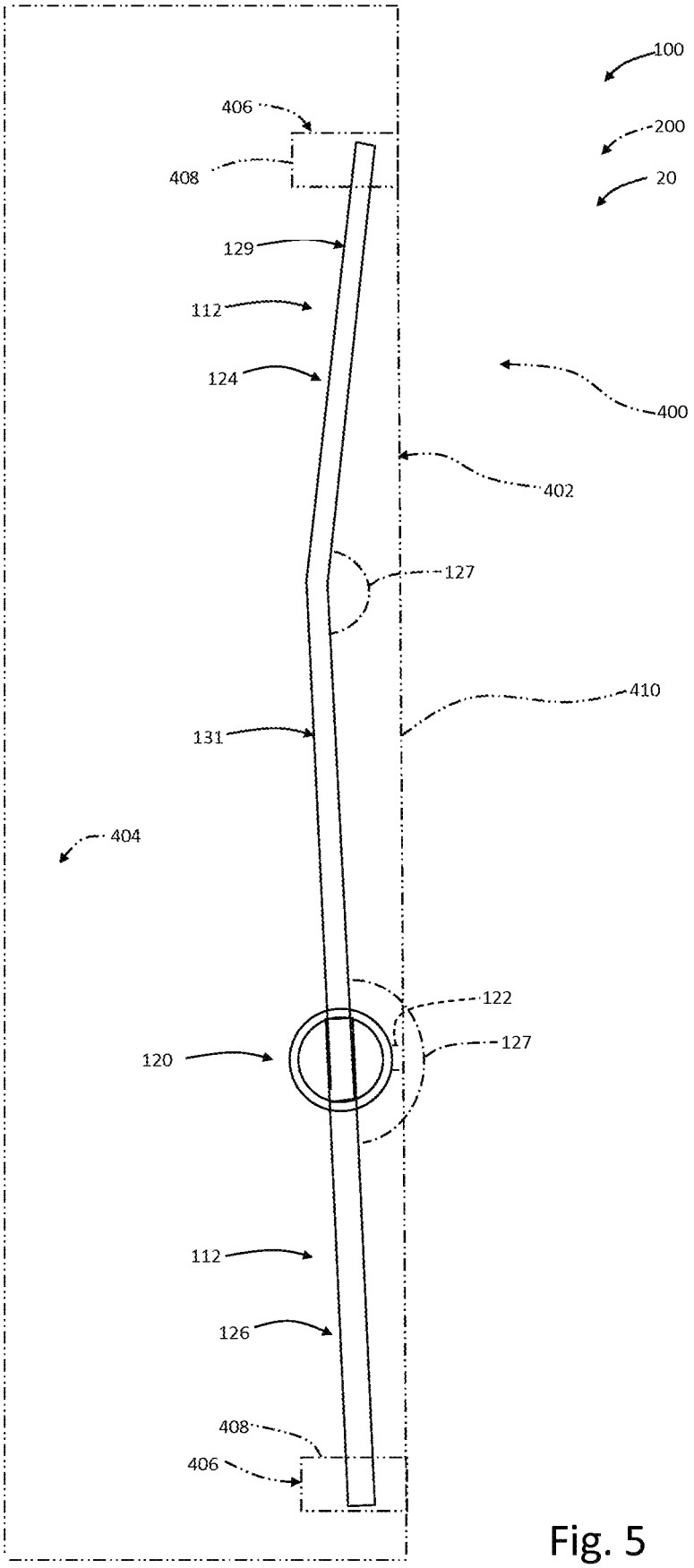
FIG. 5 is a schematic side elevational view showing examples of the interconverting support frames of FIG. 3 engaged with the pack of a load-carrying device.
Figure 6:
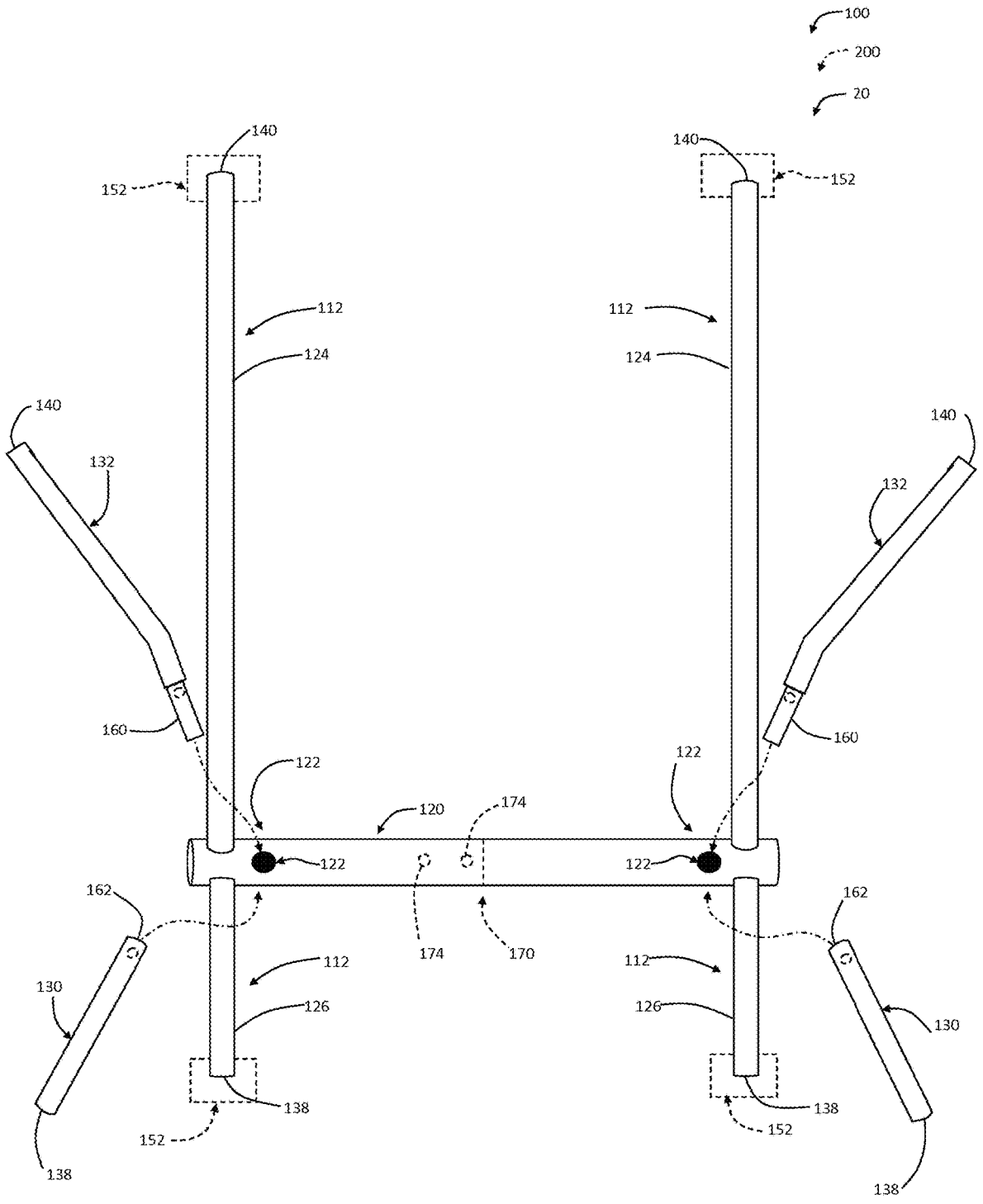
FIG. 6 is an exploded elevation view showing examples of the interconverting support frames of FIG. 3 being transitioned between the pack frame assembled configuration to the seat frame assembled configuration.
Figure 7:
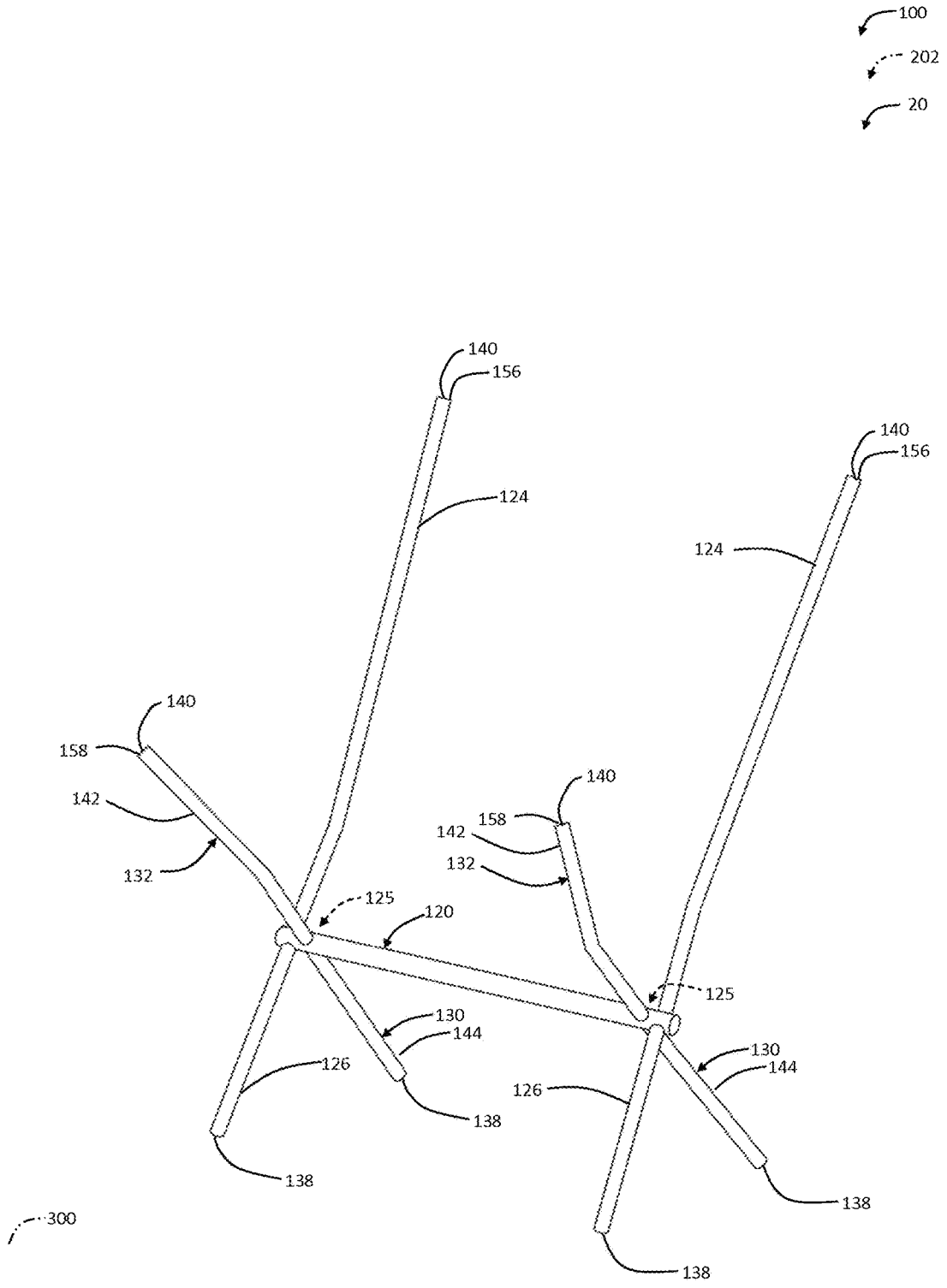
FIG. 7 is an isometric view showing an example of the interconverting support frames of FIG. 3 in the seat frame assembled configuration.
Figure 8:
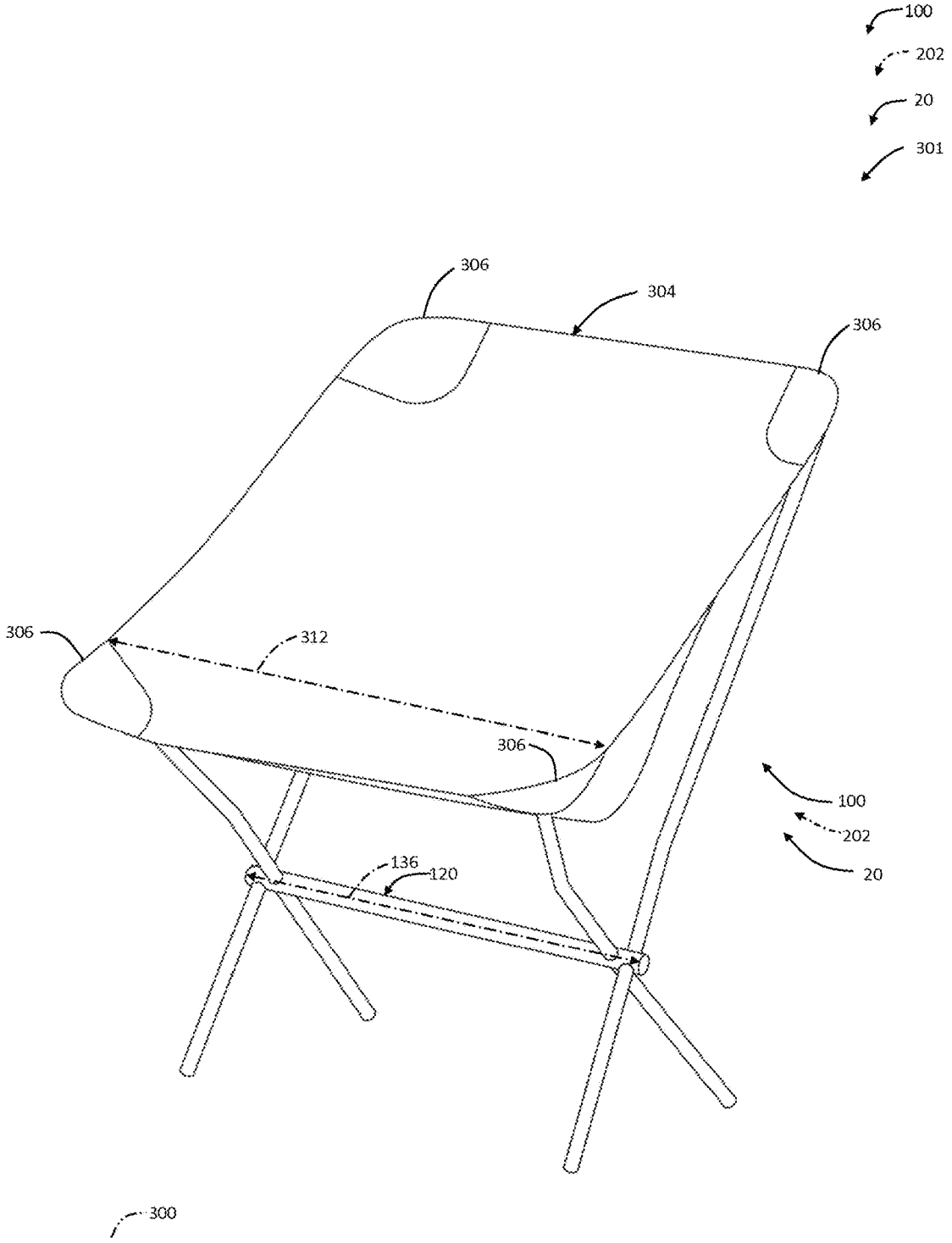
FIG. 8 is an isometric view showing examples of a seat that includes the example the interconverting support frame of FIG. 3 in the seat frame assembled configuration.

FIGS. 3-8 illustrate examples of interconverting support frames 100 that are indicated at and referred to herein as interconverting support frame 20 according to the present disclosure. In particular, FIG. 3 is an elevation view illustrating examples of interconverting support frame 20 in pack frame assembled configuration 200, FIG. 4 is an elevation view showing examples of a load-carrying device 400 that includes interconverting support frame 20 in pack frame assembled configuration 200, FIG. 5 is a schematic side view showing examples of interconverting support frame 20 in pack frame assembled configuration 200 and received in pack 402 of load-carrying device 400, FIG. 6 is an exploded view of interconverting support frame 20, FIG. 7 is an isometric view illustrating examples of interconverting support frame 20 in seat frame assembled configuration 202, and FIG. 8 is an isometric view illustrating examples of a seat 301 that includes interconverting support frame 20 in seat frame assembled configuration 202.

Generally with reference FIGS. 3-8, and with an initial focus on the examples of FIG. 3, interconverting support frame 20 includes central frame member 120, first pair 124 of longitudinal frame members 112, and second pair of longitudinal frame members 112. First pair 124 and second pair 126 of longitudinal frame members 112 are operatively coupled to and extend from central frame member 120 in pack frame assembled configuration 200. In this example, longitudinal frame members 112 of first pair 124 are spaced apart along the width of central frame member 120 and extend at least substantially parallel to one another. Likewise, longitudinal frame members 112 of second pair 126 are spaced apart along the width of central frame member 120 and extend at least substantially parallel to one another. First pair 124 and second pair 126 of longitudinal frame members 112 also are at least substantially aligned or extend coaxially with one another. Longitudinal frame members 112 of first pair 124 are of at least substantially the same length, and longitudinal frame members 112 of second pair 126 are of at least substantially the same length. For reasons that are discussed in more detail herein, first pair 124 of longitudinal frame members 112 are longer than second pair 126 of longitudinal frame members 112.

Interconverting support frame 20 also includes two transitioning frame members 114 and transitioning frame member couplers 152 that couple transitioning frame members 114 to longitudinal frame members 112. In particular, a first transitioning frame member 114 is operatively coupled to and extends between first pair 124 of longitudinal frame members 112, and a second transitioning frame member 114 is operatively coupled to and extends between second pair 126 of longitudinal frame members 112. Either end each transitioning frame member 114 is interconnected with a distal end, or distal end region, of a longitudinal frame member 112 via a respective transitioning frame member coupler 152. In this way, the first transitioning frame member 114 forms a closed shape with first pair 124 of longitudinal frame members 112, and the second transitioning frame member 114 forms a closed shape with second pair 126 of longitudinal frame members 112.

In these examples, each transitioning frame member 114 is a segmented transitioning frame member 134 and includes first transitioning frame member segment 130 and second transitioning frame member segment 132 that are selectively coupled to one another via telescopic coupling mechanism 154. For reasons that are discussed in more detail herein, second transitioning frame member segment 132 may be longer than first transitioning frame member segment 130. The length 176 of first transitioning frame member segments may be at least substantially similar to, or the same as, the length 178 of longitudinal frame members 112 of the second pair 126.

Second transitioning frame member segment 132 also may be non-linear, kinked, or bent at an inflection point that may be beyond or otherwise not interfering with telescoping coupling mechanism 154. Telescopic coupling mechanism 154 optionally includes a telescopic retaining mechanism 174 that is configured to selectively interlock first transitioning frame member segment 130 with second transitioning frame member segment 132. As examples, telescopic retaining mechanism 174 may include a button latch, a push button lock, a friction fit, a gasket lock, a ring detent, a ball detent, a ball plunger, a cotter pin, and/or a threaded engagement.

Central frame member 120 extends laterally between longitudinal frame members 112 of first pair 124 and longitudinal frame members 112 of second pair 126. Central frame member 120 also supports first pair 124 and second pair 126 of longitudinal frame members 112 aligned with one another. In some examples, first pair 124 and second pair 126 of longitudinal frame members 112 are fixedly and/or non-removably coupled to central frame member 120.

Central frame member 120 further includes transitioning frame member receivers 122 that extend through central frame member 120 transverse to, or at least substantially normal to, longitudinal frame members 112. In this example, each transitioning frame member receiver 122 is positioned adjacent to, and inside of, a respective longitudinal frame member 112. However, and in other examples, transitioning frame member receivers 122 may be positioned adjacent to and outside of longitudinal frame member 112. Central frame member 120 may be described as having a two pairs of transitioning frame member receiver 122, with each pair including two transitioning frame member receivers 122 that are aligned and/or coextensive with one another. In some examples, each pair of transitioning frame member receivers 122 is configured to receive the telescopic coupling mechanism 154 of a segmented transitioning frame member 134.

Turning to FIG. 4, illustrated therein are examples of a load-carrying device 400 that includes interconverting support frame 20 in the pack frame assembled configuration of FIG. 3. As shown in the examples of FIG. 4, load-carrying device 400 includes pack 402 that is engaged with and supported by interconverting support frame 20. Pack 402 includes frame-receiving region 406 in the form of tension pockets 408. In particular, pack 402 includes a first tension pocket 408 that is disposed along an upper region of pack 402 and that is configured to receive first pair 124 of longitudinal frame members 112 and the transitioning frame member 114 that extends therebetween. Pack 402 also includes a second tension pocket 408 that is disposed along a lower region of pack 402 and that is configured to receive second pair 126 of longitudinal frame members 112 and the transitioning frame member 114 that extends therebetween. In some examples, the separation between tension pockets 408 along the long axis 412 of pack 402 is at least substantially the same as the separation between transitioning frame members 114 in interconverting support frame 20.

In some examples, tension pockets 408 include open ends that face one another and into which interconverting support frame 20 is selectively inserted and removed. In the examples of FIG. 4, pack 402 is in the form of a backpack. Pack 402 includes shoulder straps 414 a back panel 410, and may include waist strap 416. Back panel 410 extends between and beyond tension pockets 408, and tension pockets 408 may be attached to back panel 410. In some examples, interconverting support frame 20 tensions back panel 410 into a tensioned or planar conformation. Back panel 410 may be configured to contact a user's back and support pack 402 on the user's back, while shoulder straps 414 may be configured to support and/or suspend load-carrying device 400 from a user's shoulders. For the sake of illustration, shoulder straps 414 and waist strap 416 are shown in cutaway.

Pack 402 is configured to permit interconverting support frame 20 to be selectively inserted into and removed from frame-receiving region 406. As an example, pack may include a port through which interconverting support frame 20 may be selectively inserted into and/or removed from frame-receiving region 406. The port may take the form of a slot or aperture that is dimensioned to permit interconverting support frame 20 to be inserted into and removed from frame-receiving region 406. The port may include a closing mechanism, such as a zipper, hook and loop strips, and/or buttons. The port may be disposed along lateral sides of pack 402 (i.e., sides that extend transverse to the back panel and generally along the long axis of pack 402) or the port may be disposed along the top or bottom of pack 402.

FIG. 5 is a schematic side view showing more examples of interconverting support frame 20 received in pack 402 of load-carrying device 400. As shown, interconverting support frame 20 may extend at least partially between a load compartment 404 and back panel 410 of pack 402. Interconverting support frame 20 may be described as having a concave longitudinal conformation relative to back panel 410 of pack 402, such that central frame member 120 is spaced apart from back panel 410 when interconverting support frame 20 is received in pack 402. Such a configuration also may enhance the comfort of carrying or wearing load-carrying device 400 by permitting longitudinal frame members 112 to tension back panel 410 into a planar or at least substantially planar configuration. Such a configuration also may permit longitudinal frame members 112 to act as a spring, such as a leaf spring, and absorb dynamic load variations applied to interconverting support frame 20 during operative use of load-carrying device 400.

More specifically, first pair 124 of longitudinal frame members 112 may include a kink or a bend, such that a distal portion 129 of first pair 124 of longitudinal frame members 112 extends at a deflection angle 127 relative to a proximal portion 131 of first pair 124 of longitudinal frame members 112 that is coupled central frame member 120. Examples of suitable deflection angles 127 include at most 179°, at most 175°, at most 160°, at most 150°, at most 140°, at least 175°, at least 170°, at least 160°, at least 150°, at least 140°, at least 130°, and/or at least 120°. In some examples, the kink in first pair 124 of longitudinal frame members 112 facilitates flexing of interconverting support frame into and out of tension pockets 408 of frame receiving region 406. Additionally or alternatively, central frame member 120 may support first pair 124 and second pair 126 of longitudinal frame members 112 with deflection angle 127 therebetween to configure interconverting support frame 20 with the longitudinal concave conformation relative to back panel 410. In such examples, first pair of longitudinal frame members 112 may not be kinked or bent.

As yet another example, transitioning frame member receivers 122 are unoccupied and may include tubular sockets that project from central frame member 120 transverse to central frame member 120 and transverse to longitudinal frame members 112. In some examples, the sockets of transitioning frame member receivers 122 are configured to support back panel 410 spaced apart from central frame member 120 such that back panel 410 may be tensioned or form a sling between transitioning frame member receivers 122. This feature also may enhance the comfort of carrying or wearing load-carrying device 400 when transitioning frame member receivers 122 are appropriately positioned.

FIG. 6 illustrates examples of interconverting support frame 20 being transitioned between pack frame assembled configuration 200 and seat frame assembled configuration 202, and FIG. 7 illustrates examples of interconverting support frame assembled in seat frame assembled configuration 202. As shown, first transitioning frame member segment 130 and second transitioning frame member segment 132 of each segmented transitioning frame member 134 are disconnected from one another. First transitioning frame member segment 130 includes telescopic receiving portion 162 and second transitioning frame member segment 132 includes telescopic insert portion 160. Telescopic insert portion 160 is inserted into transitioning frame member receiver 122 and extends into, and optionally through, the transitioning frame member receiver 122 on the opposed side of central frame member 120. In this position, telescopic insert portion 160 may be received by, and engage telescopic receiving portion 162 within transitioning frame member receiver 122 and/or exterior to central frame member 120. In other words, telescopic receiving portion 162 of first transitioning frame member segment 130 may be received within the transitioning frame member receiver 122 and engaged with telescopic insert portion 160 therein. Alternatively, telescopic receiving portion 162 may abut central frame member 120 and receive telescopic insert portion 160 from exterior to transitioning frame member receiver 122. In either case, both first transitioning frame member segment 130 and second transitioning frame member segment 132 may be described as being operably interconnected with central frame member 120.

As perhaps best seen in FIG. 7, when operably interconnected with central frame member 120 via transitioning frame member receivers 122, first transitioning frame member segment 130 and second transitioning frame member segment 132 extend from central frame member 120 in opposing directions. In particular, first transitioning frame member segments 130 extend downwardly from central frame member 120 to form a pair of ground-contacting ends 138 and second transitioning frame member segments 132 extend upwardly from central frame member 120 to form seat-contacting ends 140. In other words, first transitioning frame member segments 130 may be described as forming a pair of ground-contacting transitioning frame members 144 and second transitioning frame member segments 132 may be described as forming a pair of seat-contacting transitioning frame members 142.

First pair 124 of longitudinal frame members 112 extend upwardly from central frame member 120 to form a pair of seat-contacting ends 140 and second pair 126 of longitudinal frame members 112 extend downwardly from central frame member 120 to form ground-contacting ends 138. In these examples, longitudinal frame members 112 may remain interconnected with central frame member 120 during the transition between pack frame assembled configuration 200 and seat frame assembled configuration 202. Transitioning frame member receivers 122 orient first transitioning frame member segments 130 and second transitioning frame member segments 132 to extend transverse to longitudinal frame members 112. In this way, interconverting support frame 20 forms four ground-contacting ends 138 that are spaced apart from one another and positioned to simultaneously contact ground surface 300 and four seat-contacting ends 140 that are spaced apart from one another and positioned to collectively support a seat fabric.

As mentioned, first transitioning frame member segments 130 may be dimensioned to be the same length as longitudinal frame members 112 of second pair 126. In this way, first transitioning frame member segments 130 and second pair 126 may form a symmetrical ground support structure for supporting the seat on ground surface 300. The length of first pair 124 of longitudinal frame members 112 is greater than that of second transitioning frame member segments 132 such that second transitioning frame member segments 132 form a pair of lower seat-contacting ends 158, and first pair 124 of longitudinal frame members 112 extend above second transitioning frame member segments 132 to form a pair of upper seat-contacting ends 156.

Transitioning frame member couplers 152 may remain interconnected with and/or disconnect from with longitudinal frame members 112 during the transition between pack frame assembled configuration 200 and seat frame assembled configuration 202. For examples in which transitioning frame member couplers 152 remain interconnected with second pair 126 of longitudinal frame members 112, transitioning frame member couplers 152 may form and/or be utilized as ground-contacting ends 138. Similarly, for examples in which transitioning frame member couplers 152 remain interconnected with first pair 124 of longitudinal frame members 112, transitioning frame member couplers 152 may form and/or be utilized as seat-contacting ends 140.

As mentioned, second transitioning frame member segments 132 may include a kink or bend. As shown in FIG. 7, second transitioning frame member segments 132 may be oriented to extend laterally beyond the width of central frame member 120 in seat frame assembled configuration 202. In particular, second transitioning frame member segments 132 may be oriented such that the kink or bend thereof orients a distal portion of second transitioning frame member segments 132 to extend laterally beyond the width of central frame member 120. In some examples, second transitioning frame member segment 132 and transitioning frame member receiver 122 collectively may include a rotational retaining mechanism 125 configured to restrict second transiting frame member segment 132 from rotating within transitioning frame member receiver 122 and retain second transitioning frame member segment 132 in this orientation. As examples, rotational retaining mechanism 125 may include a key, a recess, and/or a non-circular cross section formed in telescopic insert portion 160 of second transitioning frame member segment 132 and/or transitioning frame member receiver 122.

FIG. 8 illustrates an example of a seat 301 that includes interconverting support frame 20 in seat frame assembled configuration 201. As shown, seat 301 also includes seat fabric 304 that is engaged with and supported by interconverting support frame 20 spaced apart from ground surface 300. In particular, seat fabric 304 includes four receiving regions 306. Each receiving region 306 receives and engages a respective seat-contacting end 140 of interconverting support frame 20. Receiving regions 306 are generally disposed along the four corners of seat fabric 304 such that the remainder of seat fabric is suspended from, and slings between, receiving regions 306. First pair 124 of longitudinal frame members 112 support the respective receiving regions 306 above the receiving regions 306 supported by second transitioning frame member segments 132. In this way, interconverting support frame 20 may form seat 301 with a back rest and a bottom rest.

As further shown in FIG. 8, second transitioning frame member segments 132 may support the respective receiving regions 306 of seat fabric 304 spaced laterally beyond width 136 of central frame member, such that an outermost lateral extent 312 of seat fabric 304 is greater than width 136 of central frame member 120. In such examples, central frame member 120 may be appropriately dimensioned to fit within pack 402, and/or frame-receiving region 406 thereof, which may be narrower than the hips of the user, while seat 301 may be dimensioned such that outermost lateral extent 312 thereof is wider than the hips of the user. Stated another way, in seat frame assembled configuration 202, interconverting support frame 20 may be configured to support seat fabric 304 with an outermost lateral extent that is greater than the width 136 of central frame member 120 in pack frame assembled configuration 200. In this way, seat 301 may comfortably support, and optionally at least partially surround, the lower backside of a user.

Additionally or alternatively, as shown in FIG. 6, central frame member 120 may include a central frame member telescoping mechanism 170 that is configured to selectively adjust width 136 of central frame member 120. More specifically, central frame member telescoping mechanism 170 may be configured to selectively retain central frame member 120 with a first width 136 in pack frame assembled configuration 200 and a second width 136 in seat frame assembled configuration 202, in which the second width is greater than the first width. In this way, interconverting support frame 20 may support seat fabric 304 with an outermost lateral extent 312 that is greater than the width 136 of central frame member 120 in pack frame assembled configuration 200. As an example, central frame member 120 may include two portions that are selectively telescoping relative to one another and that at least partially define central frame member telescoping mechanism 170. Central frame member telescoping mechanism 170 also may include telescopic retaining mechanism 174 that is configured to selectively restrict telescoping of the two portions of central frame member 120 relative to one another and selectively retain central frame member 120 with the selected width.

Seat fabric 304 may be incorporated into load-carrying device 400 in any suitable manner. As examples, seat fabric 304 may be stowed in load-carrying device 400 when interconverting support frame 20 forms a portion of load-carrying device 400. As a more specific example, pack 402 may include a dedicated compartment for stowing seat fabric 304. Additionally or alternatively, seat fabric 304 may be utilized as a portion of, utilized with, and/or form a portion of pack 402. As an example, seat fabric 304 may be configured to be utilized as a rain cover for pack 402, in which case seat fabric 304 may be dimensioned and shaped to fit over at least a portion of an exterior of pack 402. As yet another example, seat fabric 304 may define a portion of the fabric of pack 402, in which case, pack 402 may include a zipper that is configured to selectively connect seat fabric 304 to the remainder of pack 402 and selectively completely disconnect seat fabric 304 from the remainder of pack 402.

That said, in some examples, pack 402 is configured to be utilized as load-carrying device 400 with interconverting support frame 20 removed from frame-receiving region 406 and with seat fabric 304 dissociated from pack 402. In other words, load-carrying device 400 may be configured such that pack 402 and/or load compartment 404 are operable to carry a load with interconverting support frame 20 removed from frame-receiving region 406 and with seat fabric 304 dissociated from pack 402. In such a configuration, pack 402 may be described as and/or may be utilized as a frameless pack or frameless backpack. For examples in which pack 402 is utilized for backpacking, such a configuration may be useful for daytrips where a frame for pack 402 is not necessary.

Figure 9:
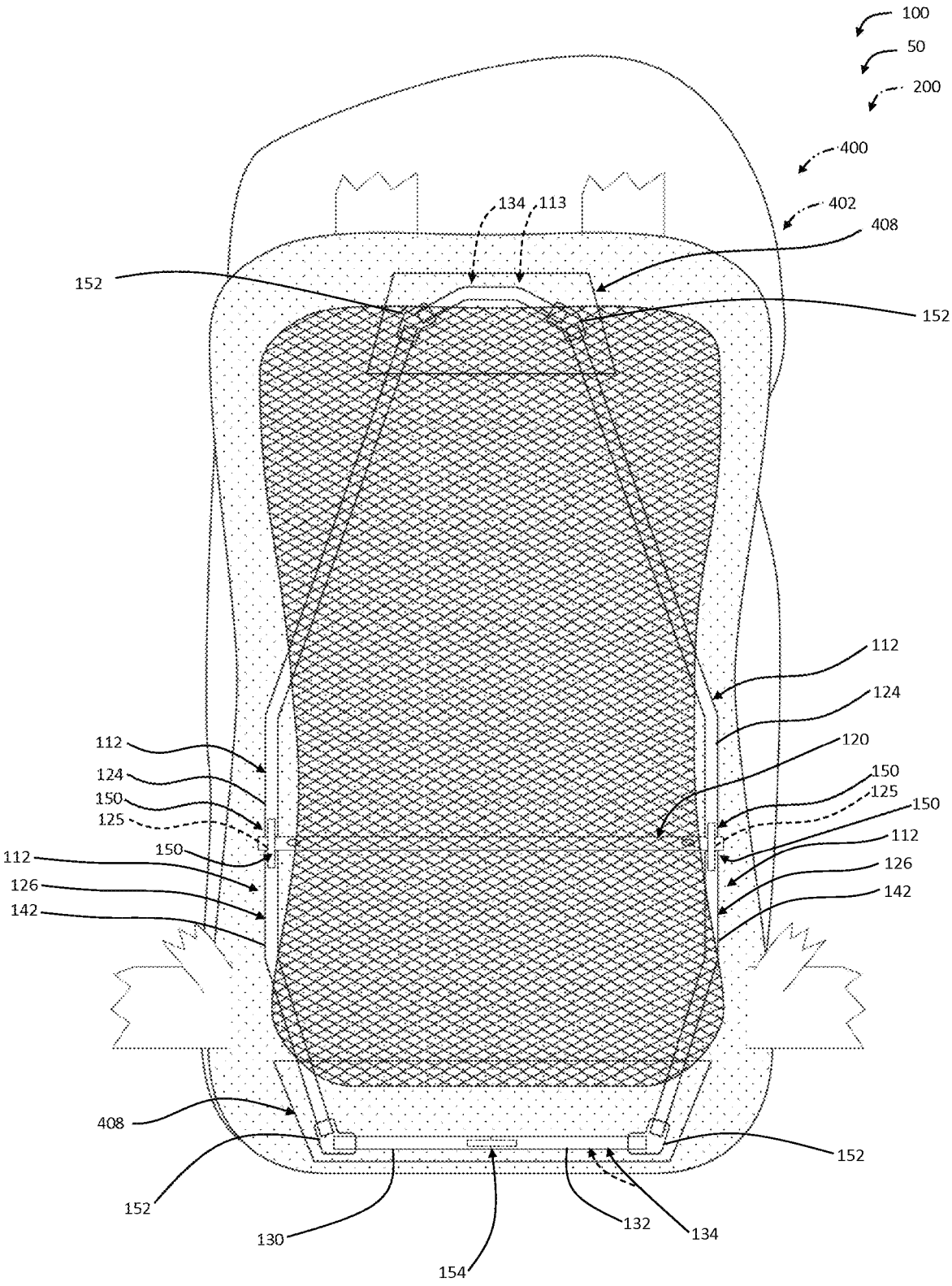
FIG. 9 is a front elevation view showing less schematic examples of interconverting support frames in the pack frame assembled configuration and included in examples of load-carrying devices according to the present disclosure.
Figure 10:
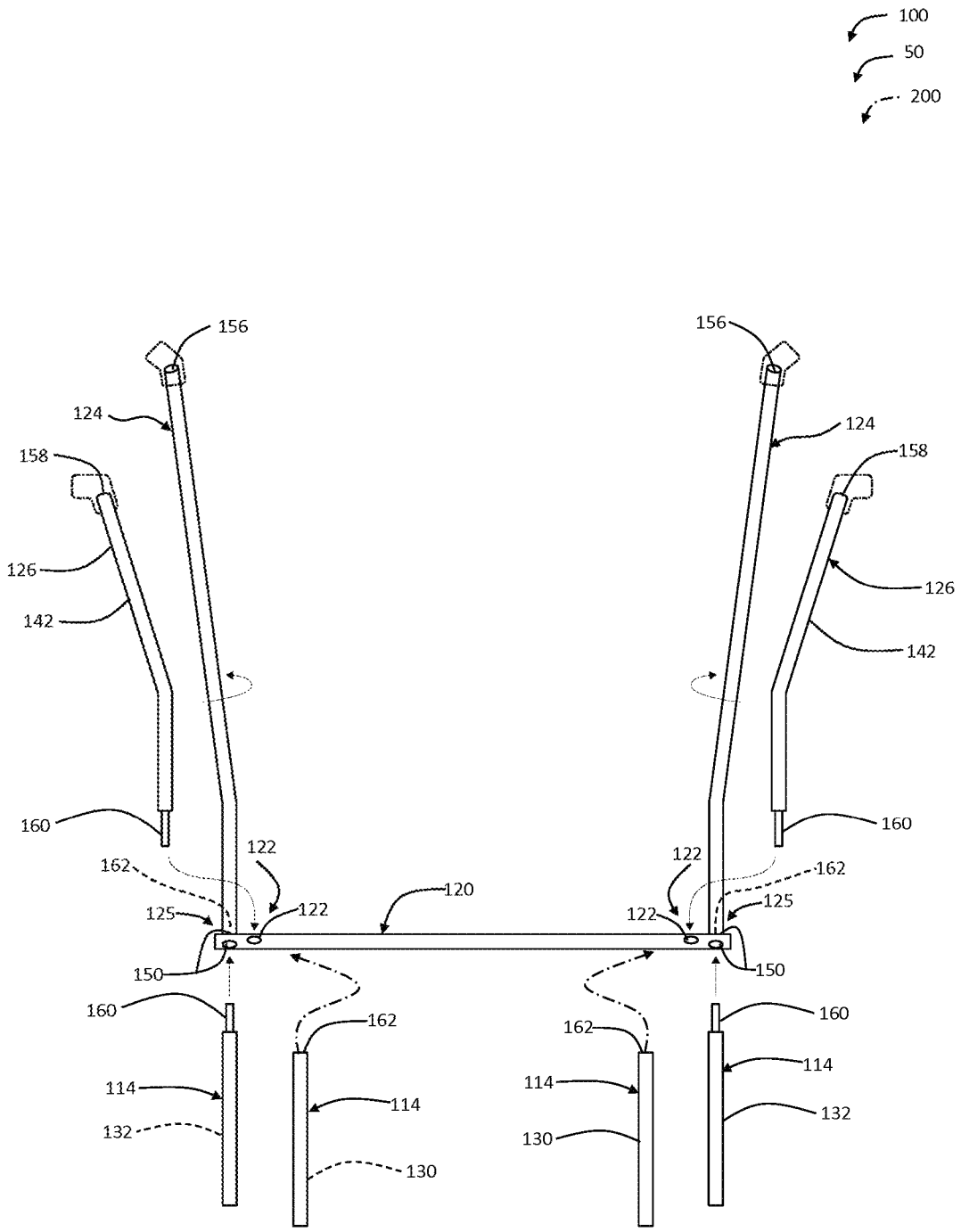
FIG. 10 is an exploded elevation view showing examples of the interconverting support frames of FIG. 9 being transitioned between the pack frame assembled configuration and the seat frame assembled configuration.
Figure 11:
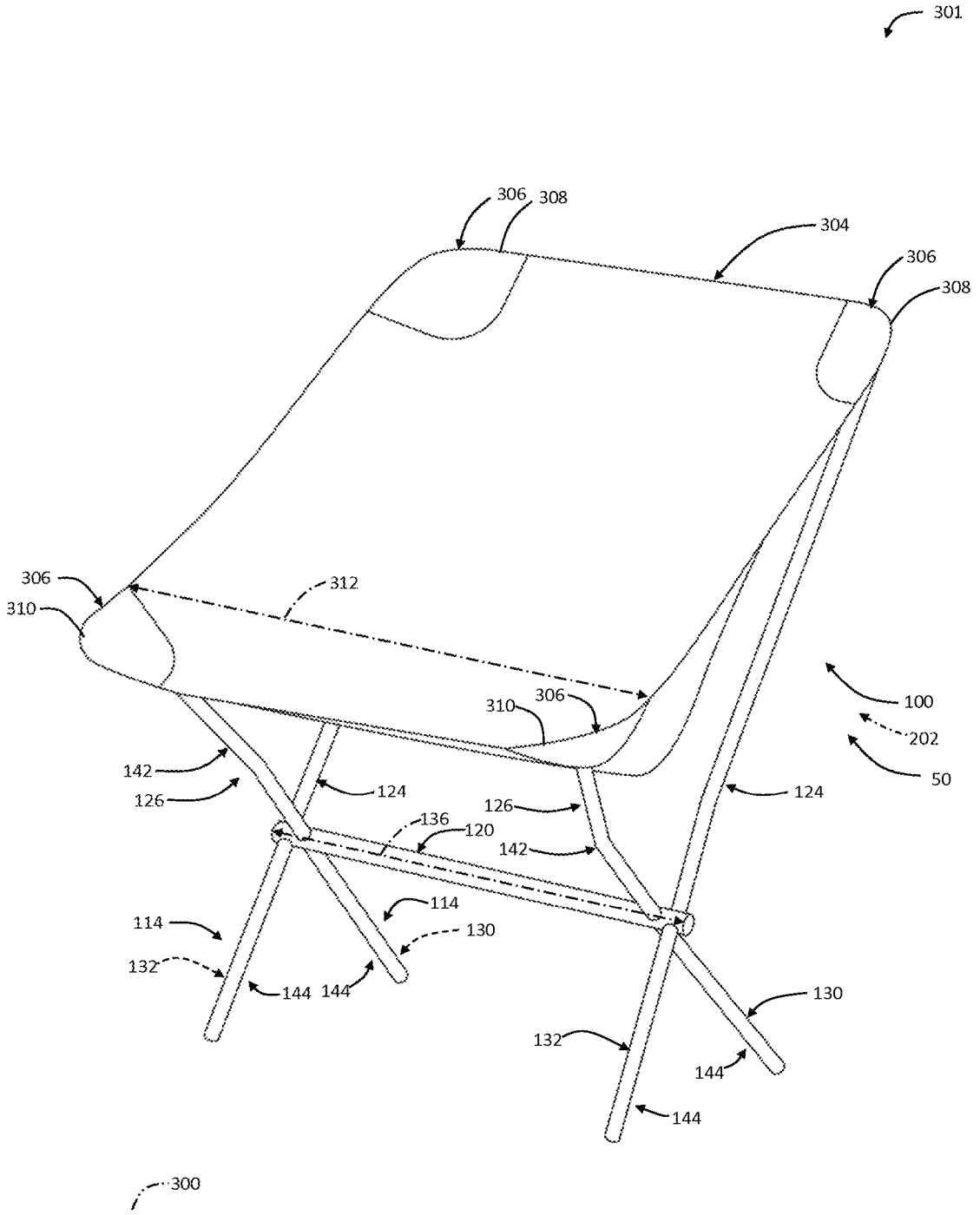
FIG. 11 is an isometric view of the interconverting support frames of FIG. 9 in the seat frame assembled configuration and included in an example seat according to the present disclosure.

FIGS. 9-11 illustrate examples of interconverting support frames 100 that are indicated at and referred to herein as interconverting support frame 50. More specifically, FIG. 9 illustrates examples of a load-carrying device 400 that includes interconverting support frame 50 in pack frame assembled configuration 200, FIG. 10 illustrates examples of interconverting support frame 50 transitioning between pack frame assembled configuration 200 and seat frame assembled configuration 202, and FIG. 11 illustrates examples of a seat 301 that includes interconverting support frame 50 in seat frame assembled configuration 202.

Generally with reference to FIGS. 9-11, and with an initial focus on FIG. 9, interconverting support frame 50 includes first pair 124 of longitudinal frame members 112 and second pair 126 of longitudinal frame members 112 that are interconnected with central frame member 120 in pack frame assembled configuration 200. First pair 124 and second pair 126 of longitudinal frame members 112 extend from central frame member 120 generally aligned with one another. Each longitudinal frame member 112 includes a kink, or a bend, such that the distal portion thereof extends at an angle relative to proximal portion thereof, in which the proximal portion is connected or positioned closest to central frame member 120. First pair 124 of longitudinal frame members 112 of may be described as having a pack frame orientation in pack frame assembled configuration 200, in which the distal portions of first pair 124 of longitudinal frame members 112 extend towards one another. As such, the separation between the distal ends of first pair 124 of longitudinal frame members 112 is less than the separation between the proximal ends of first pair 124 of longitudinal frame members 112. Similarly, second pair 126 of longitudinal frame members 112 of may be described as having a pack frame orientation in pack frame assembled configuration 200, in which the distal ends of second pair 126 of longitudinal frame members 112 extend towards one another.

As shown in FIG. 9, the distal ends of first pair 124 of longitudinal frame members 112 may be positioned closer to one another than the distal ends of second pair 126 of longitudinal frame members 112. As discussed in more detail herein, central frame member 120 includes four longitudinal frame member receivers 150 that receive first pair 124 and second pair 126 of longitudinal frame members 112 in pack frame assembled configuration 200. Central frame member 120 also includes a plurality of transitioning frame member receivers 122 that are configured to receive and orient transitioning frame members 114 in seat frame assembled configuration 202.

Interconverting support frame 50 also includes at least one, and optionally two segmented transitioning frame members 134 that extend between and interconnect the distal end regions of second pair 126 of longitudinal frame members 112 via transitioning frame member couplers 152. For examples in which interconverting support frame 50 includes two segmented transitioning frame members 134 that extend between and interconnect the distal ends of second pair 126 of longitudinal frame members 112, transitioning frame member couplers 152 may arrange and support the two segmented transitioning frame members 134 to extend in a parallel and side-by-side relationship.

In some examples, interconverting support frame 50 includes a segmented transitioning frame member 134 that extends between and interconnect the distal ends of first pair 124 of longitudinal frame members 112. Alternatively, interconverting support frame 50 may include a stationary frame member 113 that is configured to interconnect first pair 124 of longitudinal frame members 112 in pack frame assembled configuration 200 via transitioning frame member couplers 152. Stationary frame member 113 may be fixedly coupled to pack 402 and may be disconnected from transitioning frame member couplers 152 in seat frame assembled configuration 202.

Pack 402 includes a first tension pocket 408 that receives distal end regions of first pair 124 of longitudinal frame members 112 and stationary frame member 113 or the segmented transitioning frame member 134 that extends therebetween. Pack 402 also includes a second tension pocket 408 that receives the distal end regions of second pair 126 of longitudinal frame members 112 and segmented transitioning frame member 134. Tension pockets 408 may be respectively dimensioned and shaped to receive the distal end regions of first pair 124 and second pair 126 of longitudinal frame members 112.

Turning focus to FIGS. 10-11, to transition interconverting support frame 50 from pack frame assembled configuration 200 to seat frame assembled configuration 202, interconverting support frame 20 is removed from tension pockets 408. Transitioning frame member(s) 114, and optionally stationary frame member 113, are disconnected from transitioning frame member couplers 152. In this example, second pair 126 of longitudinal frame members 112 are configured to be selectively received in and removed from longitudinal frame member receivers 150 to transition interconverting support frame 50 between pack frame assembled configuration 200 and seat frame assembled configuration 202. As perhaps best seen in FIG. 11, second pair 126 of longitudinal frame members 112 are positioned and oriented to support seat fabric 304 in seat frame assembled configuration 202. Stated in slightly different terms, second pair 126 of longitudinal frame members 112 are configured to selectively disconnect from and reconnect with central frame member 120 to form a pair of seat-contacting transitioning frame members 142.

Second pair 126 of longitudinal frame members 112 each include telescopic insert portion 160 that is configured to be selectively received in and removed from longitudinal frame member receiver 150 and transitioning frame member receiver 122. In pack frame assembled configuration 200, second pair 126 of longitudinal frame members 112 are interconnected with central frame member 120 via two, laterally spaced apart longitudinal frame member receivers 150. In seat frame assembled configuration 202, second pair 126 of longitudinal frame members 112 are interconnected with central frame member 120 via two, laterally spaced apart transitioning frame member receivers 122. The two transitioning frame member receivers 122 are circumferentially offset from the longitudinal frame member receivers 150 that receive second pair 126 of longitudinal frame members 112 in pack frame assembled configuration 200. In this way, longitudinal frame member receivers 150 orient second pair 126 of longitudinal frame members 112 to extend in a first direction that is at least substantially transverse to a second direction along which transitioning frame member receivers 122 orient second pair 126 of longitudinal frame members 112. In this way, second pair 126 of longitudinal frame members 112 may extend generally aligned with first pair 124 of longitudinal frame members 112 in pack frame assembled configuration 200 and may extend transverse to first pair of longitudinal frame members 112 in seat frame assembled configuration 202.

In seat frame assembled configuration 202, first pair 124 and second pair 126 of longitudinal frame members 112 extend upwardly from central frame member 120 and oblique to ground surface 300. Interconverting support frame 50 includes two upper seat-contacting ends 156 that are positioned to operatively contact and support upper corners 308 of seat fabric 304 and two lower seat-contacting ends 158 that are positioned to operatively contact lower corners 310 of seat fabric 304. Second pair 126 of longitudinal frame members 112 form the lower seat-contacting ends 158, and first pair 124 of longitudinal frame members 112 extend above second pair 126 of longitudinal frame members 112 to form the upper seat-contacting ends 156.

In seat frame assembled configuration 202, each segmented transitioning frame member 134 is separated into first transitioning frame member segment 130 and second transitioning frame member segment 132. First transitioning frame member segment 130 and second transitioning frame member segment 132 each define ground-contacting transitioning frame members 144 and include ground-contacting ends 138. First transitioning frame member segment 130 includes telescopic receiving portion 162 and second transitioning frame member segment 132 includes telescopic insert portion 160. Telescopic insert portion 160 of second transitioning frame member segment 132 is inserted into and retained within longitudinal frame member receiver 150. Thus, second transitioning frame member segment 132 extends at least generally aligned with and/or parallel to first pair 124 of longitudinal frame members 112 in seat frame assembled configuration 202.

The longitudinal frame member receiver 150 that receives second transitioning frame member segment 132 may be aligned and coextensive with a longitudinal frame member receiver 150 that receives a longitudinal frame member 112 of the first pair 124. As such, second transitioning frame member segment 132 may engage a longitudinal frame member 112 of the first pair 124 via longitudinal frame member receivers 150 in seat frame assembled configuration 202. Likewise, second pair 126 of longitudinal frame members 112 may engage first pair 124 of longitudinal frame members 112 via longitudinal frame member receivers 150 in pack frame assembled configuration 200.

In seat frame assembled configuration 202, first transitioning frame member segment 130 is positioned and oriented about central frame member 120 opposed to second pair 126 of longitudinal frame members 112. Telescopic receiving portion 162 of first transitioning frame member segment 130 receives and engages a telescopic insert portion 160 of a longitudinal frame member 112 of second pair 126 via central frame member 120. In this way, first transitioning frame member segment 130 extends aligned with second pair 126 of longitudinal frame members 112 and transverse to first pair 124 of longitudinal frame members 112. Central frame member 120 further may include a transitioning frame member receiver 122 into which telescopic receiving portion 162 of first transitioning frame member segment 130 is inserted and retained in this orientation. Alternatively, first transitioning frame member segment 130 may abut central frame member 120 and be retained in this orientation by engagement with the telescopic insert portion 160 of a longitudinal frame member 112 of the second pair 126.

As shown in FIG. 11, interconverting support frame 50 includes four ground-contacting transitioning frame members 144 in seat frame assembled configuration 202. For some examples in which interconverting support frame 50 includes stationary frame member 113, interconverting support frame 50 further includes two transitioning frame members 114 that are stowed in pack 402 in pack frame assembled configuration 200. In such examples, a first of the two transitioning frame members 114 is configured and utilized in seat frame assembled configuration 202 in a similar manner to that discussed for first transitioning frame member segment 130, and the second of the two transitioning frame members 114 is configured and utilized in seat frame assembled configuration 202 in a similar manner to that discussed for second transitioning frame member segment 132. For examples in which interconverting support frame 50 includes two segmented transitioning frame members 134, the transitioning frame member segments of each segmented transitioning frame member 134 may be utilized in a similar manner.

First pair 124 of longitudinal frame members 112 may be described as having a seat frame orientation in seat frame assembled configuration 202 that is different from the pack frame orientation. More specifically, in the seat frame orientation, the distal portions of first pair 124 of longitudinal frame members 112 may extend away from or parallel to one another. This may permit first pair 124 of longitudinal frame members 112 to support seat fabric 304 with the upper corners 308 thereof spaced further apart than the spacing between the distal ends of first pair 124 of longitudinal frame members 112 in pack frame assembled configuration 200. In this way, the distal ends of first pair 124 of longitudinal frame members 112 may be positioned inside of a user's shoulder blades in pack frame assembled configuration 200 and optionally outside of a user's shoulder blades in seat frame assembled configuration 202.

As perhaps best seen in FIG. 10, first pair 124 of longitudinal frame members 112 may be rotated between the pack frame orientation and the seat frame orientation. In some examples, longitudinal frame member receivers 150 are configured to permit first pair 124 of longitudinal frame members 112 to rotate within longitudinal frame member receivers 150 between the pack frame orientation and the seat frame orientation. In other examples, first pair 124 of longitudinal frame members 112 are configured to be removed from, rotated, and reinserted into longitudinal frame member receivers 150 to transition between the pack frame orientation and the seat frame orientation. First pair 124 of longitudinal frame members 112 each may include rotational retaining mechanism 125 configured to selectively restrict longitudinal frame member 112 from rotating between the pack frame orientation and the seat frame orientation while the longitudinal frame member 112 is received in longitudinal frame member receiver 150. As examples, first pair 124 of longitudinal frame members 112 each may include telescopic receiving portion 162, and rotational retaining mechanism 125 may include a key, a recess, and/or a non-circular cross section formed in telescopic receiving portion 162 and/or longitudinal frame member receiver 150.

Likewise, second pair 126 of longitudinal frame members 112 may include a pack frame orientation and a seat frame orientation and may be configured to rotate between the pack frame orientation and the seat frame orientation in a similar manner to that discussed herein for first pair 124 of longitudinal frame members 112. Thus, in seat frame assembled configuration 202, interconverting support frame 50 may support seat fabric 304 with an outermost lateral extent 312 that is greater than the width of central frame member 120. Second pair 126 of longitudinal frame members 112, the transitioning frame member receivers 122 that receive second pair 126 of longitudinal frame members 112, and/or the longitudinal frame member receivers 150 that receive second pair 126 of longitudinal frame members 112 may include rotational retaining mechanisms 125 configured to selectively retain second pair 126 of longitudinal frame members 112 in the seat frame orientation or the pack frame orientation.

Figure 12:
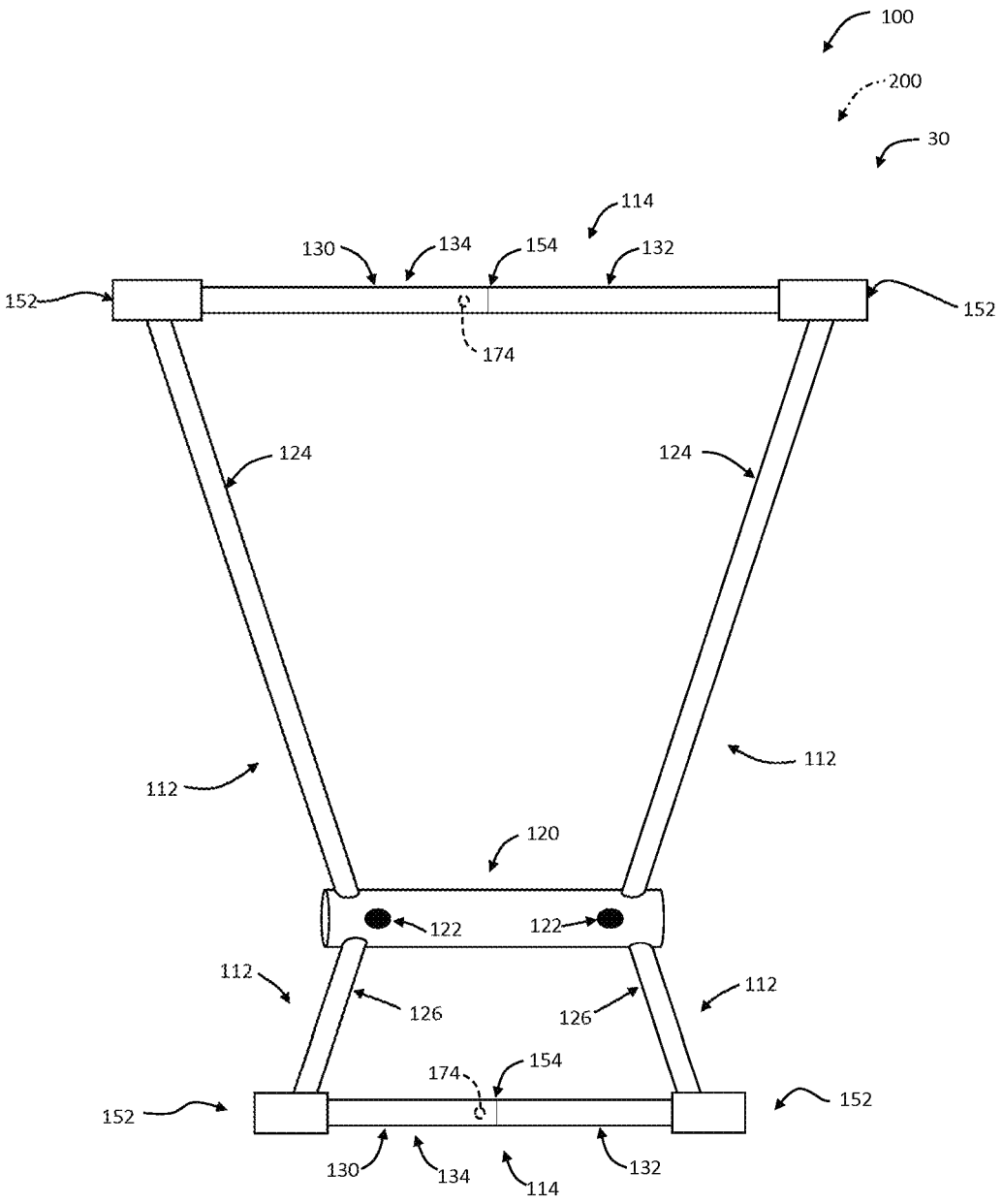
FIG. 12 is an elevation view showing less-schematic examples of interconverting support frames in the pack frame assembled configuration according to the present disclosure.
Figure 13:
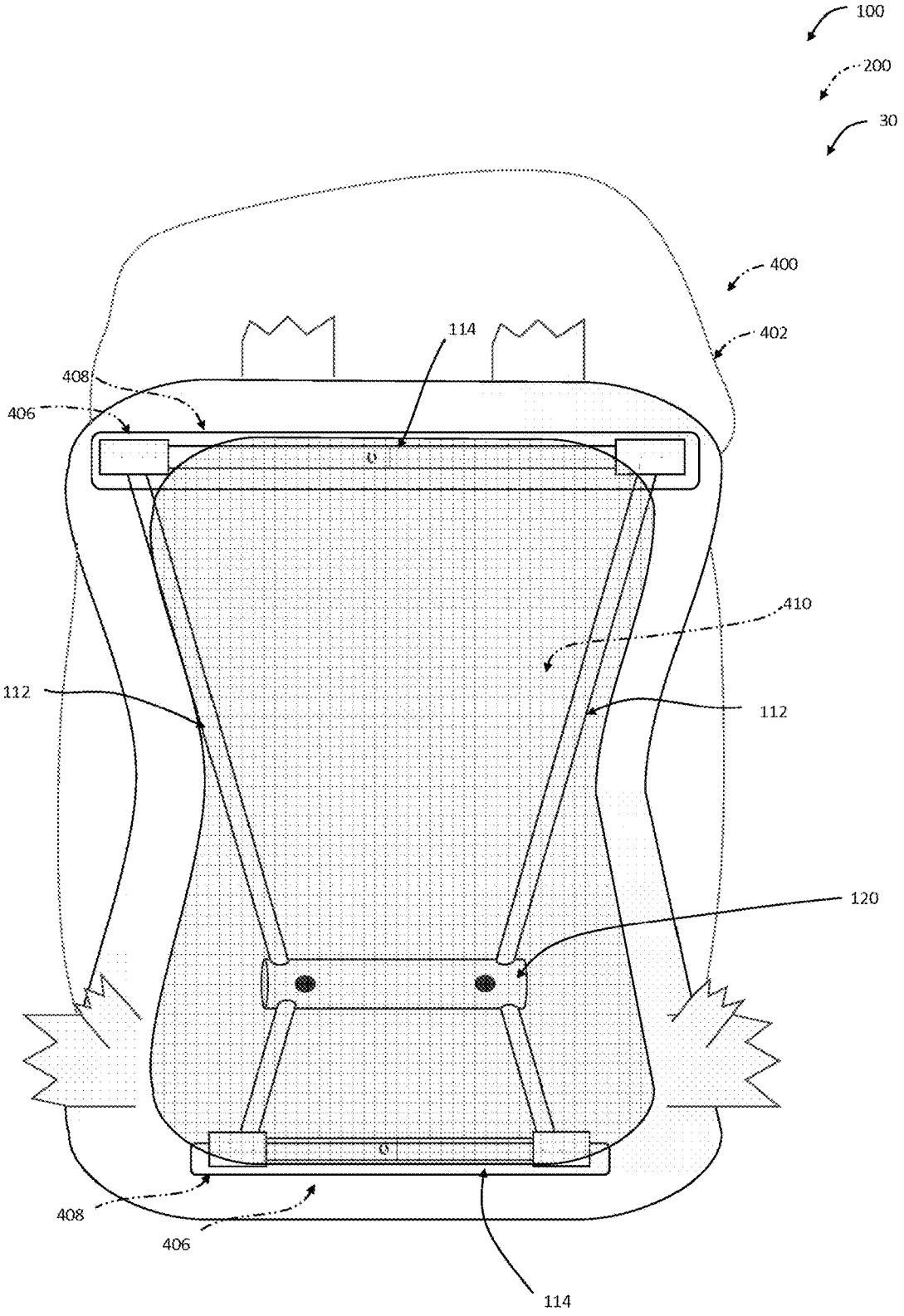
FIG. 13 is an elevation view showing examples of load-carrying devices according to the present disclosure that include the interconverting support frames of FIG. 12 in the pack frame assembled configuration.
Figure 14:
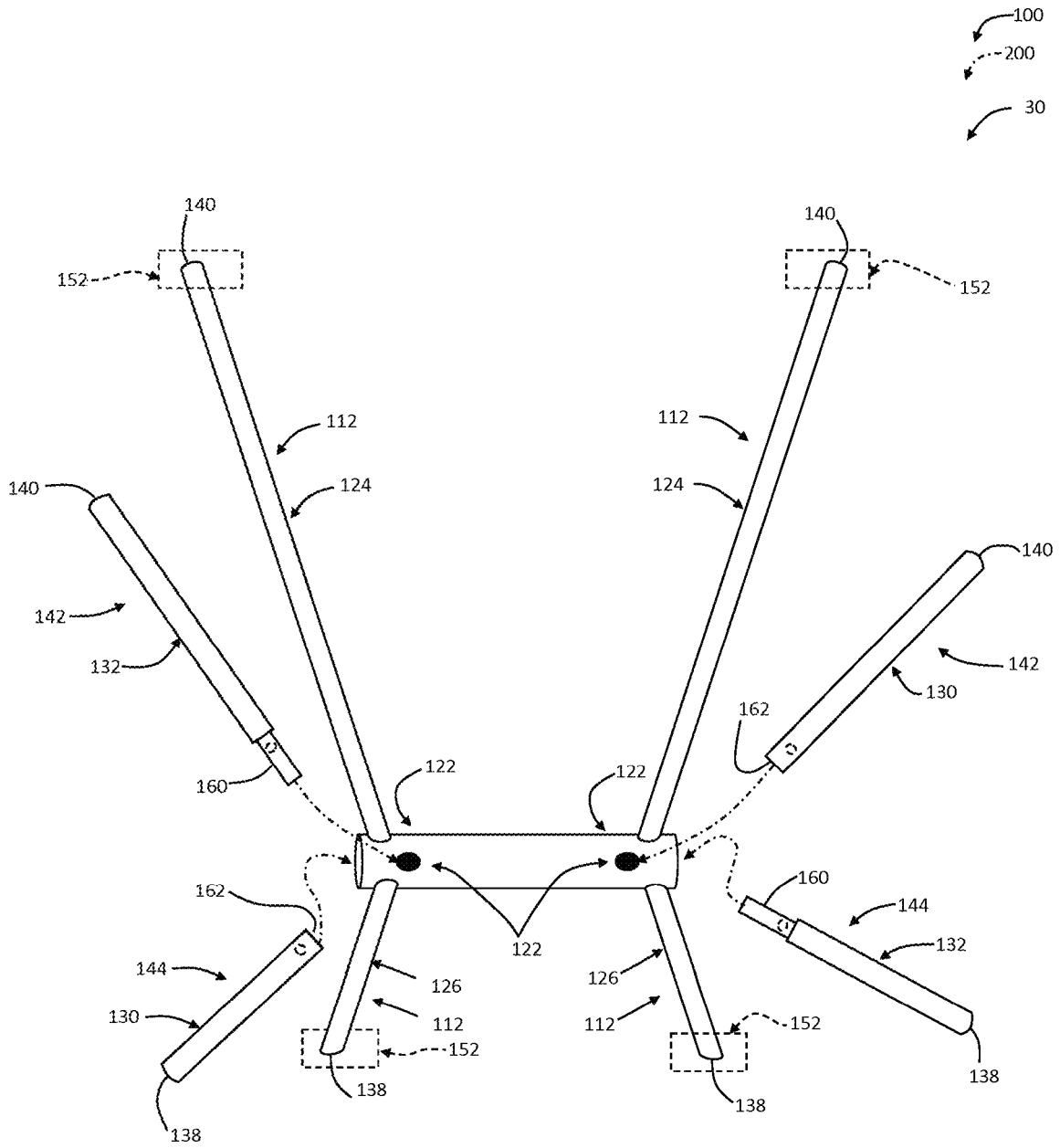
FIG. 14 is fragmentary elevation view showing examples of the interconverting support frames of FIG. 12 being transitioned between the pack frame assembled configuration and the seat frame assembled configuration.
Figure 15:
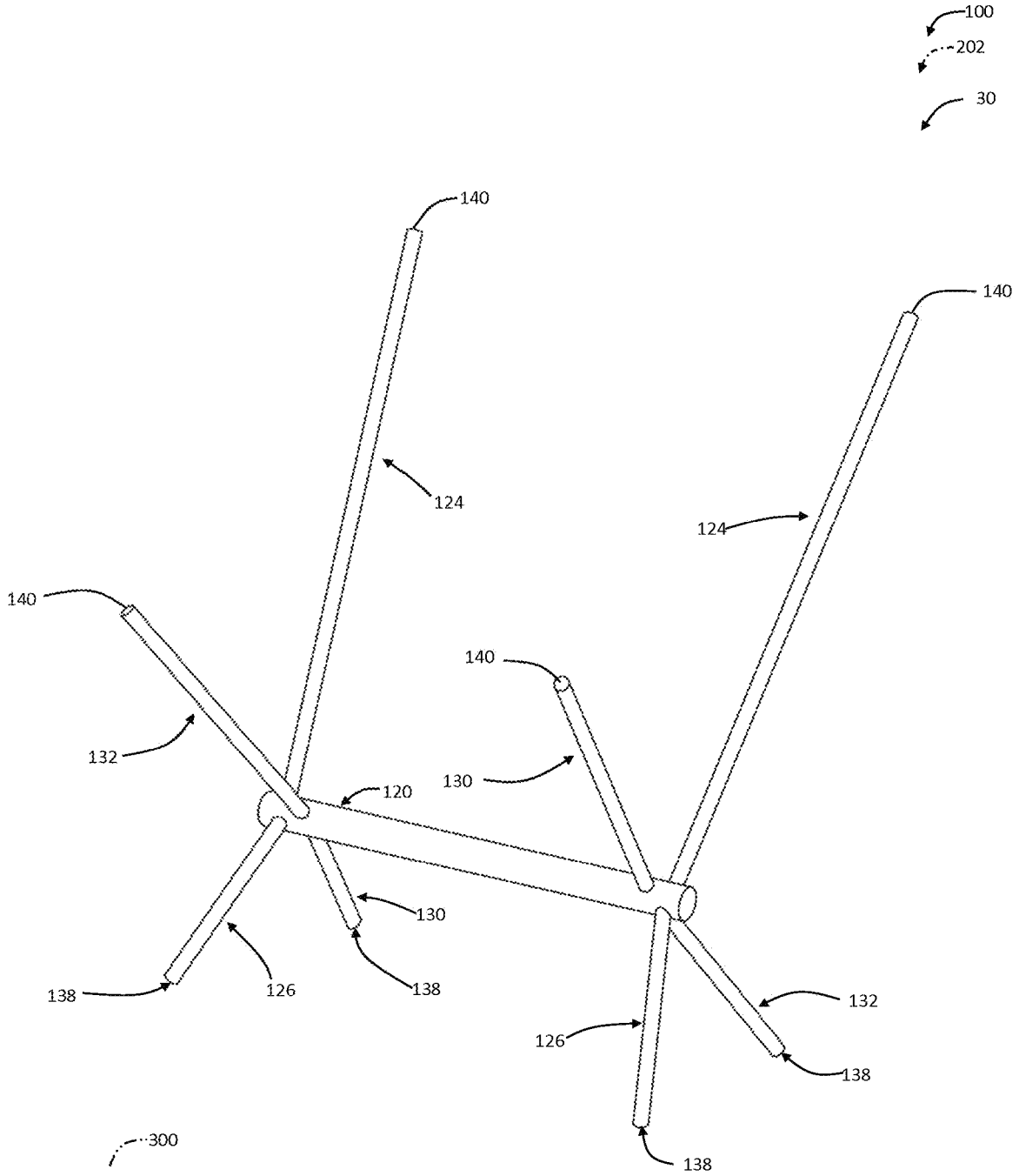
FIG. 15 is an isometric view showing examples of the interconverting support frames of FIG. 12 in the seat frame assembled configuration.

FIGS. 12-15 illustrate examples of interconverting support frames 100 that are indicated at and referred to herein as interconverting support frame 30. More specifically, FIG. 12 illustrates examples of interconverting support frame 30 in pack frame assembled configuration 200, FIG. 13 illustrates examples of a load-carrying device 400 that includes interconverting support frame 30 in pack frame assembled configuration 200, FIG. 14 illustrates examples of interconverting support frame 30 transitioning between pack frame assembled configuration 200 and seat frame assembled configuration 202, and FIG. 15 illustrates interconverting support frame 30 in seat frame assembled configuration 202.

Generally with reference to FIGS. 12-15, and with an initial focus on FIG. 12, interconverting support frame 30 includes first pair 124 and second pair 126 of longitudinal frame members 112 that extend in generally opposed directions from central frame member 120. Longitudinal frame members 112 of first pair 124 extend symmetrically from central frame member 120 and away from one another oblique to the width of central frame member 120. In this way, the distal ends of first pair 124 longitudinal frame members 112 are spaced further apart from one another than the width of central frame member 120. Similarly, longitudinal frame members 112 of second pair 126 extend symmetrically from central frame member 120 and away from one another oblique to the width of central frame member 120. First pair 124 of longitudinal frame members 112 are longer than second pair 126 of longitudinal frame members 112, such that the distal ends of first pair 124 of longitudinal frame members are spaced further apart from one another and from central frame member 120 than are the distal ends of second pair 126 of longitudinal frame members 112.

Interconverting support frame 30 includes two segmented transitioning frame members 134, a first of which may extend between the distal ends of first pair 124 of longitudinal frame members 112 and a second of which may extend between the distal ends of second pair 126 of longitudinal frame members 112. The first segmented transitioning frame member 134 is interconnected with first pair 124 of longitudinal frame members 112 by a pair of transitioning frame member couplers 152 and the second segmented transitioning frame member 134 is interconnected with second pair 126 of longitudinal frame member 112 by a pair of transitioning frame member couplers 152. The first segmented transitioning frame member 134 is dimensioned to span first pair 124 of longitudinal frame members 112, and the second segmented transitioning frame member 134 is dimensioned to span second pair 126 of longitudinal frame members 112. The telescopic coupling mechanisms 154 of segmented transitioning frame members 134 each may include telescopic retaining mechanism 174, as discussed herein.

Shifting focus to FIG. 13, in load-carrying device 400, interconverting support frame 30 is positioned within frame-receiving region 406 of pack 402, which includes tension pockets 408. Interconverting support frame 30 extends between and engages tension pockets 408. Specifically, first pair 124 of longitudinal frame members 112 extend to within a correspondingly dimensioned upper tension pocket 408, and second pair 126 of longitudinal frame members 112 extend to within a correspondingly dimensioned lower tension pocket 408. Due to the laterally outward extending orientation of longitudinal frame members 112, central frame member 120 may be dimensioned with a width that is less than the width of back panel 410.

Turning focus to FIGS. 14 and 15, to transition interconverting support frame 30 from pack frame assembled configuration 200 to seat frame assembled configuration 202, segmented transitioning frame members 134 are detached from longitudinal frame members 112 and separated into first transitioning frame member segments 130 and second transitioning frame member segments 132. In this example, first transitioning frame member segment 130 and second transitioning frame member segment 132 of each segmented transitioning frame member 134 are equal in length to one another. In particular, first transitioning frame member segment 130 and second transitioning frame member segment 132 of the first segmented transitioning frame member 134 are longer than those of the second segmented transitioning frame member 134. In this way, first transitioning frame member segment 130 and second transitioning frame member segment 132 of the first segmented transitioning frame member 134 are configured to form seat-contacting transitioning frame members 142. First transitioning frame member segment 130 and second transitioning frame member segment 132 of the second segmented transitioning frame member 134 are configured to form ground-contacting transitioning frame members 144.

Central frame member 120 includes two pairs of transitioning frame member receivers 122 that are disposed adjacent to longitudinal frame members 112 and configured to orient transitioning frame members 114 to extend transverse to longitudinal frame members 112. Transitioning frame member receivers 122 also orient transitioning frame members 114 to extend laterally outward and beyond the width of central frame member 120. One seat-contacting transitioning frame member 142 includes telescopic insert portion 160 and the other seat-contacting transitioning frame member 142 includes telescopic receiving portion 162. Likewise, one ground-contacting transitioning frame member 144 includes telescopic insert portion 160 and the ground-contacting transitioning frame member 144 includes telescopic receiving portion 162. Telescopic insert portions 160 are inserted into corresponding transitioning frame member receivers 122 and engaged with telescopic receiving portions 162 within central frame member 120 and/or on the other side of central frame member 120 from which telescopic insert portion 160 is inserted.

In seat frame assembled configuration 202, first pair 124 of longitudinal frame members 112 form seat-contacting ends 140, while second pair 126 of longitudinal frame members 112 form ground-contacting ends 138. Longitudinal frame members 112 may remain fixedly coupled to central frame member 120 between seat and pack frame assembled configurations.

Figure 16:
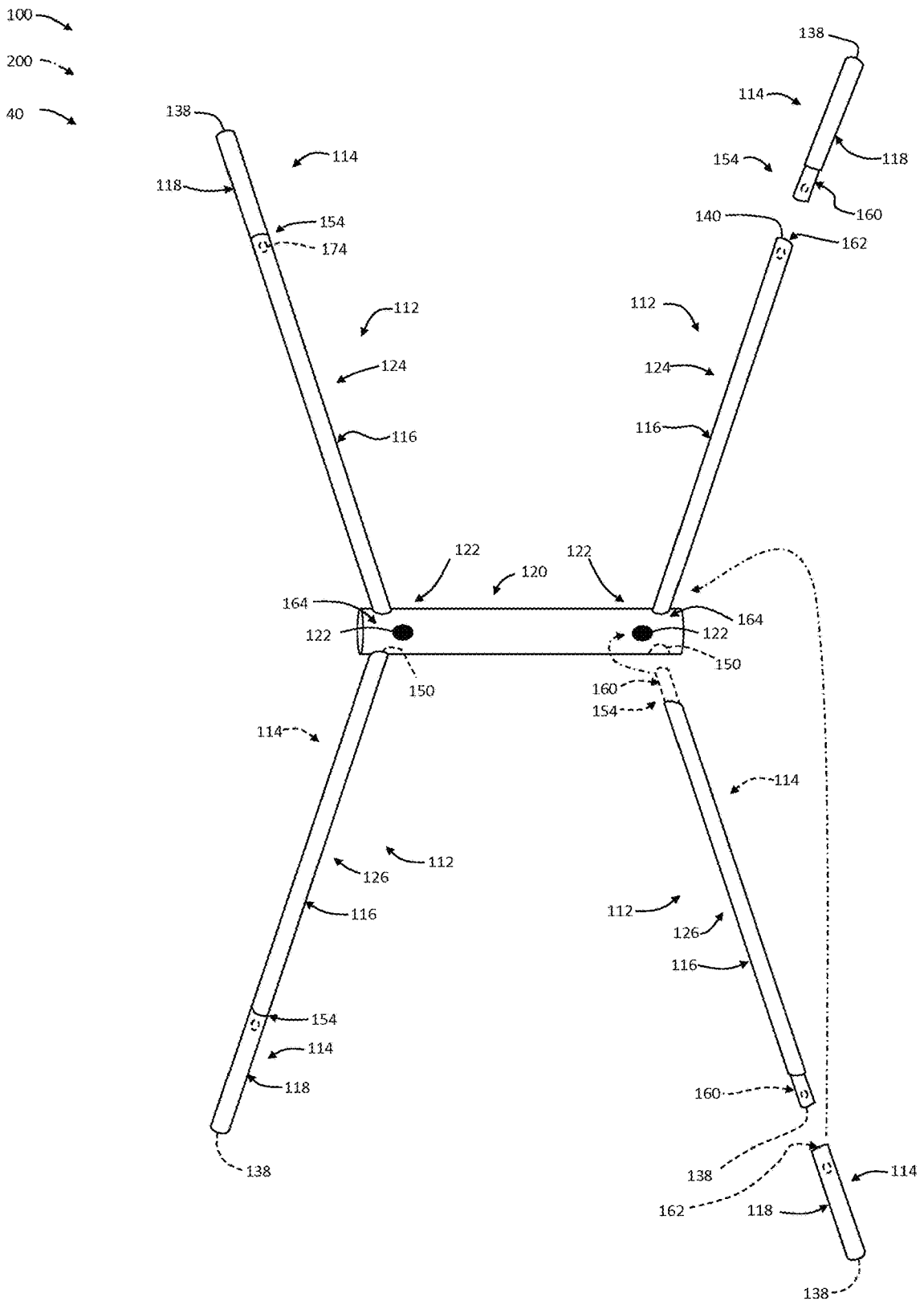
FIG. 16 is a partially exploded elevation view showing less-schematic examples of interconverting support frames.
Figure 17:
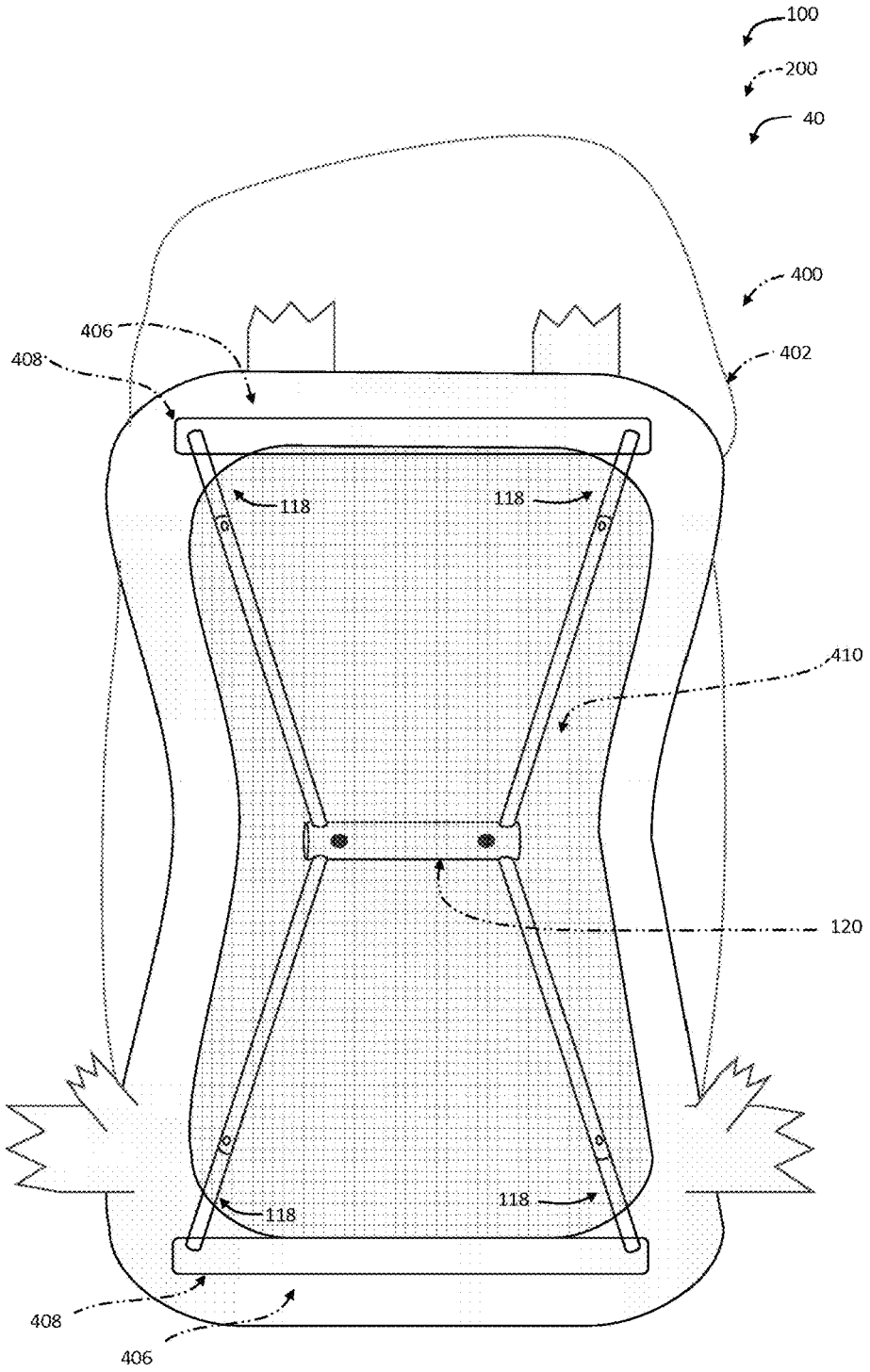
FIG. 17 is a front elevation view showing less-schematic examples of the interconverting support frame of FIG. 16 in the pack frame assembled configuration and included in an example load-carrying device according to the present disclosure.
Figure 18:
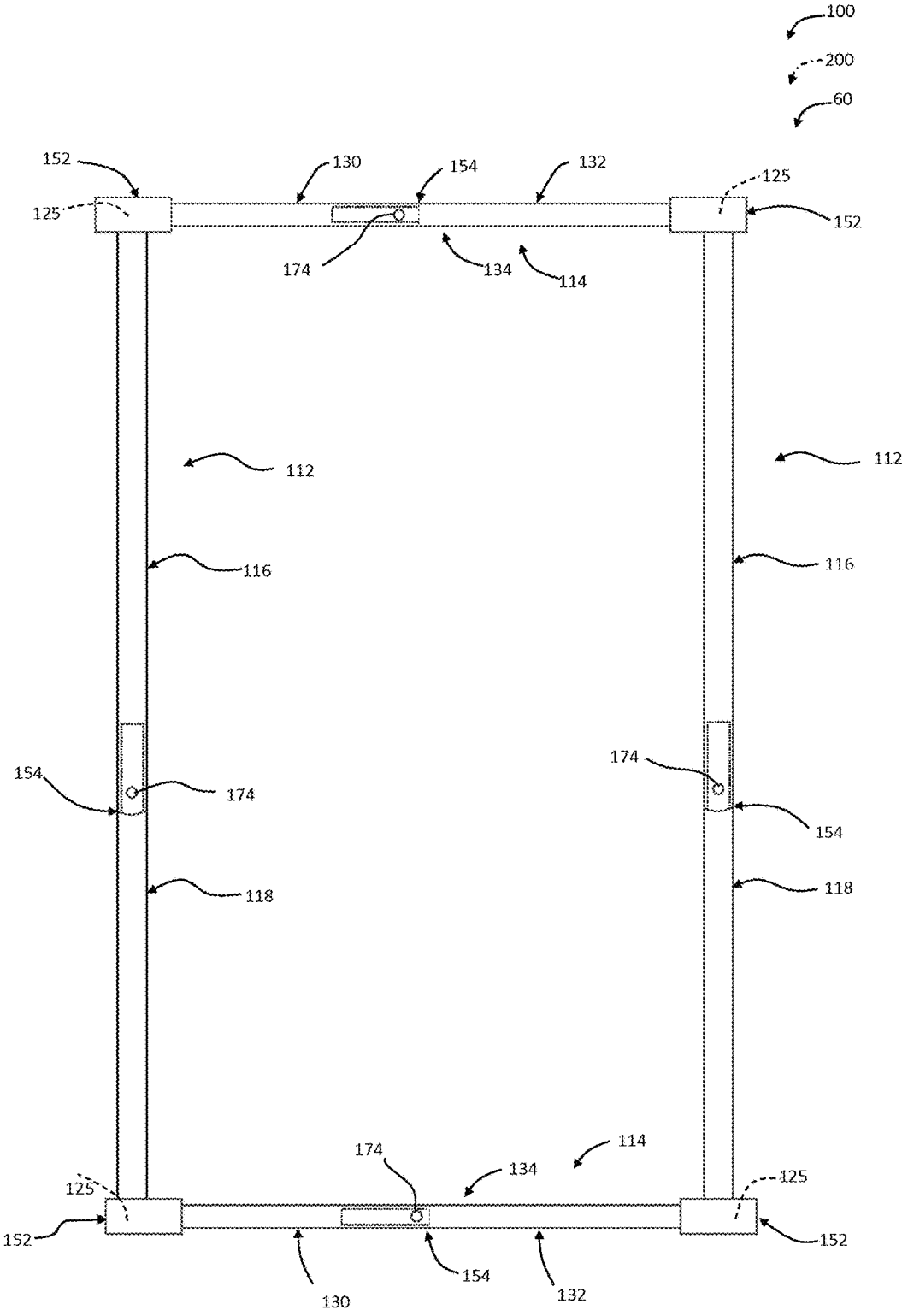
FIG. 18 is an elevation view showing less-schematic examples of interconverting support frames in the pack frame assembled configuration according to the present disclosure.

FIGS. 16-18 illustrate examples of interconverting support frames 100 that are indicated at and referred to herein as interconverting support frame 40. More specifically, FIG. 16 is a partially exploded view with a left side of FIG. 16 showing interconverting support frame 40 in pack frame assembled configuration 200 and the right side of FIG. 16 showing interconverting support frame 40 transitioning between pack frame assembled configuration 200 and seat frame assembled configuration 202. FIG. 17 illustrates examples of a load-carrying device 400 that includes interconverting support frame 40 in pack frame assembled configuration.

Generally with reference to FIGS. 16-17, and with an initial focus on FIG. 16, interconverting support frame 40 includes first pair 124 and second pair 126 of longitudinal frame members 112 that are directly interconnected with central frame member 120 in pack frame assembled configuration 200. First pair 124 and second pair 126 of longitudinal frame members 112 may be aligned with one another along central frame member 120 and/or may extend at least substantially along a common plane.

Longitudinal frame members 112 of the first pair 124 and the second pair 126 are spaced apart from one another and are interconnected with central frame member 120 proximate the end regions 164 of central frame member 120. Longitudinal frame members 112 of first pair 124 extend laterally outward from central frame member 120 at corresponding angles relative to the width of central frame member 120, such that the distal ends thereof are spaced further apart than the width of central frame member 120. Likewise, longitudinal frame members 112 of second pair 126 extend laterally outward from central frame member 120, such that the distal ends thereof are spaced further apart than the width of central frame member 120. As discussed in more detail herein, the distal ends of first pair 124, and optionally second pair 126, of longitudinal frame members 112 include ground-contacting ends 138.

Each longitudinal frame member 112 includes first segment 116 that is directly connected with central frame member 120 in pack frame assembled configuration 200 and second segment 118 that defines the distal end of the longitudinal frame member 112. Each longitudinal frame member 112 also includes telescopic coupling mechanism 154 that interconnects first segment 116 and second segment 118 in pack frame assembled configuration 200. Second segments 118 of first pair 124 of longitudinal frame members 112 may be provided with telescopic insert portions 160 and second segments 118 of second pair 126 of longitudinal frame members 112 may be provided with telescopic receiving portions 162.

To transition interconverting support frame 40 from pack frame assembled configuration 200 to seat frame assembled configuration 202, second segments 118 are configured to disconnect from first segments 116 and interconnect with central frame member 120. As such, second segments 118 may be described as transitioning frame members 114.

Central frame member 120 further includes two pairs of transitioning frame member receivers 122 that are spaced apart from one another along the width of central frame member 120 and positioned proximate to, and inside of, longitudinal frame members 112. In some examples, second segments 118 are engaged with central frame member 120 via the two pairs of transitioning frame member receivers 122. More specifically, second segments 118 of first pair 124 of longitudinal frame member 112 may be configured, and oriented by central frame member 120, to form ground-contacting ends 138 in seat frame assembled configuration 202. Second segments 118 of second pair 126 of longitudinal frame members 112 may be configured, and oriented by central frame member 120, to form seat-contacting ends 140 in seat frame assembled configuration 202. The telescopic insert portions 160 may be inserted into transitioning frame member receivers 122 and engaged with telescopic receiving portions 162 via, and/or within, transitioning frame member receivers 122, such as discussed herein.

In such examples, first segments 116 of first pair 124 and second pair 126 of longitudinal frame members 112 may be fixedly coupled to central frame member 120. First segments 116 of first pair 124 of longitudinal frame members 112 form upper seat-contacting ends 156, and first segments 116 of second pair 126 of longitudinal frame members 112 form ground-contacting ends 138. As shown in FIG. 16, the distal ends of first segments 116 of second pair 126 of longitudinal frame members 112 may include telescopic insert portions 160. With this in mind, interconverting support frame 40 may include covers, caps, and/or rubberized sockets, that are attached to these telescopic insert portions 160 in seat frame assembled configuration 202, such as to protect these telescopic insert portions 160 and form ground-contacting ends 138 therefrom.

In other examples, central frame member 120 includes longitudinal frame member receivers 150 that receive first segments 116 of second pair 126 of longitudinal frame members 112 in pack frame assembled configuration 200. In particular, first segments 116 of second pair 126 of longitudinal frame members 112 may include telescopic insert portions 160 that are received in longitudinal frame member receivers 150 in pack frame assembled configuration 200. In such examples, to transition interconverting support frame 40 from pack frame assembled configuration 200 to seat frame assembled configuration 202, first segments 116 of second pair 126 of longitudinal frame members 112 are disconnected from longitudinal frame member receivers 150 and inserted into two, laterally spaced apart transitioning frame member receivers 122 that orient the first segments 116 to form seat-contacting ends 140. In other words, the two transitioning frame member receivers 122 may orient first segments 116 to extend in a direction transverse to the direction first segments 116 are oriented by longitudinal frame member receivers 150. In such examples, first segments 116 of second pair 126 of longitudinal frame members 112 may be described as transitioning frame members 114.

Also in such examples, telescopic insert portions 160 of second segments 118 of first pair 124 of longitudinal frame members 112 may be inserted into longitudinal frame member receivers 150 to form ground-contacting ends 138 in seat frame assembled configuration 202. Telescopic receiving portions 162 of the second segments 118 of second pair 126 of longitudinal frame members 112 may be engaged with the other two transitioning frame member receivers 122 to form ground-contacting ends 138. In other words, first segment 116 and second segment 118 of each longitudinal frame member 112 of second pair 126 are received by a pair of transitioning frame member receivers 122 and may be interconnected through telescopic coupling mechanism 154 within or via the pair of transitioning frame member receivers 122, such as discussed herein.

As shown in the examples of load-carrying device 400 of FIG. 17, interconverting support frame 40 is assembled in pack frame assembled configuration 200 and received in frame-receiving region 406 of pack 402. Second segments 118 of first pair 124 of longitudinal frame members 112 are inserted into and engage the upper tension pocket 408, and second segments 118 of second pair 126 of longitudinal frame members 112 are inserted into and engage the lower tension pocket 408. In other words, interconverting support frame 40 forms four primary engagement points that span the width and length of frame-receiving region 406. In this way, interconverting support frame 40 may provide vertical, lateral, and/or torsional support and/or rigidity to load-carrying device 400.

Figure 19:
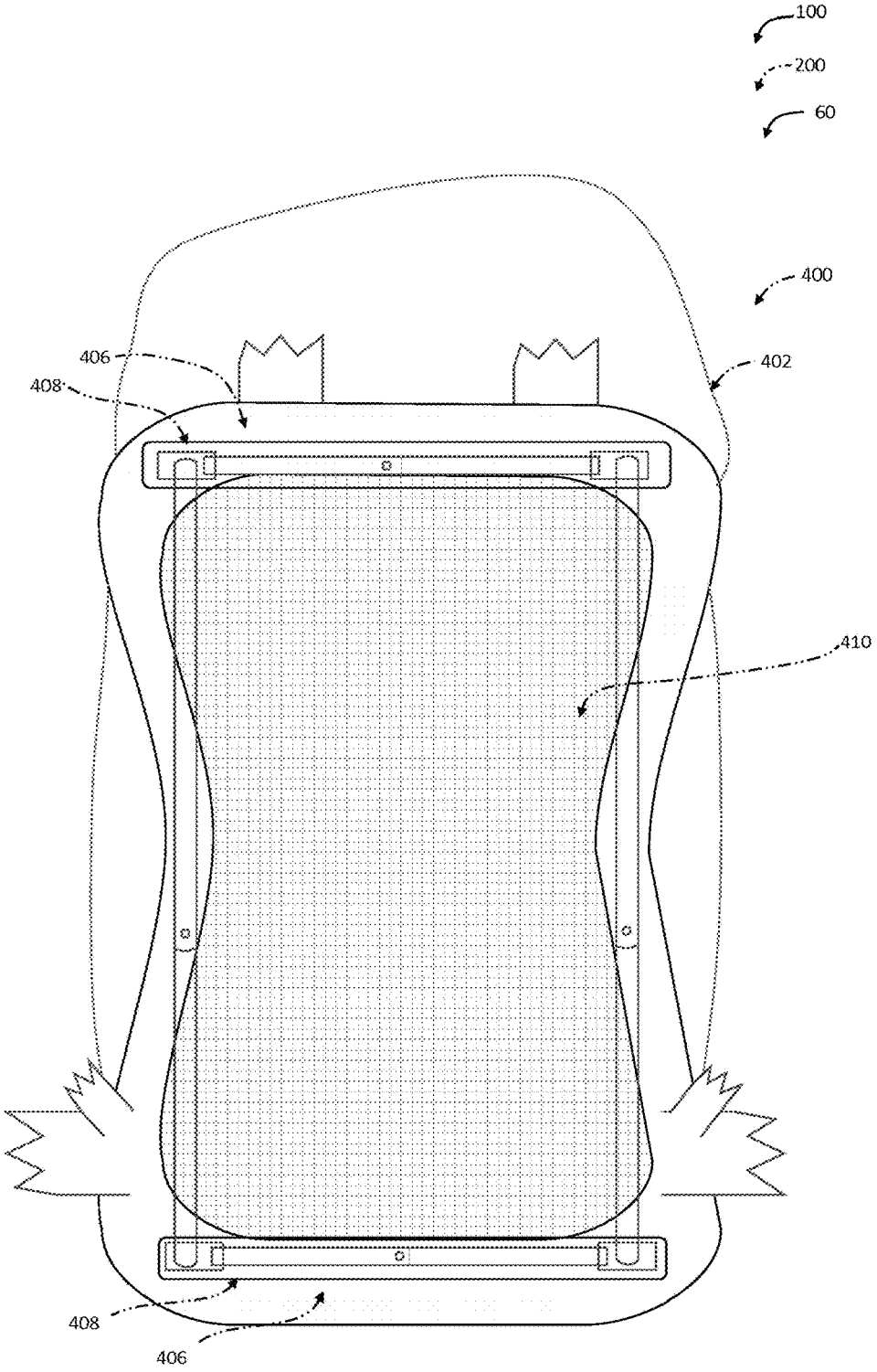
FIG. 19 is an elevation view showing an example of a load-carrying device that includes the interconverting support frame of FIG. 18 according to the present disclosure.
Figure 20:
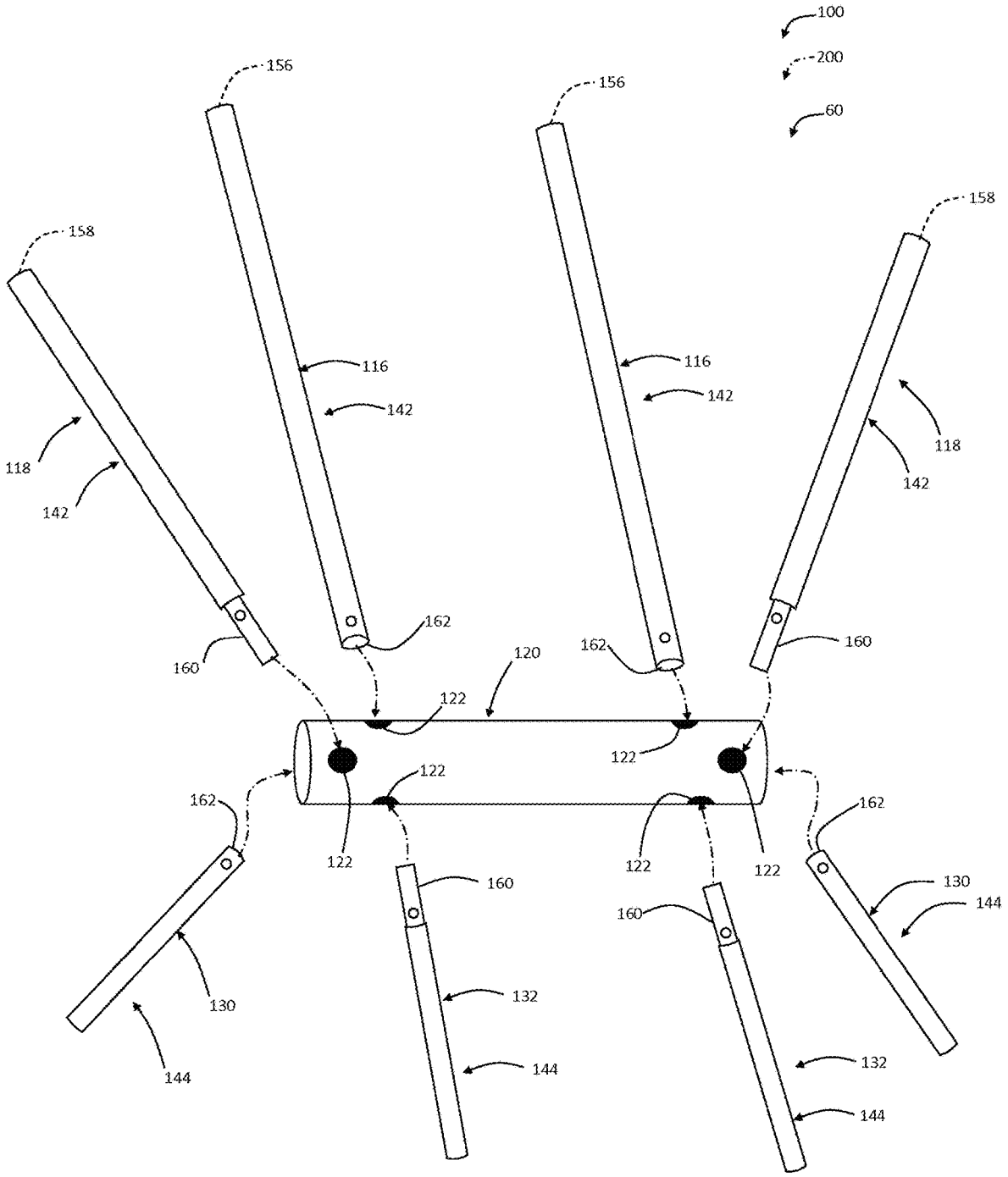
FIG. 20 is an exploded isometric view showing examples of the interconverting support frame of FIG. 18 being transitioned between the pack frame assembled configuration and the seat frame assembled configuration.

Turning to FIGS. 18-20, illustrated therein are examples of interconverting support frame 100 that are indicated that at, and referred to herein, as interconverting support frame 60. More specifically, FIG. 18 illustrates examples of interconverting support frame 60 in pack frame assembled configuration 200, FIG. 19 illustrates examples of a load-carrying device 400 that includes interconverting support frame 60, and FIG. 20 illustrates examples of interconverting support frame 60 being interconverted between pack frame assembled configuration 200 and seat frame assembled configuration 202.

Generally with reference to FIGS. 18-20, and with an initial focus on FIG. 18, longitudinal frame members 112 and transitioning frame members 114 are configured to be disconnected from central frame member 120 in pack frame assembled configuration 200. In other words, longitudinal frame members 112 of interconverting support frame 60 may be described as being transitioning frame members 114.

Interconverting support frame 60 includes a pair of longitudinal frame members 112 that may extend parallel to and spaced apart from one another in pack frame assembled configuration 200. Interconverting support frame 60 also includes a pair of transitioning frame members 114 that extend between and interconnect longitudinal frame members 112. More specifically, interconverting support frame 60 includes four transitioning frame member couplers 152 that are operably couple the ends of transitioning frame members 114 with the distal ends or distal end regions of longitudinal frame members 112. Transitioning frame members 114 support longitudinal frame members 112 spaced apart from one another such that such that interconverting support frame 60 forms a rectangular shape in pack frame assembled configuration 200.

Each transitioning frame member 114 is a segmented transitioning frame member 134 and includes first transitioning frame member segment 130, second transitioning frame member segment 132, and telescopic coupling mechanism 154 that directly interconnects the first and second transitioning frame member segments to one another. Each longitudinal frame member 112 includes first segment 116, second segment 118, and telescopic coupling mechanism 154 that directly interconnects first segment 116 and second segment 118 to one another. Telescopic coupling mechanisms 154 of segmented transitioning frame members 134 each may include telescopic retaining mechanism 174 configured to selectively retain first transitioning frame member segment 130 and second transitioning frame member segment 132 interconnected with one another. Likewise, telescopic coupling mechanisms 154 of longitudinal frame members 112 may include telescopic retaining mechanism 174 configured to selectively retain first segment 116 and second segment 118 interconnected with one another. Each transitioning frame member coupler 152 and/or the ends of each longitudinal frame member 112 and each transitioning frame member 114 may include rotational retaining mechanism 125 that is configured to restrict longitudinal frame members 112 and transitioning frame members 114 from rotating within transitioning frame member couplers 152.

Turning focus to FIG. 19, pack 402 of load-carrying device 400 includes frame-receiving region 406 having a pair of tension pockets 408 that are spaced apart from one another along the length, or height, of pack 402. In load-carrying device 400, interconverting support frame 60 is received in frame-receiving region 406 such that each transitioning frame member 114 extends within and across a respective tension pocket 408. Longitudinal frame members 112 extend between tension pockets 408 and generally aligned with the length of pack 402. Central frame member 120 is disconnected from longitudinal frame members 112 and transitioning frame members 114, and central frame member 120 may be stowed or carried in a pocket of pack 402.

Turning to FIG. 20, to transition interconverting support frame 60 from pack frame assembled configuration 200, to seat frame assembled configuration 202, first segment 116 and second segment 118 of longitudinal frame members 112 are disconnected from one another to expose telescopic insert portion 160 and telescopic receiving portions 162 thereof. Similarly, first transitioning frame member segment 130 and second transitioning frame member segment 132 are disconnected from one another to expose telescopic insert portions 160 telescopic receiving portions 162.

Central frame member 120 includes four pairs of transitioning frame member receivers 122, two of which being positioned adjacent to one end of central frame member 120 and the other two of which being positioned adjacent to the other end of central frame member 120. Each pair of transitioning frame member receivers 122 extends through central frame member 120 transverse to the pair of transitioning frame member receivers 122 positioned proximate thereto.

First segments 116 and second segments of longitudinal frame members 112 are configured to form seat-contacting transitioning frame members 142 in seat frame assembled configuration 202. First segments 116 may be configured to form upper seat-contacting ends 156 and second segments 118 may be configured to form lower seat-contacting ends 158. In other words, first segments 116 may be longer than second segments 118.

First transitioning frame member segments 130 and second transitioning frame member segments 132 are configured to form ground-contacting transitioning frame members 144. Thus, first transitioning frame member segments 130 may have at least substantially the same length as second transitioning frame member segments 132, not considering the length of telescopic insert portions 160.

First segments 116 include telescopic receiving portions 162 and second segments 118 include telescopic insert portions 160. First transitioning frame member segments 130 include telescopic receiving portions 162, and second transitioning frame member segments 132 include telescopic insert portions 160. Telescopic receiving portions 162 of first transitioning frame member segments 130 and telescopic insert portions 160 of second segment 118 are engaged with one another via two corresponding pairs of transitioning frame member receivers 122, which orient first transitioning frame member segments 130 to extend downwardly from central frame member 120 and second segments 118 to extend upwardly from central frame member 120. Similarly, telescopic receiving portions 162 of first segments 116 are engaged with telescopic insert portions 160 of second transitioning frame member segments 132 via two corresponding pairs of transitioning frame member receivers 122, which orient first segments 116 to extend upwardly from central frame member 120 and orient second transitioning frame member segments 132 extend downwardly from central frame member 120.

In the examples of FIG. 20, second segments 118 are positioned along central frame member 120 laterally outside of first segments 116 in seat frame assembled configuration 202, such that lower seat-contacting ends 158 may be spaced further apart than upper seat-contacting ends 156. However, interconverting support frame 60 also may be configured such that first segments 116 are positioned laterally outside of second segments 118, such that upper seat-contacting ends 156 may be spaced further apart than lower seat-contacting ends 158. In other words, first segments 116 and second segments 118 may be interconnected with either pair of transitioning frame member receivers 122.

Figure 21:
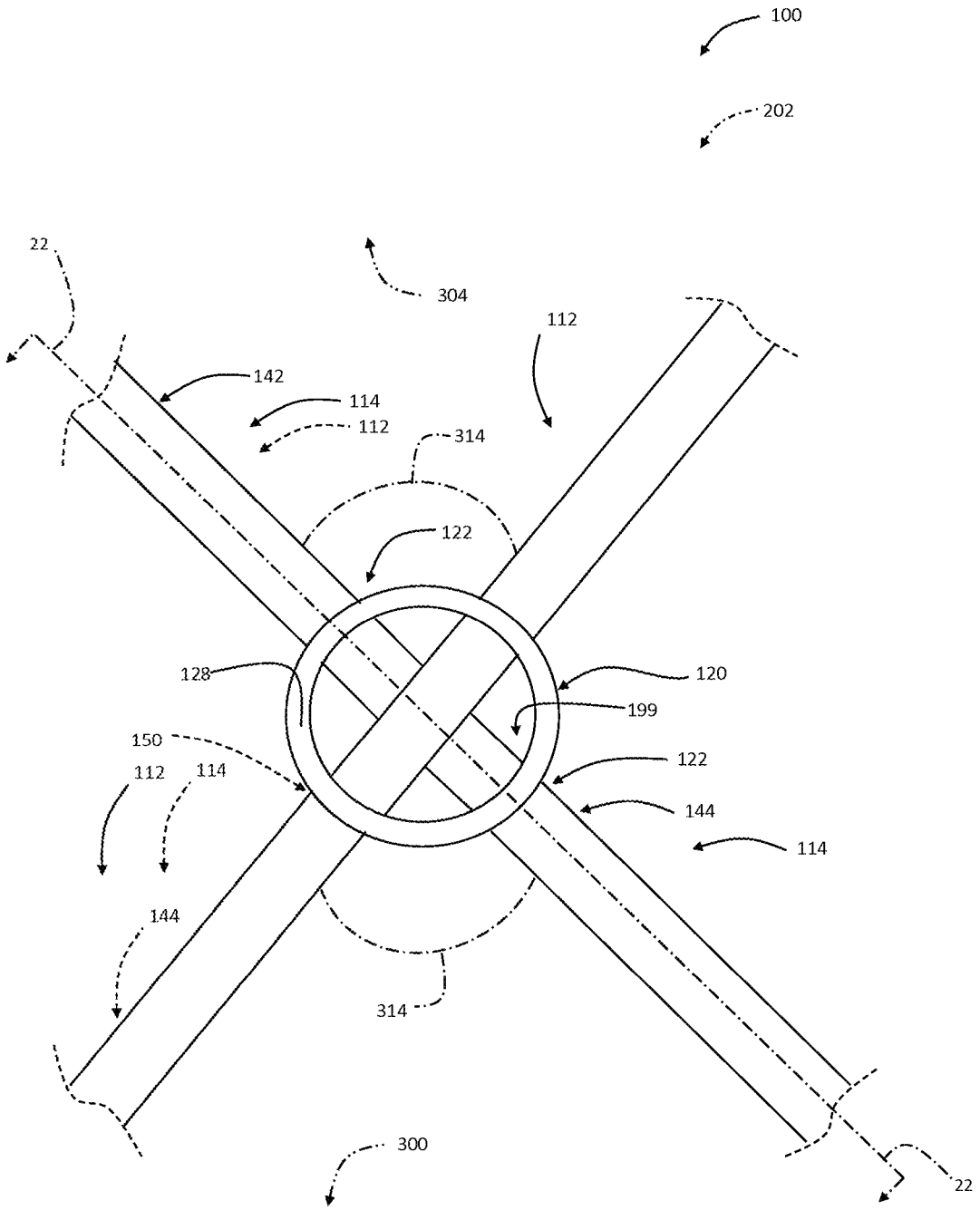
FIG. 21 is a schematic side view showing example central frame members of interconverting support frames in the seat frame assembled configuration according to the present disclosure.

FIG. 21 is a partial elevation view showing examples of interconverting support frames 100 in seat frame assembled configuration 200. Central frame member 120 is illustrated extending into the page with one end 128 of central frame member 120 shown. Two longitudinal frame members 112 and two transitioning frame members 114 are operably interconnected with central frame member 120 adjacent to the end 128 of central frame member 120 shown. Another two longitudinal frame members 112 and two transitioning frame members 114 are operably interconnected with central frame member 120 adjacent to the other end 128 thereof. At least two of the longitudinal frame members 112 extend upwardly towards seat fabric 304 and at least two transitioning frame members 114 extend downwardly towards ground surface 300.

Figure 22:
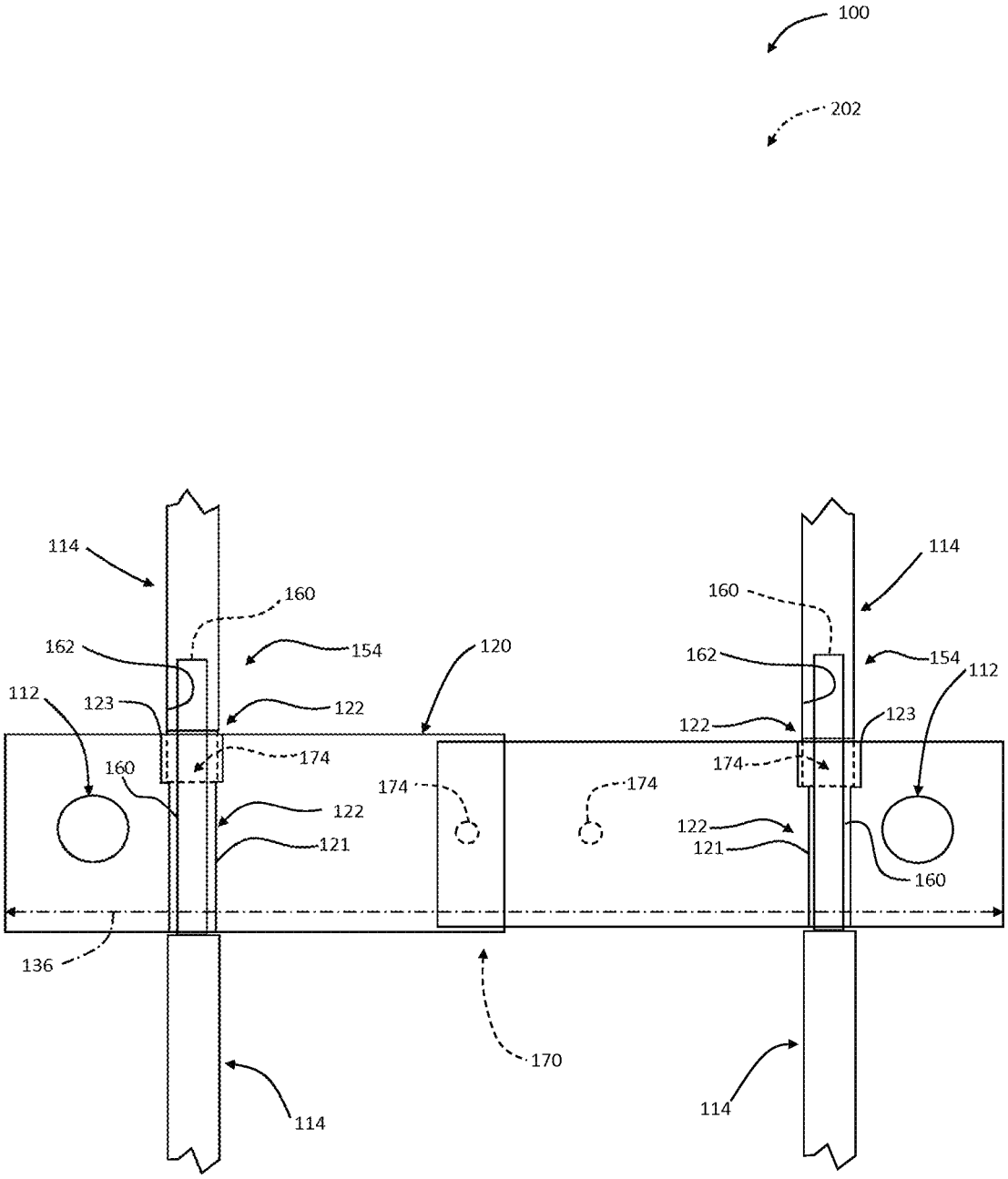
FIG. 22 is a cross-sectional view taken along line 22-22 of FIG. 21 showing less-schematic examples of central frame members according to the present disclosure.
Figure 23:
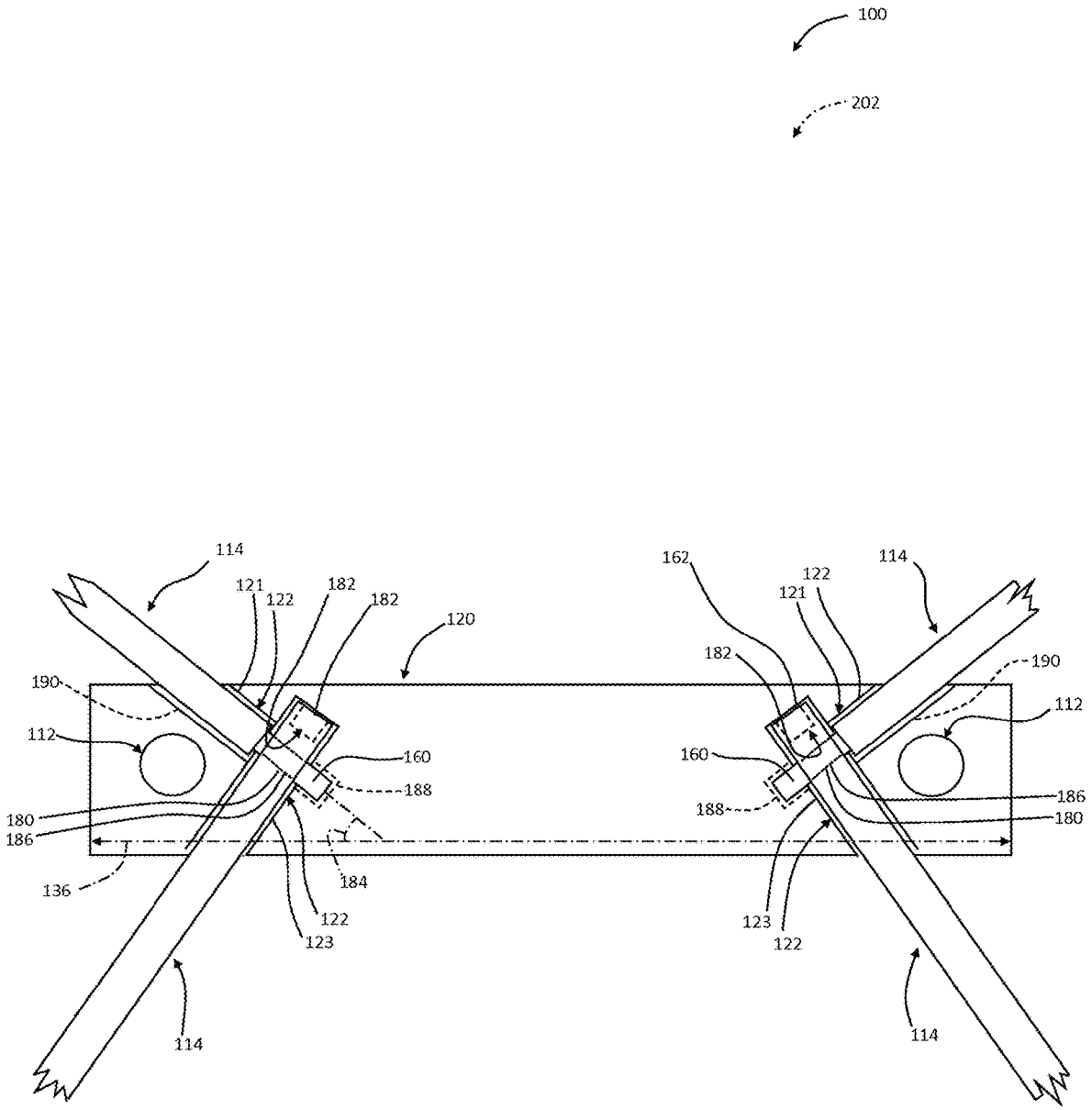
FIG. 23 is a cross-sectional view taken along line 22-22 of FIG. 21 showing additional less-schematic examples of central frame members according to the present disclosure.

In FIGS. 21-23, longitudinal frame member 112 is utilized generically and may indicate a longitudinal frame member 112, the first segment 116 thereof, or the second segment 118 thereof. Likewise, transitioning frame member 114 is utilized generically and may indicate a transitioning frame member 114, a first transitioning frame member segment 130 thereof, or a second transitioning frame member segment 132 thereof.

In these examples, central frame member 120 includes a hollow and elongated tubular shape and with a diameter that is greater than that of longitudinal frame members 112 and transitioning frame members 114. At least two transitioning frame members 114 and at least two longitudinal frame members 112 extend through an internal volume 199 of central frame member 120 such as to interconnect with the two other transitioning frame members 114 and the two other longitudinal frame members 112 within the internal volume 199 of central frame member 120 or on the other side of central frame member 120.

Central frame member 120 includes two pairs of transitioning frame member receivers 122, with one of the two pairs of transitioning frame member receivers 122 shown in the elevation view of FIG. 21. The transitioning frame member receivers 122 that form a pair extend through circumferentially opposed regions of central frame member 120 towards one another. Each pair of transitioning frame member receivers 122 operably receives two transitioning frame members 114 and orients the transitioning frame members 114 to extend from central frame member 120 coaxially, or aligned, with one another such that one transitioning frame member 114 extends upwardly towards seat fabric 304 to form a seat-contacting transitioning frame member 142 and the other transitioning frame member 114 extends downwardly towards ground surface 300 to form a ground-contacting transitioning frame member 144. The pair of transitioning frame member receivers 122 also orient transitioning frame members 114 to extend at an intersection angle 314 with the longitudinal frame members 112 that extend upwardly towards seat fabric 304 and/or with the longitudinal frame members 112 that extend downwardly towards ground surface 300. Examples of suitable intersection angles 314 include at least 80 degrees)(°, at least 90°, at least 95°, at least 100°, at least 105°, at least 110°, at least 115° at least 120°, at least 130°, at most 95°, at most 100°, at most 105°, at most 110°, at most 115°, at most 120°, at most 125°, at most 130°, and/or at most 140°.

As discussed herein, for example in connection to interconverting support frame 40, interconverting support frame 50, and interconverting support frame 60, seat-contacting transitioning frame members 142 may be formed by longitudinal frame members 112 and/or a segment thereof. In such examples, central frame member 120 includes longitudinal frame member receivers 150 that are circumferentially opposed to and coaxial with, or aligned with, the longitudinal frame members 112 that extend upwardly towards seat fabric 304. In such examples, a ground-contacting transitioning frame member 144 is received in each longitudinal frame member receiver 150 and may be oriented at intersection angle 314 with the other two ground-contacting transitioning frame members 144.

Turning to FIG. 22, illustrated therein is a partial cross-sectional view taken along line 22-22 of FIG. 21 showing examples of interconverting support frames 100 in seat frame assembled configuration. As shown, central frame member 120 includes two pairs of transitioning frame member receivers 122, with each pair being positioned adjacent to and inside of a respective longitudinal frame member 112. Each pair of transitioning frame member receivers 122 includes a first transitioning frame member receiver 121 that is configured to receive and engage telescopic insert portion 160 of a transitioning frame member 114 and a second transitioning frame member receiver 123 that is configured to operably engage, and optionally receive, telescopic receiving portion 162 of another transitioning frame member 114. First transitioning frame member receiver 121 includes a socket that is dimensioned to receive and engage telescopic insert portion 160 and extends through central frame member 120 to second transitioning frame member receiver 123.

In some examples, second transitioning frame member receiver 123 includes a bore or a socket in central frame member 120 through which telescopic insert portion 160 extends and protrudes from central frame member 120. Telescopic receiving portion 162 of the other transitioning frame member 114 may receive the end region of telescopic insert portion 160 that extends from central frame member 120 via second transitioning frame member receiver 123. In other words, the two transitioning frame members 114 may be interconnected with one another via transitioning frame member receivers 122 and telescopic coupling mechanism 154. In such examples, an end, rim, or collar of telescopic receiving portion 162 may engage or rest upon the exterior surface of central frame member 120 about the second transitioning frame member receiver 123.

Additionally or alternatively, each second transitioning frame member receiver 123 may include a socket that is configured to receive telescopic receiving portion 162, or and end region of transitioning frame member 114 that surrounds telescopic receiving portion 162. The socket of second transitioning frame member receiver 123 may be coaxial with the first transitioning frame member receiver 121. In such examples, telescopic insert portion 160 and telescopic receiving portion 162 each may be inserted into the respective transitioning frame member receivers 122 and engaged with one another within the pair of transitioning frame member receivers 122.

As further shown in FIG. 22 telescopic insert portions 160 and/or telescopic receiving portions 162 may include telescopic retaining mechanism 174, and telescopic retaining mechanism 174 may selectively retain telescopic insert portions 160 and/or telescopic receiving portions 162 in connection with one another and/or in connection with transitioning frame member receivers 122 in seat frame assembled configuration 202.

Central frame member 120 also may include central frame member telescoping mechanism 170 that divides central frame member 120 into two telescoping portions that are configured to telescope relative to one another to adjust the width 136 of central frame member 120. Central frame member telescoping mechanism 170 may include a plurality of telescopic retaining mechanisms 174 that are configured to selectively secure the two telescoping portions to one another at a desired width 136. More specifically, one telescopic retaining mechanism 174 may be configured to retain central frame member 120 in a width 136 that is desired for seat frame assembled configuration 202, and at least one other telescopic retaining mechanism 174 may be configured to retain central frame member 120 with a width 136 that is desired for pack frame assembled configuration 200.

While FIG. 22 illustrates examples in which the first transitioning frame member receivers 121 extend into central frame member 120 along parallel and aligned directions, in other examples, central frame member 120 is configured such that first transitioning frame member receivers 121 extend into central frame member 120 along parallel and opposed directions, such as in interconverting support frame 30.

FIG. 23 is a partial cross-sectional view taken along line 22-22 of FIG. 21 showing additional examples of interconverting support frames 100 in seat frame assembled configuration 202. More specifically, FIG. 23 illustrates examples in which transitioning frame members 114 are oriented by central frame member 120 to extend laterally beyond the width 136 of central frame member 120 in seat frame assembled configuration 202. The examples of FIG. 23 may be utilized, for example, in interconverting support frame 20, interconverting support frame 30, and/or interconverting support frame 40.

Central frame member 120 includes two pairs of transitioning frame member receivers 122 that are positioned proximate, and inside of, longitudinal frame members 112. Each pair of transitioning frame member receivers 122 includes first transitioning frame member receiver 121 configured to receive telescopic insert portion 160 of a transitioning frame member 114, and a second transitioning frame member receiver 123 configured to receive telescopic receiving portion 162 of another transitioning frame member 114.

First transitioning frame member receiver 121 includes a socket that extends into central frame member 120 at a skewed angle 184 relative to the width 136 of central frame member 120. Examples of suitable skewed angles 184 include at least 30°, at least 40°, at least 45°, at least 50°, at least 60°, at most 40°, at most 45°, at most 50°, at most 50°, at most 55°, at most 60°, at most 65°, and/or at most 70°. As an example, first transitioning frame member receiver 121 may include a tubular member that is dimensioned and shaped corresponding to telescopic insert portion 160 and an end portion of transitioning frame member 114 that is adjacent to, and wider than, telescopic insert portion 160.

Second transitioning frame member receiver 123 includes a socket that extends into central frame member 120 transverse to, and optionally at least substantially normal to, first transitioning frame member receiver 121. Second transitioning frame member receiver 123 is configured to receive an end region of transitioning frame member 114 that surrounds telescopic receiving portion 162. As an example, second transitioning frame member receiver 123 may include a tubular member that is dimensioned and shaped to receive an end portion of transitioning frame member 114 that surrounds telescopic receiving portion 162. Second transitioning frame member receiver 123 also may include a shank 182 positioned at the distal end thereof that is configured to be inserted into and engage telescopic receiving portion 162. Shank 182 may be configured to retain transitioning frame member 114 within second transitioning frame member receiver 123 and/or strengthen interconverting support frame 100 in seat frame assembled configuration 202. The socket of second transitioning frame member receiver 123 may terminate at an inside wall of central frame member 120 and may be welded, bonded, otherwise affixed thereto, which also may strengthen interconverting support frame 100 in seat frame assembled configuration 202.

The socket of first transitioning frame member receiver 121 intersects and may be bonded, welded, or otherwise affixed, to a midsection of the socket of second transitioning frame member receiver 123. Second transitioning frame member receiver 123 includes a bore 180 that extends through second transitioning frame member receiver 123 where first transitioning frame member receiver 121 intersects second transitioning frame member receiver 123. Bore 180 extends at skewed angle 184 relative to width 136 of central frame member 120 and is dimensioned to permit telescopic insert portion 160 to be inserted therethrough.

Each transitioning frame member 114 that includes telescopic receiving portion 162 is provided with a receiving bore 186 that extends through transitioning frame member 114 transverse to the length thereof. Receiving bore 186 is configured to align with bore 180 of second transitioning frame member receiver 123 when telescopic receiving portion 162 of the transitioning frame member 114 is operably received in second transitioning frame member receiver 123.

To assemble interconverting support frame 100 in seat frame assembled configuration 202, telescopic receiving portion 162 is inserted into second transitioning frame member receiver 123 such that receiving bore 186 of the corresponding transitioning frame member 114 is aligned with bore 180 of second transitioning frame member receiver 123. Telescopic insert portion 160 then is inserted into first transitioning frame member receiver 121 such that telescopic insert portion 160 extends through, and optionally is engaged by, receiving bore 186 of the other transitioning frame member 114.

First transitioning frame member receiver 121 may include a mouth portion 190 that is configured to receive and engage the end portion of transitioning frame member 114 from which telescopic insert portion 160 extends and a throat portion 188 that is configured to receive an end region of telescopic insert portion 160 that may protrude from bore 180. Throat portion 188 of first transitioning frame member receiver 121 may be affixed to second transitioning frame member receiver 123 about bore 180 and may extend coaxially with bore 180. Optionally, throat portion 188 may extend to an inside wall of central frame member 120 and may be bonded, welded, or otherwise affixed thereto, which may increase the strength of interconverting support frame 100 in seat frame assembled configuration 202.

While FIG. 23 illustrates examples in which the first transitioning frame member receivers 121 extend into central frame member 120 from the same side of central frame member 120, in other examples, central frame member 120 is configured such that first transitioning frame member receivers 121 extend into central frame member 120 from opposed sides of central frame member 120, such as in interconverting support frame 30.

Also, while FIGS. 22 and 23 illustrates examples in which transitioning frame member receivers 122 are positioned laterally inside of longitudinal frame members 112 along the width 136 of central frame member 120, it also is within the scope of the present disclosure that transitioning frame member receivers 122 may be positioned laterally outside of longitudinal frame members 112.

Examples of interconverting support frames 100, load-carrying devices 400, and seats 301 according to the present disclosure are presented in the following enumerated paragraphs:

A. An interconverting support frame (100), comprising:

a plurality of interconnecting frame members (110) configured to be selectively assembled in plurality of assembled configurations, which includes a pack frame assembled configuration (200) and a seat frame assembled configuration (202), wherein the plurality of interconnecting frame members (110) includes:

a central frame member (120);

a plurality of longitudinal frame members (112) configured to engage and support a pack (402) of a load-carrying device (400) in the pack frame assembled configuration (200);

a plurality of transitioning frame members (114) configured to selectively interconnect with and selectively disconnect from the central frame member (120) to transition the interconverting support frame (100) between the pack frame assembled configuration (200) and the seat frame assembled configuration (202); and wherein the plurality of longitudinal frame members (112) and the plurality of transitioning frame members are operably interconnected with the central frame member (120) in the seat frame assembled configuration (202), and wherein the interconverting support frame (100) is configured to support a seat fabric (304) on a ground surface (300) and suspend the seat fabric (304) spaced above the ground surface (300) in the seat frame assembled configuration (202).

A1. The interconverting support frame (100) of paragraph A, wherein the plurality of longitudinal frame members (112) extend at least substantially along a common plane in only one of and optionally each of the pack frame assembled configuration (200) and the seat frame assembled configuration (202).

A2. The interconverting support frame (100) of any of paragraphs A-A1, wherein the plurality of longitudinal frame members (112) are operatively coupled to and extend from the central frame member (120) in the pack frame assembled configuration (200).

A3. The interconverting support frame (100) of any of paragraphs A-A2, wherein the plurality of longitudinal frame members (112) comprises a first pair (124) of longitudinal frame members (112) that are configured to be engage an upper portion of a frame-receiving region (406) of the pack (402) in the pack frame assembled configuration (202) and a second pair (126) of longitudinal frame members (112) that are configured to engage a lower portion of the frame-receiving region (406) of the pack (402) that is opposed to the upper portion of the frame receiving region in the pack frame assembled configuration (200).

A3.1. The interconverting support frame (100) of paragraph A3, wherein the first pair (124) and the second pair (126) of longitudinal frame members (112) extend at least substantially along a common plane in the pack frame assembled configuration (200) and in the seat frame assembled configuration (202).

A3.2. The interconverting support frame (100) of any of paragraphs A3-A3.1.1, wherein each longitudinal frame member (112) of the first pair (124) of longitudinal frame members (112) includes a length that is greater than that of each longitudinal frame member (112) of the second pair (126) of longitudinal frame members (112).

A3.3. The interconverting support frame (100) of any of paragraphs A3-A3.2, wherein the first pair (124) of longitudinal frame members (112) form seat-contacting ends (140) in the seat frame assembled configuration (202), and wherein the second pair (126) of longitudinal frame members (112) form ground-contacting ends (138) in the seat frame assembled configuration (202).

A3.4. The interconverting support frame (100) of any of paragraphs A3-A3.3, wherein one or more of the first pair (124) and the second pair (126) of longitudinal frame members (112) are fixedly coupled to the central frame member (120).

A3.5. The interconverting support frame (100) of any of paragraphs A3-A3.4, wherein each longitudinal frame member (112) of the first pair (124) of longitudinal frame members (112) is one or more of bent, non-linear, and/or kinked.

A3.6. The interconverting support frame (100) of any of paragraphs A3-A3.5, wherein, in the seat frame assembled configuration (202) and in the pack frame assembled configuration (200), the longitudinal frame members (112) of the first pair (124) of longitudinal frame members (112) one or more of:

extend at least substantially parallel to one another; and extend along a common plane.

A3.7. The interconverting support frame (100) of any of paragraphs A3-A3.6, wherein in the seat frame assembled configuration (202) and in the pack frame assembled configuration (200), the longitudinal frame members (112) of the second pair (126) of longitudinal frame members (112) one or more of:

extend at least substantially parallel to one another; and extend along a common plane.

A4. The interconverting support frame (100) of any of paragraphs A3-A3.7, wherein the central frame member (120) supports the first pair (124) of longitudinal frame members (112) laterally spaced apart from one another along a width of central frame member (120), and wherein the central frame member (120) supports the second pair (126) of longitudinal frame members (112) laterally spaced apart from one another along the width of the central frame member (120) in the seat frame assembled configuration (202).

A5. The interconverting support frame (100) of any of paragraphs A-A4, wherein each transitioning frame member (114) extends in a direction that is at least substantially transverse to a direction along which at least two longitudinal frame members (112) extend in the seat frame assembled configuration (202) and/or in the backpack frame assembled configuration (200).

A6. The interconverting support frame (100) of any of paragraphs A-A5, wherein the interconverting support frame (100) is configured distribute a load across the pack (402) of the load-carrying device (400) in the pack frame assembled configuration (200).

A7. The interconverting support frame (100) of any of paragraphs A-A6, wherein in the seat frame assembled configuration (202), the plurality of interconnecting frame members (110) includes four seat-contacting ends (140) that are positioned to engage and support the seat fabric (304).

A7.1. The interconverting support frame (100) of paragraph A7, wherein in the seat frame assembled configuration (202), the central frame member (120) supports at least two of the transitioning frame members (114) to extend upwardly relative to the ground surface (300) to form seat-contacting ends (140).

A7.2. The interconverting support frame (100) of any of paragraphs A7-A7.1, wherein in seat frame assembled configuration (202), the central frame member (120) supports at least two of the longitudinal frame members (112) to extend upwardly relative to the ground surface (300) to form include seat-contacting ends (140).

A8. The interconverting support frame (100) of any of paragraphs A-A7.4, wherein in seat frame assembled configuration (202), the central frame member (120) supports at least two of the longitudinal frame members (112) to extend downwardly to form ground-contacting ends (138) that are positioned to engage on the ground surface (300) and support the interconverting support frame (100) on the ground surface (300).

A9. The interconverting support frame (100) of any of paragraphs A-A8, wherein, in seat frame assembled configuration (202), the central frame member (120) supports at least two of the transitioning frame members (114) to extend downwardly towards the ground surface (300) and form ground-contacting ends (138) that are positioned to engage on the ground surface (300) and support the interconverting support frame (100) on the ground surface (300).

A10. The interconverting support frame (100) of any of paragraphs A-A9, wherein, in the seat frame assembled configuration (202), the interconverting support frame (100) includes four ground-contacting ends (138) and four seat-contacting ends (140).

A11. The interconverting support frame (100 of any of paragraphs A-A10, wherein the plurality of interconnecting frame members (110) are interconnected with one another in the pack frame assembled configuration (200).

A12. The interconverting support frame (100) of any of paragraphs A-A11, wherein the plurality of transitioning frame members (114) and the plurality of longitudinal frame members (112) are oriented by the central frame member (120) to extend oblique to the ground surface (300) in the seat frame assembled configuration (202).

A13. The interconverting support frame (100) of any of paragraphs A-A12, wherein each transitioning frame member (114) of the plurality of transitioning frame members (114) is disconnected from the central frame member (120) in the pack frame assembled configuration (200).

A14. The interconverting support frame (100) of any of paragraphs A-A13, wherein each transitioning frame member (114) of the plurality of transitioning frame members (114) is directly interconnected with the central frame member (120) in the seat frame assembled configuration (202).

A15. The interconverting support frame (100) of any of paragraphs A-A14, wherein the interconverting support frame 100 is configured to form the pack frame assembled configuration (200) with one or more transitioning frame members (114) of the plurality of transitioning frame members (114) disconnected from the other interconnecting frame members (110).

A16. The interconverting support frame (100 of any of paragraphs A-A15, wherein at least two transitioning frame members (114) of the plurality of transitioning frame members (114) comprises a telescopic insert portion (160) that is configured to be selectively received in and removed from a transitioning frame member receiver (122) of the central frame member (120).

A17. The interconverting support frame (100) of any of paragraphs A-A16, wherein a/the second pair (126) of longitudinal frame members (112) is configured to selectively disconnect from and reconnect with the central frame member (120) to form a pair of seat-contacting transitioning frame members (142) of the plurality of transitioning frame members (114).

A17.1. The interconverting support frame (100) of paragraph A17, wherein the second pair (126) of longitudinal frame members (112) are directly interconnected with the central frame member (120) in the pack frame assembled configuration (200).

A17.1.1. The interconverting support frame (100) of paragraph A17.1, wherein the second pair (126) of longitudinal frame members (112) are interconnected the central frame member (120) through a pair of longitudinal frame member receivers (150) in the pack frame assembled configuration (200), wherein the second pair (126) of longitudinal frame members (112) are interconnected with the central frame member (120) through a pair of transitioning frame member receivers (122) in the seat frame assembled configuration (202), and wherein the pair of longitudinal frame member receivers (150) are circumferentially offset from the pair of transitioning frame member receivers (122).

A17.1.1.1. The interconverting support frame (100) of paragraph A17.1.1, wherein the second pair (126) of longitudinal frame members (112) are oriented by the pair of longitudinal frame member receivers (150) to extend in a first direction that is at least substantially transverse to a second direction along which the pair of transitioning frame member receivers (122) orient the second pair (126) of longitudinal frame members (112).

A17.2. The interconverting support frame (100) of any of paragraphs A17-A17.1.1.1, wherein, in the seat frame assembled configuration (202), the interconverting support frame (100) includes two upper seat-contacting ends (156) that are positioned to operatively contact and support upper corners (308) of the seat fabric (304) and two lower seat-contacting ends (158) that are positioned to operatively contact and support lower corners (310) of the seat fabric (304), and wherein the first pair (124) longitudinal frame members (112) include the upper seat-contacting ends (156), and wherein the second pair (126) of longitudinal frame members (112) include the lower seat-contacting ends (158).

A17.3. The interconverting support frame (100) of any of paragraphs A17-A17.2, wherein the plurality of transitioning frame members (114) further includes four ground-contacting transitioning frame members (144) that are positioned and oriented to contact the ground surface (300) in the seat-frame assembled configuration (202).

A17.3.1. The interconverting support frame (100) of paragraph A17.3, wherein two of the four ground-contacting transitioning frame members (144) are interconnected with the central frame member (120) through the first pair of longitudinal frame member receivers (150) in the seat frame assembled configuration (202).

A18. The interconverting support frame (100) of any of paragraphs A-A17.3.1, wherein two transitioning frame members (114) of the plurality of transitioning frame members (114) are segmented transitioning frame members (134), wherein each segmented transitioning frame member (134) comprises a first transitioning frame member segment (130) and a second transitioning frame member segment (132) that are configured to selectively interconnect with and disconnect from one another to transition the interconverting support frame (100) between the pack frame assembled configuration (200) and the seat frame assembled configuration (202).

A18.1. The interconverting support frame (100) of paragraph A18, wherein the first transitioning frame member segment (130) and the second transitioning frame member segment (132) of each segmented transitioning frame member (134) are operably interconnected with the central frame member (120) in the seat frame assembled configuration (202).

A18.1.1. The interconverting support frame (100) of paragraph A18.1, wherein the central frame member (120) at least partially interposes the first transitioning frame member segment (130) and the second transitioning frame member segment (132) of each segmented transitioning frame member (134) in the seat frame assembled configuration (202).

A18.2. The interconverting support frame (100) of any of paragraphs A18-A18.1.1, wherein the first transitioning frame member segment (130) and the second transitioning frame member segment (132) of each segmented transitioning frame member (134) are directly interconnected with one another in the pack frame assembled configuration (202).

A18.3. The interconverting support frame (100) of any of paragraphs A18-A18.2, wherein each second transitioning frame member segment (132) is oriented by the central frame member (120) to contact and support the seat fabric (304) in the seat frame assembled configuration (202), and wherein each first transitioning frame member segment (130) is oriented by the central frame member (120) to contact the ground surface (300) in the seat frame assembled configuration (202).

A18.4. The interconverting support frame of any of paragraphs A18-A18.3, wherein the second transitioning frame member segment (132) is one or more of bent, non-linear, and/or kinked.

A18.5. The interconverting support frame of any of paragraphs A18-A18.4, wherein the second transitioning frame member segment (132) extends laterally beyond the central frame member (120) in the seat frame assembled configuration (202).

A18.6. The interconverting support frame of any of paragraphs A18-A18.5, wherein each second transitioning frame member segment (132) is greater in length than each first transitioning frame member segment (130).

A18.7. The interconverting support frame of any of paragraphs A18-A18.2, wherein the first transitioning frame member segment (130) and the second transitioning frame member segment (132) of one segmented transitioning frame member (134) are oriented by the central frame member (120) to contact the seat fabric (304), and wherein the first transitioning frame member segment (130) and the second transitioning frame member segment (132) of the other segmented transitioning frame member (134) are oriented by the central frame member (120) to contact the ground surface (300) in the seat frame assembled configuration (202), and wherein the central frame member (120) orients the first transitioning frame member segment (130) and the second transitioning frame member segment (132) of each segmented transitioning frame member (134) to extent laterally beyond the central frame member (120) in the seat frame assembled configuration (202).

A18.7.1. The interconverting support frame of paragraph A18.7, wherein the first transitioning frame member segment (130) and the second transitioning frame member segment (132) of each segmented transitioning frame member (134) are equal in length to one another, and wherein the two segmented transitioning frame members (134) are different in length from one another.

A19. The interconverting support frame (100) of any of paragraphs A18-A18.7.1, wherein each segmented transitioning frame member (134) comprises a telescopic coupling mechanism (154) that is configured to selectively couple the first transitioning frame member segment (130) and the second transitioning frame member segment (132) to one another and selectively release the first transitioning frame member segment (130) and the second transitioning frame member segment (132) from one another.

A19.1. The interconverting support frame (100) of paragraph A19, wherein the telescoping coupling mechanism (154) is configured to selectively couple the first transitioning frame member segment (130) and the second transitioning frame member segment (132) to respective transitioning frame member receivers (122) of the central frame member (120) in the seat frame assembled configuration (202).

A19.2. The interconverting support frame (100) of any of paragraphs A19-A19.2, wherein the telescopic coupling mechanism (154) comprises a telescopic insert portion (160) that is included in one of the first transitioning frame member segment (130) and the second transitioning frame member segment (132) and a telescopic receiving portion (162) that is included in the other of the first transitioning frame member segment (130) and the second transitioning frame member segment (132), and wherein the telescopic insert portion (160) is configured to selectively insert within, engage, and selectively remove from within the telescopic receiving portion (162)

A19.2.1. The interconverting support frame (100) of paragraph A19.2, wherein, in the seat frame assembled configuration (202), the telescopic insert portion (160) is configured to engage and extend through a respective transitioning frame member receiver (122) and the telescopic receiving portion (162) is configured to receive at least an end region of the telescopic insert portion that protrudes from and/or extends through the transitioning frame member receiver (122).

A19.2.2. The interconverting support frame (100) of paragraph A19.2.1, wherein at least a portion of the telescopic receiving portion (162) extends within a respective transitioning frame member receiver (122) in the seat frame assembled configuration (202).

A20. The interconverting support frame (100) of any of paragraphs A-A19.2.2, wherein at least one transitioning frame member (114) of the plurality of transitioning frame members (114) extends between and interconnects two respective longitudinal frame members (112) of the plurality of longitudinal frame members (112) in the pack frame assembled configuration (200).

A20.1. The interconverting support frame (100) of paragraph A20, wherein the interconverting support frame (100) further includes a plurality of transitioning frame member couplers (152) each being configured to interconnect an end region of a transitioning frame member (114) with a longitudinal frame member (112) in the pack frame assembled configuration (200) and selectively release the end region of the respective transitioning frame member (114) from the respective longitudinal frame member (112) to convert the interconverting support frame (100) from the pack frame assembled configuration (200) to the seat frame assembled configuration (202).

A20.2. The interconverting support frame (100) of any of paragraphs A20-A20.1, wherein the at least one transitioning frame member (114) extends between distal ends or distal end regions of the two respective longitudinal frame members (112) of the plurality of longitudinal frame members (112).

A20.3. The interconverting support frame (100) of paragraph A20.2, wherein the at least one transitioning frame member (114) is directly interconnected with the two respective longitudinal frame members (112) of the plurality of transitioning frame members via two transitioning frame member couplers (152) of the plurality of transitioning frame member couplers (152) in the pack frame assembled configuration (200).

A21. The interconverting support frame (100) of any of paragraph A-A16, wherein each longitudinal frame member (112) of the plurality of longitudinal frame members (112) comprises a first segment (116) and a second segment (118) that are configured to selectively interconnect with and disconnect from one another, and wherein the second segment (118) of each longitudinal frame member (112) is configured to selectively disconnect from the first segment to be a transitioning frame member (114) of the plurality of transitioning frame members (114).

A21.1.1. The interconverting support frame (100) of paragraph A21.1, wherein the first segment (116) of at least two longitudinal frame members (112) is directly interconnected with the central frame member (120) in the pack frame assembled configuration (200), and wherein the first segment (116) and the second segment (118) of each longitudinal frame member (112) are directly interconnected with the central frame member (120) in the seat frame assembled configuration (202).

A21.2. The interconverting support frame (100) of any of paragraphs A21.1-21.1.1, wherein the second segment (118) of each longitudinal frame member (112) forms a distal end of the respective longitudinal frame member (112) in the pack frame assembled configuration (200).

A21.3 The interconverting support frame (100) of any of paragraphs A21.1-A21.2, wherein the second segment (118) of the at least two longitudinal frame members (112) is positioned to operatively contact the ground surface (300) in the seat frame assembled configuration (202).

A21.4. The interconverting support frame (100) of any of paragraphs A21.1-A21.3, wherein each longitudinal frame member (112) comprises a/the telescopic coupling mechanism (154) that is configured to selectively couple the first segment (116) and the second segment (118) to one another and selectively release the first segment (116) and the second segment (118) from one another.

A21.4.1. The interconverting support frame (100) of paragraph A21.4, wherein the telescoping coupling mechanism (154) is configured to selectively couple at least the second segment (118) to a respective transitioning frame member receiver (122) of the central frame member (120).

A22. The interconverting support frame of any of paragraphs A-A21.4.1, wherein the plurality of transitioning frame members (114) and the plurality of longitudinal frame members (112) are configured to be disconnected from the central frame member (120) in the pack frame assembled configuration (200).

A22.1. The interconverting support frame (100) of paragraphs A22, wherein each longitudinal frame member (112) of the plurality of longitudinal frame members (112) is a transitioning frame member (114).

A22.1.1. The interconverting support frame (100) of paragraph A22.1, wherein each longitudinal frame member (112) of the plurality of longitudinal frame members (112) comprises a/the first segment (116) and a/the second segment (118), wherein the first segment (116) and the second segment (118) are directly interconnected with one another in the pack frame assembled configuration (200), and wherein the first segment (116) and the second segment (118) are directly or operably interconnected with the central frame member (120) in the seat frame assembled configuration (202).

A23. The interconverting support frame (100) of any of paragraphs A-A22.1.1, wherein the central frame member (120) is configured to orient and support the plurality of longitudinal frame members (112) and the plurality of transitioning frame members (114) in the seat frame assembled configuration (202).

A24. The interconverting support frame (100) of any of paragraphs A-A23, wherein the central frame member (120) comprises a plurality of transitioning frame member receivers (122), each being configured to receive and orient a respective transitioning frame member (114) in the seat frame assembled configuration (202), and selectively release the respective transitioning frame member (114) to convert the interconverting support frame (100) from the seat frame assembled configuration (202) to the pack frame assembled configuration (200).

A24.1. The interconverting support frame (100) of paragraph A24, wherein each transitioning frame member receiver (122) is configured to orient the respective transitioning frame member (114) to extend transverse to an adjacent longitudinal frame member (112) in the seat frame assembled configuration (202).

A24.2. The interconverting support frame (100) of any of paragraphs A24-A24.1, wherein each transitioning frame member receiver (122) is configured to orient the respective transitioning frame member (114) to extend transverse to a/the width (136) of the central frame member (120) in the seat frame assembled configuration (202).

A25. The interconverting support frame (100) of any of paragraphs A-A24.2, wherein the central frame member (120) is configured to support at least one pair of longitudinal frame members (112) laterally spaced apart from one another along a/the width (136) of the central frame member (120) in the seat frame assembled configuration (202) and optionally in the pack frame assembled configuration (200).

A26. The interconverting support frame (100) of any of paragraphs A-A25, wherein the central frame member (120) is configured to support two seat-contacting transitioning frame members (142) and/or two ground-contacting transitioning frame members (144) laterally spaced apart from one another along a width (136) of the central frame member (120) in the seat frame assembled configuration (202).

A27. The interconverting support frame (100) of any of paragraphs A-A26, wherein, in the seat frame assembled configuration (202), the interconverting support frame (100) is configured to support the seat fabric (304) with an outermost lateral extent (312) that is greater than a/the width (136) of the central frame member (120) in the pack frame assembled configuration (200).

A27.1. The interconverting support frame of paragraph A27, wherein the central frame member (120) comprises a central frame member telescoping mechanism (170) configured to selectively adjust the width (136) of the central frame member (120), wherein the central frame member telescoping mechanism (170) is configured to selectively retain the central frame member (120) with a first width (136) in the pack frame assembled configuration (200) and with a second width (136) in the seat frame assembled configuration (202), and wherein the second width (136) is greater than the first width (136).

A27.2. The interconverting support frame (100) of any of paragraphs A27-A27.1, wherein, in the seat frame assembled configuration (202), the interconverting support frame (100) comprises a/the pair of seat-contacting transitioning frame members (142) that extend from the central frame member (120) to operably contact and support the seat fabric (304) and a/the pair of ground-contacting transitioning frame members (144) that extend from the central frame member (120) to operably contact the ground surface (300), and wherein the pair of seat-contacting transitioning frame members (142) extend laterally beyond the width (136) of the central frame member (120) such that the pair of seat-contacting transitioning frame members (142) are positioned to support the seat fabric (304) with the outermost lateral extent (312) of seat fabric being greater than the width (136) of the central frame member (120).

A27.2.1. The interconverting support frame (100) of paragraphs A27.2, wherein central frame member (120) orients each seat-contacting transitioning frame member (142) to extend laterally beyond the width (136) of the central frame member (120).

A27.2.2. The interconverting support frame (100) of any of paragraphs A27.2-A27.1.1, wherein each of the pair of seat-contacting transitioning frame members (142) comprises a bend or a kink such that a distal portion of each seat-contacting transitioning frame member (142) extends laterally beyond the width (136) central frame member (120) in the seat frame assembled configuration (202).

A27.2.3. The interconverting support frame (100) of any of paragraphs A27.2-A27.2.2, wherein central frame member (120) orients at least two ground-contacting transitioning frame members (144) to extend laterally beyond the width (136) of the central frame member (120) in the seat frame assembled configuration (202).

A27.2.4. The interconverting support frame (100) of any of paragraphs A27.2-A27.2.3, wherein in the seat frame assembled configuration (202), each seat-contacting transitioning frame member (142) interconnects with and engages a respective ground-contacting transitioning frame member (144) within or via the central frame member (120).

A28. The interconverting support frame (100) of any of paragraphs A-A27, wherein each longitudinal frame member (112) of a/the first pair (124) of longitudinal frame members (112) is oriented in a pack frame orientation in the pack frame assembled configuration (200) and is oriented in a seat frame orientation in the seat frame assembled configuration, and wherein each longitudinal frame member (112) of the first pair (124) of longitudinal frame members (112) is configured to selectively rotate between the pack frame orientation and the seat frame orientation.

A28.1 The interconverting support frame (100) of paragraph A28, wherein the each longitudinal frame member (112) of the first pair (124) of longitudinal frame members (112) is received in a respective longitudinal frame member receiver (150) of the central frame member (120), wherein each longitudinal frame member (112) of the first pair (124) of longitudinal frame members (112) comprises a rotational retaining mechanism (125) configured to engage with the respective longitudinal frame member receiver (150) to restrict the longitudinal frame member (112) from rotating between the pack frame orientation and the seat frame orientation while the longitudinal frame member (112) is received in the respective longitudinal frame member receiver (150), and wherein each longitudinal frame member (112) of the first pair (124) is configured to be selectively removed from the respective longitudinal frame member receiver (150), rotated, and reinserted into the respective longitudinal frame member receiver (150) to transition the interconverting support frame between the seat frame assembled configuration (202) and the pack frame assembled configuration (200).

A28.2 The interconverting support frame (100) of any of paragraphs A28-A28.2, when depending from paragraph A3.5, wherein the first pair (124) of longitudinal frame members (112) extend towards one another in the pack frame assembled configuration (200) and wherein the longitudinal frame members (112) of the first pair (124) extend at least substantially parallel to one another or extend away from one another in the seat frame assembled configuration (202).

B. A load-carrying device (400), comprising:

the interconverting support frame (100) of any of paragraphs A-A28.2 in the pack frame assembled configuration (202); and a pack (402) comprising a frame-receiving region (406) configured to receive and operably couple to the interconverting support frame (100) in the pack frame assembled configuration (200), wherein the pack (402) includes a load compartment (404) configured to carry a load, and wherein the interconverting support frame (100) is configured to distribute a weight of the load across the pack (402).

B1. The load-carrying device (400) of any of paragraph B, wherein the frame-receiving region (406) comprises a plurality of tension pockets (408) configured to selectively engage and selectively release the interconverting support frame (100) in the pack frame assembled configuration (200).

B1.2. The load-carrying device (400) of paragraph B1.1, wherein the plurality of tension pockets (408) includes a pair of opposed tension pockets (408), one of which being positioned along a/the upper portion of the frame-receiving region (406) and the other of which being positioned along a/the lower portion of the frame-receiving region (406), and wherein the interconverting support frame (100) is configured to apply an outward force between the pair of opposed tension pockets (408) to apply tension to the pack (402).

B1.2.1. The load-carrying device (400) of paragraph B1.2, wherein the interconverting support frame (100) is configured to flex to be selectively received within and removed from the pair of opposed tension pockets (408).

B1.2.2. The load-carrying device (400) of any of paragraphs B1.2-B1.2.1, wherein the interconverting support frame (100) is configured in a concave longitudinal conformation relative to a back panel (410) of the pack (402) when engaged with the pair of opposed tension pockets (408).

B2. The load-carrying device (400) of any of paragraphs B-B1.2.2, further comprising a seat fabric (304) stowed in the pack (402) and configured to engage with the interconverting support frame (100) in the seat frame assembled configuration (202) to form a seat therefrom.

C. A seat (301), comprising:

the interconverting support frame (100) of any of paragraphs A-A27.4.2 in the seat frame assembled configuration (202); and a seat fabric (304) configured to engage with and extend between seat-contacting ends (140) of the interconverting support frame (100), wherein the seat fabric (304) comprises receiving regions (306) each being configured to engage with a respective seat-contacting end (140) of the interconverting support frame (100).

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, "selective" and "selectively," when modifying an action, movement, configuration, or other activity of one or more components or characteristics of a tent according to the present disclosure, means that the specified action, movement, configuration, or other activity is a direct or indirect result of user manipulation of an aspect of, or one or more components of, the tent.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, an object that is at least substantially formed from a material includes an object for which at least 75% of the object is formed from the material and also includes an object that is completely formed from the material. As another example, a first direction that is at least substantially parallel to a second direction includes a first direction that forms an angle with respect to the second direction that is at most 22.5 degrees and also includes a first direction that is exactly parallel to the second direction. As another example, a first length that is substantially equal to a second length includes a first length that is at least 75% of the second length, a first length that is equal to the second length, and a first length that exceeds the second length such that the second length is at least 75% of the first length.

INDUSTRIAL APPLICABILITY

The interconverting support frames, load-carrying devices, and seats disclosed herein are applicable to the outdoor, travel, and leisure products and industries.

The invention claimed is:

1. An interconverting support frame (100), comprising:

a plurality of interconnecting frame members (110) configured to be selectively assembled in plurality of assembled configurations, which includes a pack frame assembled configuration (200) and a seat frame assembled configuration (202), wherein the plurality of interconnecting frame members (110) includes:

a central frame member (120);

a plurality of longitudinal frame members (112) configured to engage and support a pack (402) of a load-carrying device (400) in the pack frame assembled configuration (200);

a plurality of transitioning frame members (114) configured to selectively interconnect with and selectively disconnect from the central frame member (120) to transition the interconverting support frame (100) between the pack frame assembled configuration (200) and the seat frame assembled configuration (202);

wherein the plurality of longitudinal frame members (112) and the plurality of transitioning frame members are operably interconnected with the central frame member (120) in the seat frame assembled configuration (202), and wherein the interconverting support frame (100) is configured to support a seat fabric (304) on a ground surface (300) and suspend the seat fabric (304) spaced above the ground surface (300) in the seat frame assembled configuration (202); and wherein the plurality of longitudinal frame members (112) comprises a first pair (124) of longitudinal frame members (112) that are configured to engage an upper portion of a frame-receiving region (406) of the pack (402) in the pack frame assembled configuration (202) and a second pair (126) of longitudinal frame members (112) that are configured to engage a lower portion of the frame-receiving region (406) of the pack (402) that is opposed to the upper portion of the frame receiving region in the pack frame assembled configuration (200).

2. The interconverting support frame (100) of claim 1, wherein the plurality of longitudinal frame members (112) are operatively coupled to and extend from the central frame member (120) in the pack frame assembled configuration (200).

3. The interconverting support frame (100) of claim 1, wherein at least one transitioning frame member (114) of the plurality of transitioning frame members (114) is disconnected from the central frame member (120) in the pack frame assembled configuration (200), and wherein the at least one transitioning frame member (114) of the plurality of transitioning frame members (114) is directly interconnected with the central frame member (120) in the seat frame assembled configuration (202).

4. The interconverting support frame (100) of claim 1, wherein each longitudinal frame member (112) of the first pair (124) of longitudinal frame members (112) includes a length that is greater than that of each longitudinal frame member (112) of the second pair (126) of longitudinal frame members (112).

5. The interconverting support frame (100) of claim 1, wherein the first pair (124) of longitudinal frame members (112) form seat-contacting ends (140) in the seat frame assembled configuration (202), and wherein the second pair (126) of longitudinal frame members (112) form ground-contacting ends (138) in the seat frame assembled configuration (202).

6. The interconverting support frame (100) of claim 1, wherein the second pair (126) of longitudinal frame members (112) are fixedly coupled to the central frame member (120).

7. The interconverting support frame (100) of claim 1, wherein each longitudinal frame member (112) of the first pair (124) of longitudinal frame members (112) is oriented in a pack frame orientation in the pack frame assembled configuration (200) and is oriented in a seat frame orientation in the seat frame assembled configuration (202), and wherein each longitudinal frame member (112) of the first pair (124) of longitudinal frame members (112) is configured to selectively rotate between the pack frame orientation and the seat frame orientation.

8. The interconverting support frame (100) of claim 1, wherein the central frame member (120) supports the first pair (124) of longitudinal frame members (112) laterally spaced apart from one another along a width of central frame member (120), and wherein the central frame member (120) supports the second pair (126) of longitudinal frame members (112) laterally spaced apart from one another along the width of the central frame member (120) in the seat frame assembled configuration (202).

9. The interconverting support frame (100) of claim 1, wherein at least one transitioning frame member (114) of the plurality of transitioning frame members (114) extends between and interconnects two respective longitudinal frame members (112) of the plurality of longitudinal frame members (112) in the pack frame assembled configuration (200).

10. The interconverting support frame (100) of claim 9, wherein the interconverting support frame (100) further includes a plurality of transitioning frame member couplers (152) each being configured to interconnect an end region of a transitioning frame member (114) with a longitudinal frame member (112) in the pack frame assembled configuration (200) and selectively release the end region of the respective transitioning frame member (114) from the respective longitudinal frame member (112) to convert the interconverting support frame (100) from the pack frame assembled configuration (200) to the seat frame assembled configuration (202).

11. The interconverting support frame (100) of claim 1, wherein two transitioning frame members (114) of the plurality of transitioning frame members (114) are segmented transitioning frame members (134), wherein each segmented transitioning frame member (134) comprises a first transitioning frame member segment (130) and a second transitioning frame member segment (132) that are configured to selectively interconnect with and disconnect from one another to transition the interconverting support frame (100) between the pack frame assembled configuration (200) and the seat frame assembled configuration (202).

12. The interconverting support frame (100) of claim 11; wherein, in the pack frame assembled configuration (200), a first of the two segmented transitioning frame members (134) extends between and interconnects the first pair (124) of longitudinal frame members (112), and wherein a second of the two segmented transitioning frame members (134) extends between and interconnects the second pair (126) of longitudinal frame members (112).

13. The interconverting support frame (100) of claim 11, wherein the first transitioning frame member segment (130) and the second transitioning frame member segment (132) of each segmented transitioning frame member (134) are operably interconnected with the central frame member (120) in the seat frame assembled configuration (202).

14. The interconverting support frame (100) of claim 1, wherein the central frame member (120) is configured to orient and support the plurality of longitudinal frame members (112) and the plurality of transitioning frame members (114) in the seat frame assembled configuration (202).

15. The interconverting support frame (100) of claim 14, wherein the central frame member (120) comprises a plurality of transitioning frame member receivers (122), each being configured to receive and orient a respective transitioning frame member (114) in the seat frame assembled configuration (202), and selectively release the respective transitioning frame member (114) to convert the interconverting support frame (100) from the seat frame assembled configuration (202) to the pack frame assembled configuration (200).

16. The interconverting support frame (100) of claim 15, wherein each transitioning frame member receiver (122) is configured to orient the respective transitioning frame member (114) to extend transverse to at least two longitudinal frame members (112) of the plurality of longitudinal frame members (112) in the seat frame assembled configuration (202).

17. A load-carrying device (400), comprising:

the interconverting support frame (100) of claim 1 in the pack frame assembled configuration (202); and a pack (402) comprising a frame-receiving region (406) configured to receive and operably couple to the interconverting support frame (100) in the pack frame assembled configuration (200), wherein the pack (402) includes a load compartment (404) configured to carry a load, and wherein the interconverting support frame (100) is configured to distribute a weight of the load across the pack (402).

18. The load-carrying device (400) of claim 17, wherein the frame-receiving region (406) comprises a plurality of tension pockets (408) configured to selectively engage and selectively release the interconverting support frame (100) in the pack frame assembled configuration (200).

19. A seat (301), comprising:

the interconverting support frame (100) of claim 1 in the seat frame assembled configuration (202); and a seat fabric (304) configured to engage with and extend between seat-contacting ends (140) of the interconverting support frame (100), wherein the seat fabric (304) comprises receiving regions (306) each being configured to engage with a respective seat-contacting end (140) of the interconverting support frame (100).

* * * * *